US008073704B2

(12) United States Patent
Suzuki

(10) Patent No.: US 8,073,704 B2
(45) Date of Patent: Dec. 6, 2011

(54) CONVERSION DEVICE

(75) Inventor: Ryoji Suzuki, Nara (JP)

(73) Assignee: Panasonic Corporation, Osaka (JP)

( * ) Notice: Subject to any disclaimer, the term of this patent is extended or adjusted under 35 U.S.C. 154(b) by 895 days.

(21) Appl. No.: 12/091,420

(22) PCT Filed: Jan. 23, 2007

(86) PCT No.: PCT/JP2007/050963

§ 371 (c)(1),
(2), (4) Date: Apr. 24, 2008

(87) PCT Pub. No.: WO2007/086365

PCT Pub. Date: Aug. 2, 2007

(65) Prior Publication Data

US 2009/0132243 A1 May 21, 2009

(30) Foreign Application Priority Data

Jan. 24, 2006 (JP) ..... 2006-014846

(51) Int. Cl.
*G10L 21/04* (2006.01)

(52) U.S. Cl. ..... 704/503; 700/94

(58) Field of Classification Search ..... 704/211, 704/270, 500–504; 700/94
See application file for complete search history.

(56) References Cited

U.S. PATENT DOCUMENTS 4,852,169 A * 7/1989 Veeneman et al. ..... 704/207
5,341,432 A 8/1994 Suzuki et al.
5,630,013 A 5/1997 Suzuki et al.
6,415,326 B1 * 7/2002 Gupta et al. ..... 709/231
6,801,898 B1 10/2004 Koezuka
2007/0011343 A1 * 1/2007 Davis et al. ..... 709/231
2007/0055397 A1 * 3/2007 Steinberg ..... 700/94

FOREIGN PATENT DOCUMENTS

| | | |
|---|---|---|
| JP | 4104200 | 4/1992 |
| JP | 5-80796 | 4/1993 |
| JP | 6-175675 | 6/1994 |
| JP | 6-222794 | 8/1994 |
| JP | 7-13596 | 1/1995 |
| JP | 9-152889 | 6/1997 |
| JP | 200-259200 | 9/2000 |
| JP | 2000-322100 | 11/2000 |
| JP | 2001-350500 | 12/2001 |
| JP | 2004-505304 | 2/2004 |

OTHER PUBLICATIONS

Suzuki, Ryoji et al.; "An Implementation of a Time-Scale Modification Method on a DSP", The Institute of Electronics, Information and Communication Engineers; Aug. 23, 1990; w/partial verified English translation.

* cited by examiner

*Primary Examiner* — Abul K Azad

(57) ABSTRACT

A plurality of pairs of segments to be weighted/added are selected non-linearly with respect to a time axis of audio data. A speed conversion is achieved by performing the weighting/addition on the selected pairs of segments. The non-linear selection is performed by (a) obtaining all possible pairs of segments constituting the audio data, (b) calculating a degree of similarity pertaining to each possible pair, (c) ranking the all possible pairs of segments according to the degrees of similarity, and (d) overlapping at least one of the all possible pairs of segments that holds the highest degree of similarity.

7 Claims, 24 Drawing Sheets

FIG. 4

SEGMENT SELECTION LOG

| START TIME OF SEGMENT X1 | START TIME OF SEGMENT X2 | DEGREE OF SIMILARITY R(i) | SELECTION M(i) |
|---|---|---|---|
| AAAA | BBBB | CCCC | 1 |
| AAAA' | BBBB' | CCCC' | 1 |
| AAAA'' | BBBB'' | CCCC'' | 0 |
| ... | ... | ... | ... |
| AAAA'''' | BBBB'''' | CCCC'''' | 0 |

NOTE, AAAA<BBBB, AAAA'<BBBB', AAAA''<BBBB'', AAAA''''<BBBB''''
AAAA<AAAA'<AAAA''<AAAA''''
BBBB<BBBB'<BBBB''<BBBB''''

SUBSTRATE IN PLAYBACK DEVICE

CONVERSION DEVICE

TECHNICAL FIELD

The present invention belongs to the technical field of audio speed conversion technology and relates to improving the listenability of audio played back.

BACKGROUND ART

The audio speed conversion technology is technology for changing only the duration time of audio data while maintaining the fundamental frequency (pitch) thereof, and is implemented into a video/audio playback device for improving the audio quality of the audio data during trick playback. The following is a description of a conventional speed conversion.

According to the conventional speed conversion, audio data is divided into a plurality of cycles, and each cycle is further divided into segments each having a length of 12 milliseconds. Assuming here that each cycle is divided into five segments A, B, C, D and E, the following are performed in one of the cycles: (a) obtaining all possible combinations of the five segments; (b) calculating a degree of similarity of each possible combination, the degree of similarity indicating inter-segment similarity; and (c) judging, out of all possible combinations of the five segments, which combination has the highest degree of similarity. If a pair of B and C has the highest degree of similarity of all combinations of A, B, C, D and E, then B and C are overlapped such that B and C are played back simultaneously. B and C can be overlapped by performing the following in listed order: (a) multiplying the segment B, which temporally precedes the segment C, by a window function that gradually decreases with time (hereafter, "decreasing window function"); (b) multiplying the segment C, which is temporally behind the segment B, by a window function that gradually increases with time (hereafter, "increasing window function"); and (c) adding the segments B and C. A result of this overlap is B/C. Accordingly, if the above A, B, C, D and E are output in the form of A, B/C, D and E, then a time length of the cycle would be 4/5 of the original time length thereof. By performing the above-described similarity calculation and overlap in every cycle, a time length of the audio data can be decreased to 4/5 of the original time length thereof.

B and C can also be overlapped by performing the following in listed order: (a) multiplying the segment B, which temporally precedes the segment C, by an increasing window function; (b) multiplying the segment C, which is temporally behind the segment B, by a decreasing window function, and (c) adding the segments B and C. A result of this overlap is C\B. If this C\B is added to the above A, B, C, D and E, and A, B, C, D, and E are output in the form of A, B, C\B, C, D and E, then a time length of the cycle would be increased to 6/5 of the original time length thereof. By performing the above-described similarity calculation and overlap in every cycle, a time length of the audio data can be increased to 6/5 of the original time length thereof.

Known examples of the above-described speed conversion include a method for hearing assistance with a function for controlling the speech speed in audio data (Patent Reference 1), and an audio conversion device that performs the conversion linearly with respect to audio data (Patent Reference 2 or Non-Patent Reference 1).

Patent Reference 1:

Japanese Laid-Open Patent Application No. H05-80796

Patent Reference 2:

Japanese Laid-Open Patent Application No. H04-104200

Non-Patent Reference 1:

Suzuki and Misaki, "An Implementation of a Time-Scale Modification Method on a DSP," Shingakugiho, SP90-34, 1990.

DISCLOSURE OF THE INVENTION

The Problems the Invention is Going to Solve

According to the above-described speed conversion, a signal to be converted is divided into cycles, and each cycle is further divided into a plurality of segments. In every cycle, a pair of segments to be overlapped (hereafter, "overlap targets") is selected from among the plurality of segments. That is, the above-described speed conversion is performed linearly. In other words, overlap targets are selected uniformly with respect to a playback time axis of the audio data. As a result of such a uniform selection, the audio data may sound strange when played back, like a sound generated by fast-forwarding or slow-playing a recording tape. Hence, it can hardly be said that the listenability of the content of the audio data is fully guaranteed.

Recent studies have revealed the fact that it is effective to select a sound period during which a vowel is pronounced (hereafter, "vowel period") and a soundless period as overlap targets. However, in a case where the speed conversion is performed on audio data in which a vowel period of several hundred milliseconds repeats and in which a soundless period repeats on the order of one second, two seconds or the like, the above-described speed conversion will uniformly select overlap targets from both the sound periods and soundless periods. In this view, the speed conversion like the one described above, which divides audio data in cycles and then selects overlap targets from each cycle, has a disadvantage of being inefficient.

The present invention aims to provide a conversion device that can play back audio data after setting the audio data to a desired time length, while maintaining the listenability of the content thereof.

Means to Solve the Problems

In order to solve the stated problem, a conversion device of the present invention comprises: a segment processing unit operable to (a) select at least one pair of segments from a plurality of segments constituting original audio data and (b) overlap playback periods of the selected pair of segments; and a generation unit operable to generate after-conversion audio data by arranging the overlapped segments and unoverlapped segments in playback order, the unoverlapped segments being remainders of the plurality of segments, wherein along a time axis of the original audio data, a positional relationship between the overlapped segments and the unoverlapped segments is non-linear.

Effects of the Invention

Along the time axis of the original audio data, a positional relationship between the overlapped segments and the unoverlapped segments are non-linear. This makes possible a non-linear selection of segments, which is to select many segments (audio) to be overlapped from a soundless period or a vowel period, but select no segments at all from a sound period during which a consonant is pronounced (hereafter, "consonant period"). This way it is possible to select, as overlap targets, a vowel period and a soundless period that are concentrated in certain parts of the audio data. Accordingly, the time length of the audio data can be increased or decreased without significantly changing the frequency of the original audio.

Such an increase/decrease in the time length of the audio data is similar to a human being's unintentional attempt to speed up or slow down their speech. By increasing/decreasing the time length of the audio data, the audio data played back after the speed conversion sounds similar to a human speech. Put another way, it is possible to give the after-conversion audio data a resemblance to a change in a speech speed that a human makes while speaking. Accordingly, the stated conversion device has the effect of reducing problems such as a lack of sound, sound duplication, and deterioration in sound quality.

The overlap targets are selected non-linearly from the audio data. Therefore, the longer the audio data subject to speed conversion, the wider range the overlap targets are selected from. As opposed to the case where the speed conversion is performed linearly, the stated conversion device does not limit the location of overlap targets to within a certain cycle. Thus, compared to the case of linear speed conversion, the stated conversion device can extend or compress the audio data highly efficiently.

There may be a case where, out of the overlapped segments, one segment only contains a voice of a particular person, while the other segment contains a voice of the same person with background music or noise. Even in such a case, the stated conversion device selects this set of segments as overlap targets, as long as these segments are judged to hold higher similarity to each other than to the rest of the segments. The stated conversion device can thereby play back or output the audio data in accordance with a desired compression/extension ratio.

Although optional, further effects can be achieved by adding the following technical matters to the technical matter (technical matter 1) of the conversion device described above, and using specific structures for the stated conversion device.

{Technical Matter 2}

The conversion device further comprises: a calculation unit operable to (a) generate all possible pairs of the plurality of segments and (b) calculate a degree of similarity pertaining to each possible pair of the plurality of segments, wherein the overlapped segments are one of the all possible pairs of the plurality of segments that holds the highest degree of similarity, and the unoverlapped segments are included in remainders of the all possible pairs of the plurality of segments.

Adding this technical matter to technology specifying the conversion device of the present invention makes it possible to determine a time difference between segments that hold a high degree of similarity, and also to select a pair or set of segments to be weighted/added, based on a single scale of evaluation (i.e., the degree of similarity). This provides the effect of reducing the processing complexity and processing amount.

{Technical Matter 3}

In the conversion device, the segment processing unit includes a selection subunit operable to (a) obtain a time difference between each of the at least one pair of segments to be overlapped and (b) accumulate the time difference, and the selection subunit selects, one by one, the at least one pair of segments to be overlapped, as long as the following condition is satisfied: the accumulated time difference is equal to or smaller than a target time length, which is a time length of the after-conversion audio data.

Adding this technical matter to technology specifying the conversion device of the present invention makes it possible to select one or more pairs/sets of segments to be weighted/added until a desired time axis conversion ratio is achieved. This provides the effect of changing the time axis conversion ratio finely and accurately.

{Technical Matter 4}

The conversion device that is implemented as an audio conversion device into a playback device that plays back and outputs video and audio, wherein the playback device includes a video conversion device that converts a playback speed of the video, and the video conversion device converts the playback speed of the video by freezing or skipping a part of a plurality of frames constituting video data.

Adding this technical matter to technology specifying the conversion device of the present invention makes it possible to freeze or skip a part of video frames constituting the video data, and thus to convert the speed of the video data almost evenly (i.e., linearly) with respect to a time axis of the video data.

Consequently, such a speed conversion can be performed with simple processing, but can make the video data look stable and smooth when displayed. At the same time, the speed of the audio data can be converted naturally, with the result that the after-conversion audio data sounds similar to a change in a speech speed that a human makes while speaking.

There is a possibility that audio and video may get out of sync along the way. However, since the stated conversion device converts the audio speed non-linearly but accurately according to a desired conversion ratio, the stated conversion device has the effect of making a time length of video to match a time length of audio at least by the end of conversion.

BRIEF DESCRIPTION OF THE DRAWINGS

FIG. 4 shows a segment selection log.

DESCRIPTION OF CHARACTERS

Figure 1:
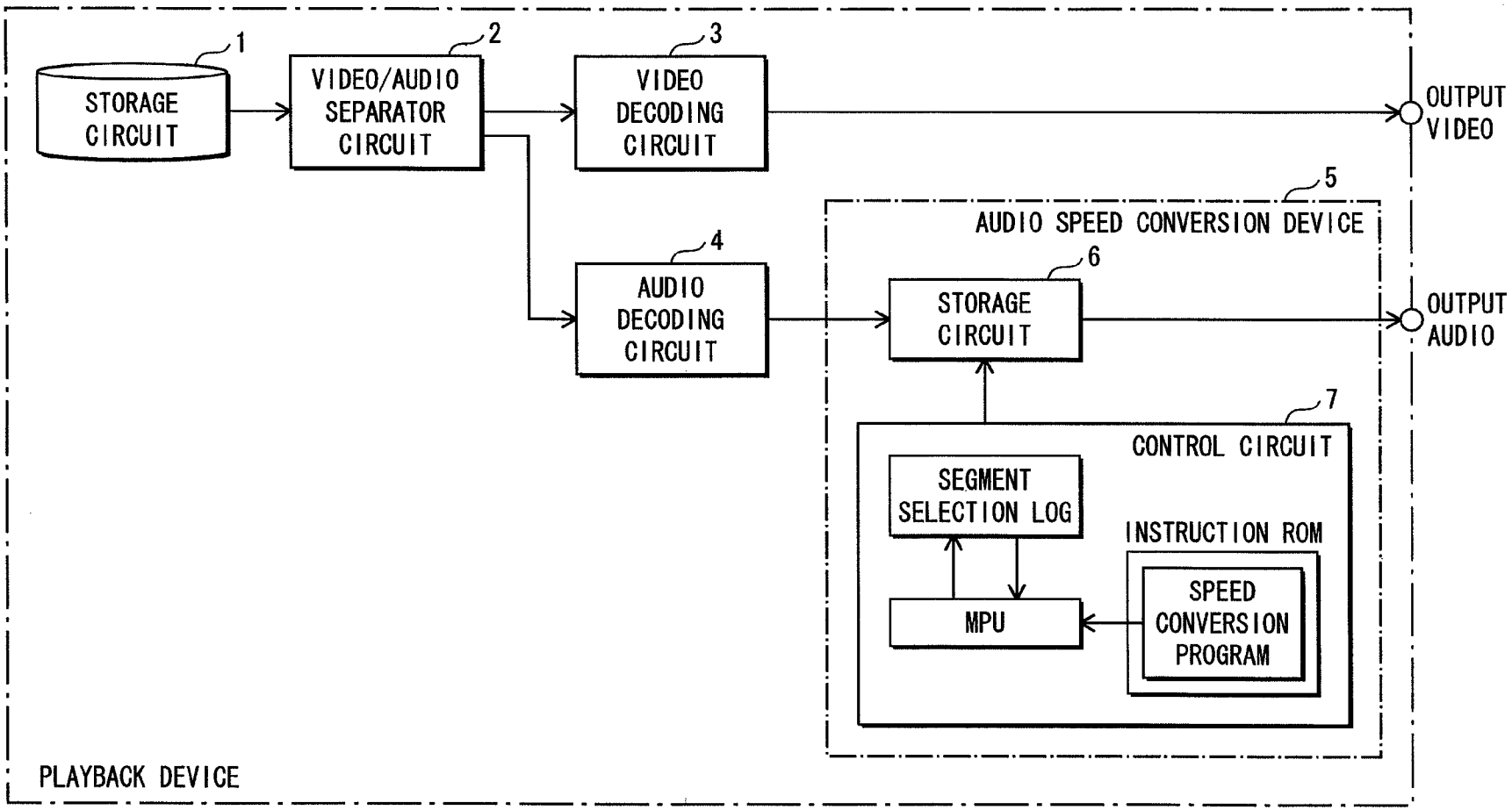
FIG. 1 shows an internal structure of a playback device into which a conversion device is implemented.

1 storage circuit
2 video/audio separator circuit
3 video decoding circuit
4 audio decoding circuit
5 audio speed conversion device
6 storage circuit
7 control circuit
8 video speed conversion device
9 control circuit
101 storage circuit
102 switch circuit
103 buffer memory circuit
104 buffer memory circuit
105 similarity calculation circuit
106 judgment circuit
107 window function generation circuit
108 switch circuit
109 switch circuit
110 multiplication circuit
111 multiplication circuit
112 addition circuit
113 switch circuit
114 output buffer circuit
115 speed setting circuit
116 parameter storage circuit
117 pointer value calculation circuit
118 pointer control circuit
119 control signal generation circuit
120 parameter extraction circuit

BEST MODE FOR CARRYING OUT THE INVENTION

First Embodiment

The following describes embodiments of a conversion device pertaining to the present invention, with reference to the accompanying drawings. The conversion device of the present invention is implemented into a playback device and is used as a part of an audio playback function.

The conversion device performs speed conversion by performing the following in listed order: (a) reading out original audio data stored in a rewritable recording medium, such as a semiconductor memory card and HDD; (b) temporarily decoding the read original audio data to an uncompressed state; (c) from among segments constituting the stated uncompressed audio data, selecting a set of segments nonlinearly with respect to a playback time axis of the original audio data, the set of segments being located within a time range Tr specified by a user; and (d) overlapping the set of segments, and then outputting the set of overlapped segments together with the rest of the segments. An assembly of segments that is output in the above-described manner is audio data for trick playback.

The audio data for trick playback denotes audio data that the playback device plays instead of the original audio data when performing trick playback. The audio data for trick playback is written into a recording medium in correspondence with each of (a) the original audio data, which is the source of the conversion, (b) a time range Tr pertaining to the original audio data, and (c) a ratio $\alpha$ of a playback time axis of the audio data for trick playback to the playback time axis of the original audio data.

This way, if the playback device is instructed at a later date to perform trick playback of the original audio data by converting a part of the original audio data that is within the time range Tr according to the ratio $\alpha$, then the playback device can retrieve, from among all pieces of audio data for trick playback that are stored in the recording medium, audio data for trick playback that corresponds to a set of (a) the original audio data, (b) the time range Tr, and (c) the ratio $\alpha$, and can play back the retrieved audio data for playback instead of the original audio data. Here, the audio data for trick playback, which is read out from the recording medium and then played back, is pre-made. Accordingly, the audio data for trick playback sounds clear when provided to a user.

In the present embodiment, it is intended to temporarily store the audio data for trick playback before playing back the same. Hence, it is not imperative that the conversion device performs a real-time speed conversion.

FIG. 1 shows an internal structure of the playback device into which the conversion device is implemented. As shown in FIG. 1, the playback device comprises a storage circuit 1, a video/audio separator circuit 2, a video decoding circuit 3, an audio decoding circuit 4, a storage circuit 6, and a control circuit 7.

The storage circuit 1 stores (a) video data compressed using encoding methods such as MPEG2-Video and MPEG4-AVC, and (b) audio data compressed using encoding methods such as MPEG2-AAC and Dolby Digital. The storage circuit 1 outputs desired video data and desired audio data in accordance with an address value output by the control circuit.

The video data and audio data, which have been output from the storage circuit 1, are input to the video/audio separator circuit 2. The video/audio separator circuit 2 outputs the video data to the video decoding circuit 3 and the audio data to the audio decoding circuit 4.

The video decoding circuit 3 decodes the video data, which has been output from the video/audio separator circuit 2, into a video signal.

The audio decoding circuit 4 decodes the audio data, which has been output from the video/audio separator circuit 2, into uncompressed audio data, and then stores the uncompressed audio data into the storage circuit 6.

The control circuit 7 is a one-chip microcontroller composed of MPU and ROM that provides an instruction code to MPU. The control circuit 7 performs speed conversion on a part of the uncompressed audio data that is within a predetermined time range Tr, the uncompressed audio data being stored in a memory as a result of the decoding performed by the audio decoding circuit. Specifically, what this speed conversion does is non-linearly extract, from among all possible combinations of segments that are located within the predetermined time range Tr of the audio data, one or more sets of segments that each hold the exceptionally high degree of similarity and thus are subject to weighting/addition.

One characteristic feature of the present invention lies in that the overlap targets are selected non-linearly. The following schematically describes the principle of this non-linear selection.

Figure 2:
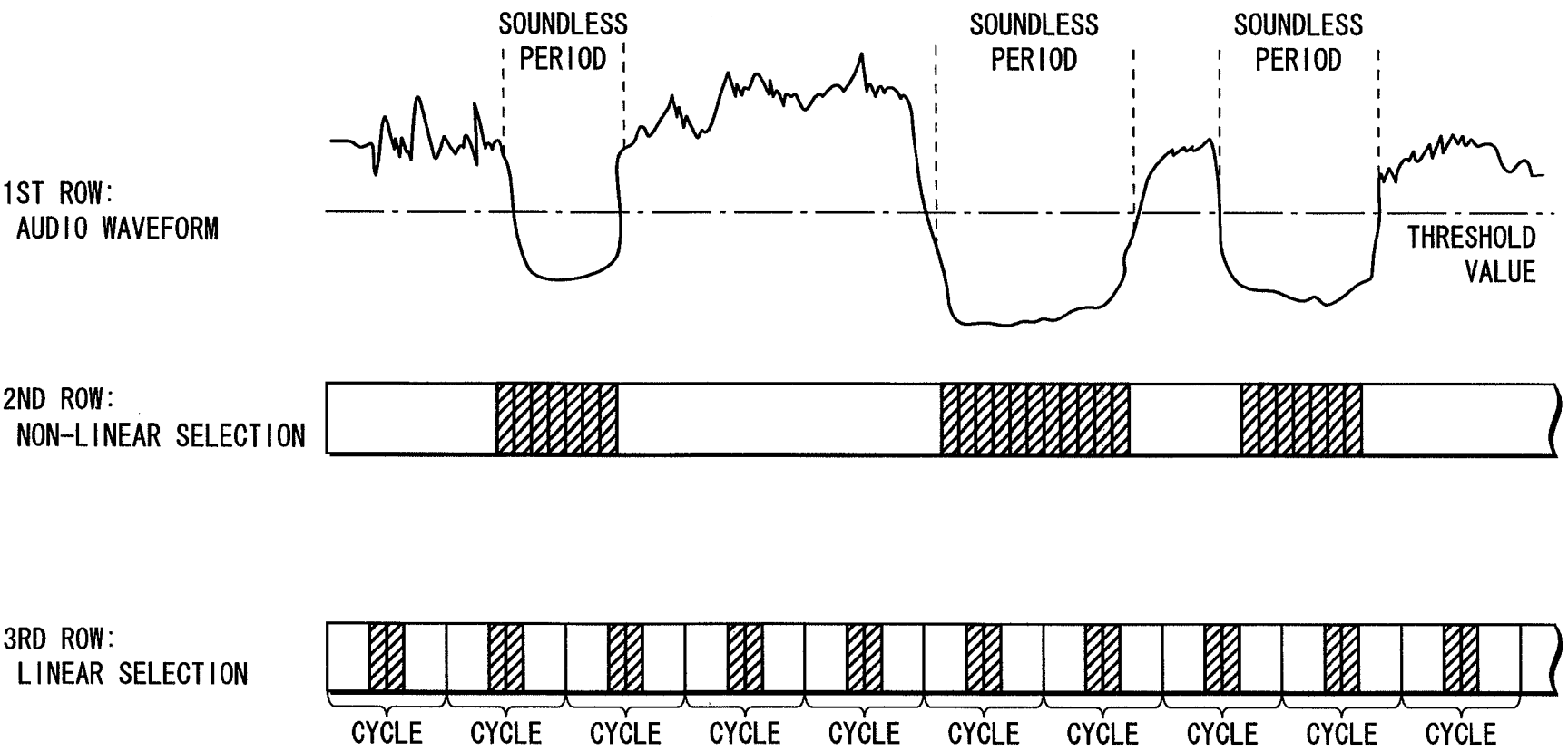
FIG. 2 shows a plurality of segments that are selected non-linearly.

FIG. 2 shows a plurality of segments that are selected non-linearly. Here, the first row shows an audio signal level corresponding to the original audio data. The second row shows segments that are non-linearly selected from the original audio data. The third row shows segments that are linearly selected from the original audio data. In the third row, each pair of segments that are extracted as overlap targets is hatched. In observing the location of each pair of hatched segments in the third row, one can see that overlap targets are selected from every cycle specified by "{". This indicates that, with a linear selection, overlap targets are uniformly selected from each one of the cycles included in the audio data, where each cycle includes a plurality of segments.

Likewise, in the second row, each set of segments that are extracted as overlap targets is hatched. In observing the location of each pair of hatched segments in the second row, one can see that overlap targets are selected from within a soundless period during which a crest value of the audio signal level shown in the first row becomes less than a threshold value. This indicates that, with a non-linear selection, overlap targets are selected intensively from within the soundless period, regardless of a cycle that repeats at certain intervals throughout the audio data.

Figure 3:
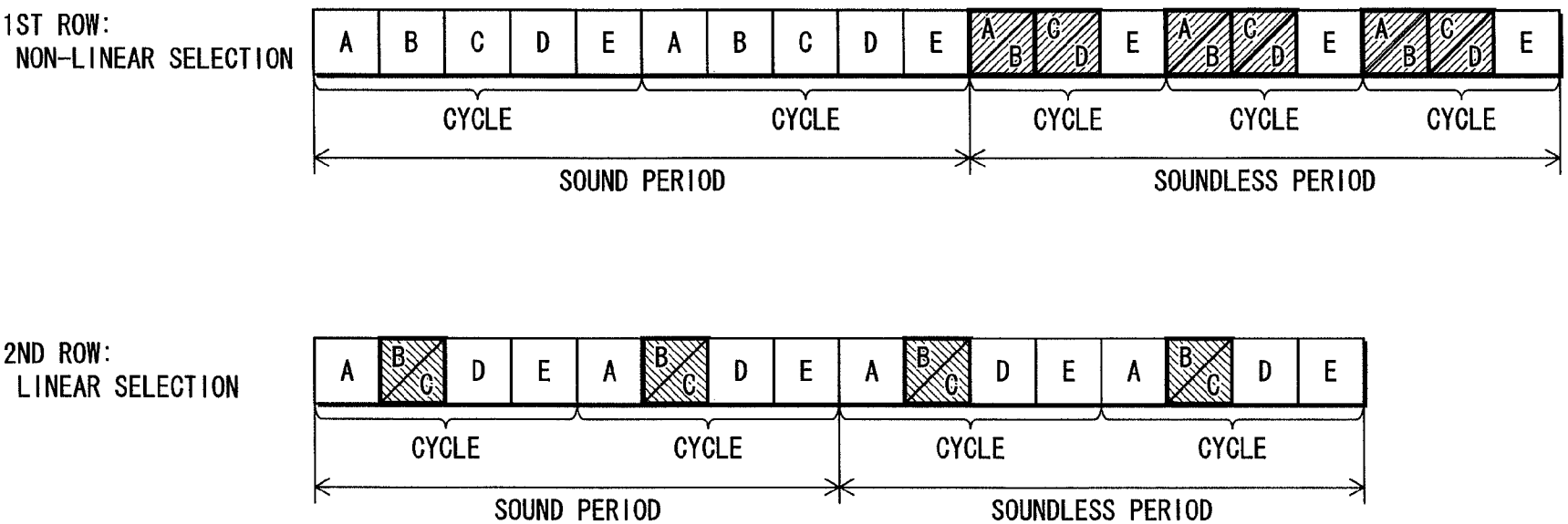
FIG. 3 shows how the segments selected in FIG. 2 are overlapped.

FIG. 3 shows how the segments selected in FIG. 2 are overlapped. In FIG. 3, the first row shows overlap of segments that are selected non-linearly, and the second row shows overlap of segments that are selected linearly. The first and second rows particularly show a certain part of the audio data shown in FIG. 2, the certain part being where a sound period is switched to a soundless period.

In the second row, B/C represents a pair of segments that are linearly selected as overlap targets. In observing the locations of B/C, one can see that such overlap targets are uniformly selected not only from cycles included in the sound period, but also from cycles included in the soundless period.

In the first row, A/B and C/D each represents a set of segments that are non-linearly selected as overlap targets. In observing the locations of A/B and C/D, one can see that such overlap targets are selected intensively from cycles included in the soundless period, but not from any cycle included in the sound period.

The following is a further description of requirements for the aforementioned non-linear selection.

<Target of Non-Linear Selection>

It is acknowledged that a period to be a target of non-linear selection (i.e., the soundless period exemplarily shown in FIG. 2) has the following characteristic property: a degree of correlativity among segments is high, or a minimum square error is small. The degree of correlativity being high, or the minimum square error being small, indicates that "a degree of similarity among segments is high". In the present invention, a set of such segments that exhibit high similarity to each other is selected non-linearly.

The following formulae can be used to calculate a square error and a correlation function.

The square error, which represents a degree of similarity, is calculated using <Formula 1>. For simplicity, a unit of time and a sampling cycle are regarded to be equal in <Formula 1>.

$$\text{Square Error} = \sum_{j=1}^{Ts} (X1(j) - X2(j))^2 \qquad \text{< Formula 1 >}$$

The correlation function, which also represents a degree of similarity, is calculated using <Formula 2>. For simplicity, a unit of time and a sampling cycle are regarded to be equal in <Formula 2>.

$$\text{Correlation Function} = \sum_{j=1}^{Ts} (X1(j) \times X2(j)) \qquad \text{< Formula 2 >}$$

Such a period that includes segments holding high similarity to each other is not limited to a soundless period. A sound period, within which vowels are concentrated, could also include segments holding high similarity to each other. Furthermore, if a formula other than the above <Formula 1> and <Formula 2> is used to calculate a degree of similarity, then there is a possibility that other periods having different characteristics may also include segments holding high similarity to each other. In the present invention, a target of non-linear selection is a period that includes a set of segments whose degree of similarity, which is calculated in the above-described manner, is high.

Depending on which one of the minimum square error or the correlation function is used as the degree of similarity, criterion for selecting segments varies. That is, one will select segments that hold high similarity to each other, while the other will select segments that hold low similarity to each other. Hereafter, a high degree of similarity is expressed by the smallness of the minimum square error, and the criterion for selecting segments is whether the degree of similarity is high or not, unless otherwise stated.

Also, according to <Formula 1> and <Formula 2>, minimum square errors and correlation functions of a set of X1(1)-X1 (Ts) and a set of X2(1)-X2(Ts) are calculated. Accordingly, the set of X1(1)-X1 (Ts) and the set of X2(1)-X2(Ts) are targets of non-linear selection. Hereafter, the set of X1(1)-X1 (Ts) and the set of X2(1)-X2(Ts) are referred to as X1 and X2, respectively, and are each considered as a single unit of processing.

<Range of Selection>

The above-stated non-linear selection is performed on an assembly of segments satisfying a relationship of <Formula 3> or <Formula 4>.

$$(\text{Time Length of Input Signal})\times(\alpha-1)\leqq\Sigma(\text{Time Difference between Selected Segments}) \quad \text{<Formula 3>}$$

$$(\text{Time Length of Input Signal})\times(1-\alpha)\leqq\Sigma(\text{Time Difference between Selected Segments}) \quad \text{Formula 4>}$$

Here, $\alpha$ denotes a ratio of a time axis of output audio data to a time axis of input audio data. <Formula 3> is applied in a case where $\alpha\geqq1$, and <Formula 4> is applied in a case where $\alpha<1$.

The case where $\alpha\geqq1$ is when the time axis is extended. The case where $\alpha<1$ is when the time axis is compressed. In each of <Formula 3> and <Formula 4>, the left-hand side denotes a target time length of audio data, whereas the right-hand side denotes an accumulated sum of a time difference between selected segments. Thus, an assembly of segments satisfying the relationship of <Formula 3> or <Formula 4> can be obtained by performing the following: (a) calculating a degree of similarity of all possible sets of segments constituting the audio data; (b) ranking these sets of segments in order of highest degree of similarity; and (c) repeatedly selecting a set of segments in order of highest degree of similarity. As stated above, the calculation of a degree of similarity is performed on the set of X1(1)-X1(Ts) and the set of X2(1)-X2(Ts). Accordingly, the selection according to <Formula 3> and <Formula 4> is performed on the set of X1(1)-X1 (Ts) and the set of X2(1)-X2(Ts) as well.

<Overlap>

Each set of segments that has been non-linearly selected is subject to overlap according to the following formulae.

$$Y(n)=W1(n)\times X1(n)+W2(n)\times X2(n) \quad \text{<Formula 5>}$$

n=1−Ts $$Y(n)=W2(n)\times X1(n)+W1(n)\times X2(n) \quad \text{<Formula 6>}$$

n=1−Ts

Here, W1($n$) is an increasing window function and W2($n$) is a decreasing window function. Ts represents the number of segments. As set forth, the calculation of degree of similarity, as well as the selection of segments, is performed on the set of X1(1)-X1(Ts) and the set of X2(1)-X2(Ts). Thus, the overlap according to <Formula 5> and <Formula 6> is performed on the set of X1(1)-X1(Ts) and the set of X2(1)-X2(Ts).

It should be noted that, as described earlier, the present invention has created a technical idea of selecting overlap targets non-linearly with respect to the time axis. The hardware structure or the software structure disclosed herein is merely an example of something rational that can implement such a technical idea into an actual playback device. The following describes how this idea is applied to software in order to make MPU perform speed conversion.

Described below is how to non-linearly select overlap targets. As set forth, the calculation of degree of similarity, the selection, and the overlap are performed on the set of X1(1)-X1(Ts) and the set of X2(1)-X2(Ts).

Hereafter, these two sets of segments are abbreviated as X1 and X2, respectively. X1 temporally precedes X2.

To extend the time axis, X1 is shifted with reference to X2 (X2 is temporally behind X1). A segment to be referenced (X2) is selected as just described so as to shift X1 along the playback time axis with X2 being fixed. This way it is possible to maintain continuity between X2 and a part that precedes X2, while concurrently changing a time difference between a start time of X1 and a start time of X2 by the maximum time lag Tl_max to the minimum time lag Tl_min.

The following describes Tl_max, Tl_min, and time lengths of segments. For example, it is said that the fundamental frequency of an audio signal ranges approximately from 50 to 500 Hz. Therefore, the maximum cycle length and the minimum cycle length of an audio signal are respectively 20 msec, which is an inverse of 50 Hz, and 2 msec, which is an inverse of 500 Hz. The time lengths of the above-described segments X1 and X2 are each set to 12 msec, which is the middle between 2 msec and 20 msec. The time length of the minimum time lag Tl_min is set to 2 msec (the minimum wave period) or less, whereas the time length of the maximum time lag Tl_max is set to 20 msec or more. This way it is possible to perform weighting/addition on an input audio signal whose fundamental frequency ranges from 50 to 500 Hz, while keeping phases of segments constituting the input audio signal in-phase to each other. However, in view of the operation amount, a segment that is in-phase with X2 may not be actually searched if the distance between its start time and the start time of X2 is less than 2 msec or more than 20 msec. Thus, when performing the speed conversion with use of software or hardware, it is desirable to set the minimum time lag Tl_min to a value obtained by adding/subtracting a predetermined time to/from the minimum cycle length of an input signal—that is, to a value in the proximity of the minimum cycle length. Likewise, it is preferable to set the maximum time lag Tl_max to a value obtained by adding/subtracting a predetermined period to/from the maximum cycle length of the input signal—that is, to a value in the proximity of the maximum cycle length.

On the other hand, to compress the time axis, X2 is shifted with reference to X1 (X1 temporally precedes X2). A segment to be referenced (X1) is selected as just described so as to shift X2 along the playback time axis with X1 being fixed. This way it is possible to maintain continuity between X1 and a part that precedes X1, while concurrently changing a time difference between start times of X1 and X2 by the maximum time lag Tl_max and the minimum time lag Tl_min. In shifting the subsidiary segment, when the subsidiary segment is in a location where it holds the highest similarity to X1 than any other segment, the start time of the subsidiary segment is expressed as an optimal time lag Tl_min. Here, among X1 and X2, one that is fixed to be referenced is referred to as "a base segment", and the other that is shifted to search the highest degree of similarity is referred to as "a subsidiary segment".

Such a calculation of degree of similarity and a selection of segments can be performed using a selection log shown in FIG. 4. FIG. 4 shows a segment selection log. Each piece of data included in this log is composed of the following items that correspond to one another, and the following items should be input to edit the log, or add a new piece of data to the log: a pair of a start time of X1 and a start time of X2; a degree of similarity R(i); and a selection flag M(i). In FIG. 4, the first piece of data is composed of the following items that correspond to one another: a pair of time AAAA and time BBBB, a degree of similarity CCCC, and a selection flag indicating a value "1".

The second piece of data is composed of the following items that correspond to one another: a pair of time AAAA' and time BBBB'; a degree of similarity CCCC'; and a selection flag indicating a value "1".

Figures 5A, 5B, 5C:
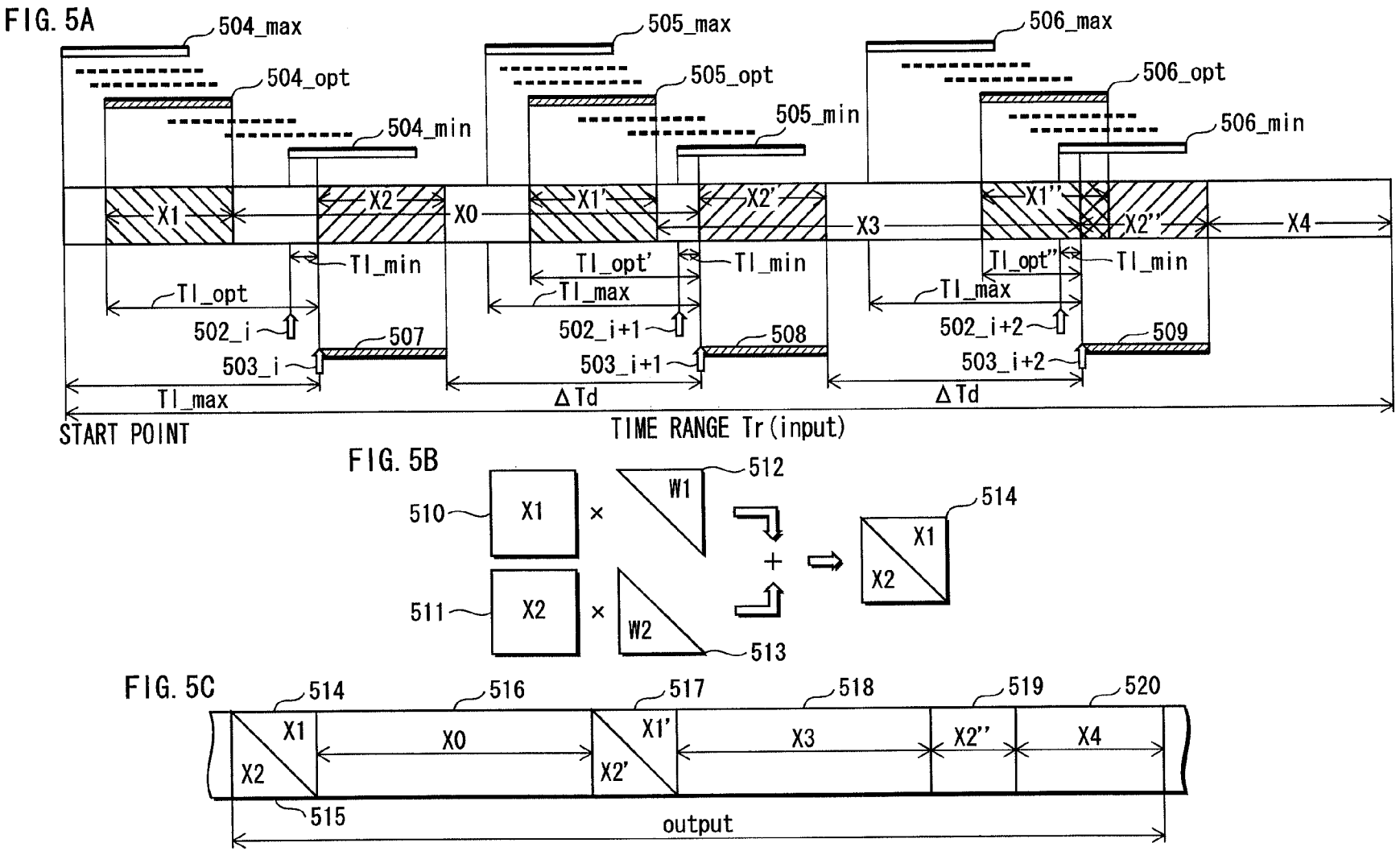
FIG. 5A shows three pairs of X1 and X2 that are each selected for holding the highest degree of similarity in extending a time axis of audio data.
FIG. 5B schematically shows an operation executed when X1 and X2 are overlap targets.
FIG. 5C shows an output that is made by selecting and overlapping X1 and X2 as well as X1' and X2' as shown in FIG. 5A.

FIGS. 5A-5C show possible locations of X1, X2, Tl_max, Tl_min, and Tl_opt along the time axis. FIG. 5A shows three pairs of X1 and X2 that are each selected for holding the highest degree of similarity in extending the time axis.

In FIGS. 5A, 507, 508 and 509 each represent a signal period to be X2. A start time of 507 is Tl_max apart from the start of the audio data. An interval between 508 and 507 is a predetermined interval ΔTd. Likewise, an interval between 508 and 509 is the same predetermined interval ΔTd. This predetermined interval ΔTd is, for example, longer than Tl_max.

The start time of X1 is located somewhere between (a) a point that is Tl_max apart from the start time of X2 and (b) a point that is Tl_min apart from the start time of X2.

(Case: X2 is Located at 507)

502_*i* is a location of a first pointer indicating a start time of X1, and 503_*i* is a location of a second pointer indicating a start time of X2. 502_*i* is calculated using the formula 503_*i*−Tl_min, and is thereby set as a default for the first pointer.

X1 can be shifted and thus be located anywhere within a range of 504_min to 504_max. In other words, X1 is shifted anywhere within this range by updating the first pointer with the second pointer being fixed in the stated location. In FIG. 5A, how X1 is gradually shifted from 504_min to 504_max is schematically illustrated using "- - - ". Shifting X1 in such a manner allows searching the location where X1 has the highest similarity to X2. When X2 is located at 507, 504_max is one of possible locations of X1 and is obtained using the formula 503_*i*−Tl_max. Likewise, when X2 is located at 507, 504_min is another one of possible locations of X1 and is obtained using the formula 503_*i*−Tl_min.

In shifting X1 within the range of 504_max to 504_min, 504_opt is a location of X1 where X1 holds the highest similarity to X2. A start time of 504_opt is calculated using the formula 503_*i*−Tl_opt. Tl_opt is obtained by shifting X1 within the stated range to search the location of X1 that holds the highest similarity to X2. A start time of Tl_opt denotes a time difference between start times of X1 and X2 that hold the highest degree of similarity.

(Case: X2 is Located at 508)

In this case, X1 and X2 are regarded as X1' and X2', respectively.

502_*i*+1 is a location of a first pointer indicating a start time of X1', and 503_*i*+1 is a location of a second pointer indicating a start time of X2'. 502_*i*+1 is calculated using the formula 503_*i*+1−Tl_min, and is thereby set as a default for the first pointer.

X1' can be located anywhere within a range of 505_min to 505_max. In other words, X1' is shifted anywhere within this range by updating the first pointer with the second pointer being fixed in the stated location. In FIG. 5A, how X1' is gradually shifted from 505_min to 505_max is schematically illustrated using "- - - ". Shifting X1' in such a manner allows searching the location where X1' has the highest similarity to X2'. When X2' is located at 508, 505_max is one of possible locations of X1' and is obtained using the formula 503_*i*+1−Tl_max. Likewise, when X2' is located at 508, 505_min is another one of possible locations of X1 and is obtained using the formula 503_*i*+1−Tl_min.

In shifting X1' within the range of 505_max to 505_min, 505_opt is a location of X1' where X1' holds the highest similarity to X2'. A start time of 505_opt is calculated using the formula 503_*i*+1−Tl_opt'. When X2' is located at 508, this 505_opt is bound to be obtained.

(Case: X2 is Located at 509)

In this case, X1 and X2 are regarded as X1" and X2", respectively.

502_*i*+2 is a location of a first pointer indicating a start time of X1", and 503_*i*+2 is a location of a second pointer indicating a start time of X2". 502_*i*+2 is calculated using the formula 503_*i*+2−Tl_min, and is thereby set as a default for the first pointer.

X1" can be located anywhere within a range of 506_min to 506_max. In other words, X1" can be shifted anywhere within this range by updating the first pointer with the second pointer being fixed in the stated location. In FIG. 5A, how X1" is gradually shifted from 506_min to 506_max is schematically illustrated using "- - - ". Shifting X1" in such a manner allows searching the location where X1" has the highest similarity to X2". When X2" is located at 509, 506_max is one of possible locations of X1' and is obtained using the formula 503_*i*+2−Tl_max. Likewise, when X2" is located at 508, 506_min is another one of possible locations of X1" and is obtained using the formula 503_*i*+2−Tl_min.

In shifting X1" within the range of 506_max to 506_min, 506_opt is a location of X1" where X1" holds the highest similarity to X2". A start time of 506_opt is calculated using the formula 503_*i*+2−Tl_opt".

An accumulated sum of time differences between X1 and X2, X1' and X2', and so on, is referred to Tas. After X1, X2, X1' and X2' shown in FIGS. 5A-5C are selected, X1" and X2" are not selected if the accumulated sum Tas exceeds a target time length Ta by selecting X1" and X2". This leaves only the pair of X1 and X2 and the pair of X1' and X2' as overlap targets. When the pair of X1 and X2 and the pair of X1' and X2' are selected, X3 and X4 shown in FIGS. 5A-5C are output unmodified.

FIG. 5B schematically shows an operation executed when X1 and X2 are overlap targets.

In FIG. 5B, the operation "X1×W1" denotes multiplying X1 (510) by a decreasing window function. The size of a square representing X1 indicates the data size of X1, and the size of a triangle representing W1 indicates a compression ratio according to W1. That is, by multiplying X1 by W1, X1 is compressed down to the size of the triangle representing W1.

In FIG. 5B, the operation "X2×W2" denotes multiplying X2 (511) by an increasing window function 513. The size of a square representing X2 indicates the data size of X2, and the size of a triangle representing W2 indicates a compression ratio according to W2. That is, by multiplying X2 by W2, X2 is compressed down to the size of the triangle representing W2.

The operation "+" in FIG. 5B denotes adding "X1×W1" to "X2×W2". An added signal "X2\X1" is a sum of X1 that has been compressed by W1 and X2 that has been compressed by W2.

FIG. 5C shows an output that is made by selecting and overlapping X1 and X2 as well as X1' and X2' as shown in FIG. 5A. Here, an output signal is composed of the following output periods: "X2\X1", "X0", "X2'\X1'", "X3", "X2"" and "X4". "X2\X1" is an output made by adding "X1×W2" to "X2×W2". "X2'\X1'" is an output made by adding "X1'×W1" and "X2'×W2". "X3" is output unmodified.

"X2'"" and "X4" are also output unmodified.

Figure 6A:
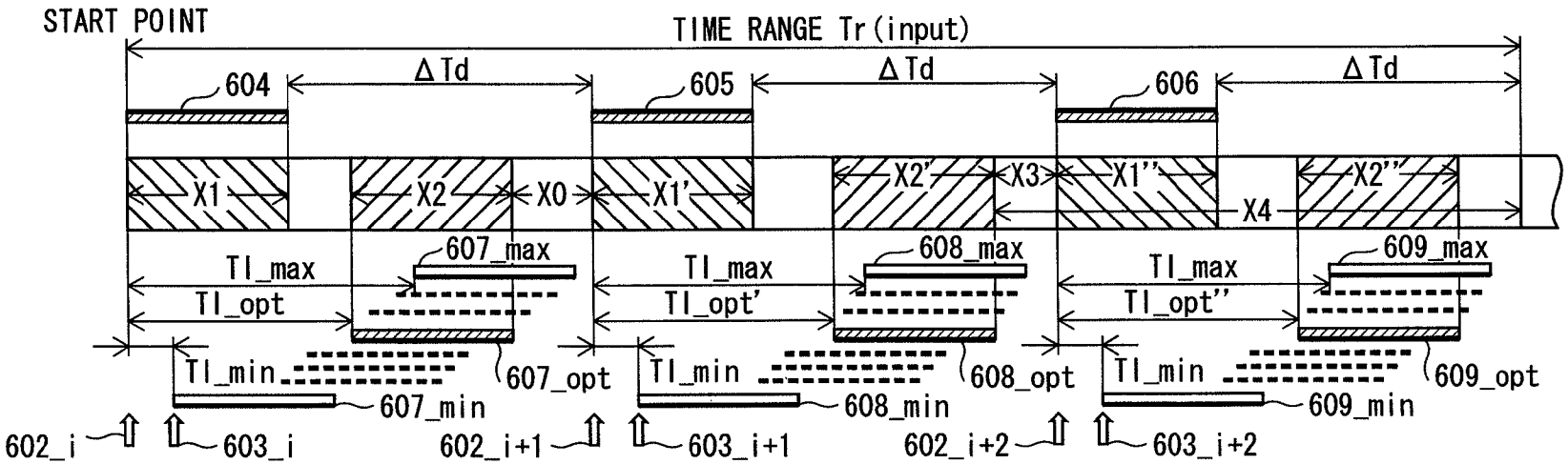
FIG. 6A shows three pairs of X1 and X2 that are each selected for holding the highest degree of similarity in compressing the time axis of the audio data.

FIG. 6A shows three pairs of X1 and X2 that are each selected for holding the highest degree of similarity in compressing the time axis of the audio data.

604, 605 and 606 represent locations of X1. A start time of X2 is located somewhere between (a) a point that is Tl_max apart from a start time of X1 and (b) a point that is Tl_min apart from the start time of X1.

(Case: X1 is Located at 604)

602_*i* is a location of a first pointer indicating a start time of X1, and 603_*i* is a location of a second pointer indicating a start time of X2. The second pointer is set to a default, which is a value calculated using the formula 602_*i*+Tl_min.

X2 can be located anywhere within a range of 607_min to 607_max. In other words, X2 is shifted anywhere within this range by updating the second pointer with the first pointer being fixed in the stated location. In FIG. 6A, how X2 is gradually shifted from 607_min to 607_max is schematically illustrated using "- - - ". Shifting X2 in such a manner allows searching the location where X2 has the highest similarity to X1. When X1 is located at 604, 607_max is one of possible locations of X2 and is obtained using the formula 602_*i*+Tl_max. Likewise, when X1 is located at 604, 607_min is another one of possible locations of X2 and is obtained using the formula 602_*i*+Tl_min.

In shifting X2 within the range of 607_max to 607_min, 607_opt is a location of X2 where X2 holds the highest similarity to X1. A start time of 607_opt is calculated using the formula 602_*i*+Tl_opt.

(Case: X1 is Located at 605)

In this case, X1 and X2 are regarded as X1' and X2', respectively. When X1' is located at 605, 602_*i*+1 is a location of a first pointer indicating a start time of X1', and 603_*i*+1 is a location of a second pointer indicating a start time of X2'. The second pointer is set to a default, which is a value calculated using the formula 602_*i*+1+Tl_min.

X2' can be located anywhere within a range of 608_min to 608_max. In other words, X2' is shifted anywhere within this range by updating the second pointer with the first pointer being fixed in the stated location. In FIG. 6A, how X2' is gradually shifted from 608_min to 608_max is schematically illustrated using "- - - ". Shifting X2' in such a manner allows searching the location where X2' has the highest similarity to X1. When X1' is located at 605, 608_max is one of possible locations of X2' and is obtained using the formula 602_*i*+l+Tl_max. Likewise, when X1' is located at 605, 608_min is another one of possible locations of X2' and is obtained using the formula 602_*i*+l+Tl_min.

In shifting X2' within the range of 608_max to 608_min, 608_opt is a location of X2' where X2' holds the highest similarity to X1'. A start time of 608_opt is calculated using the formula 602_*i*+l+Tl_opt'. When the first pointer indicates 602_*i*+1 and X1' is located at 605, this 608_opt is bound to be obtained with respect to the first pointer.

(Case: X1 is Located at 606)

In this case, X1 and X2 are regarded as X1" and X2", respectively. 602_*i*+2 is a location of a first pointer indicating a start time of X1", and 603_*i*+2 is a location of a second pointer indicating a start time of X2".

X2" can be located anywhere within a range of 609_min to 609_max. In other words, X2" can be shifted anywhere within this range by updating the second pointer with the first pointer being fixed in the stated location. In FIG. 6A, how X2" is gradually shifted from 609_min to 609_max is schematically illustrated using "- - - ". Shifting X2' in such a manner allows searching the location where X2" has the highest similarity to X1". When X1" is located at 606, 609_max is one of possible locations of X2" and is calculated using the formula 602_*i*+2+Tl_max. Likewise, when X1" is located at 606, 609_min is another one of possible locations of X2" and is obtained using the formula 602_*i*+2+Tl_min.

In shifting X2" within the range of 609_max to 609_min, 609_opt is a location of X2" where X2" holds the highest similarity to X1". A start time of 609_opt is calculated using the formula 602_*i*+2+Tl_opt". When the first pointer indicates 602_*i*+2 and X1" is located at 606, this 609_opt is bound to be obtained with respect to the first pointer.

Figure 6B:
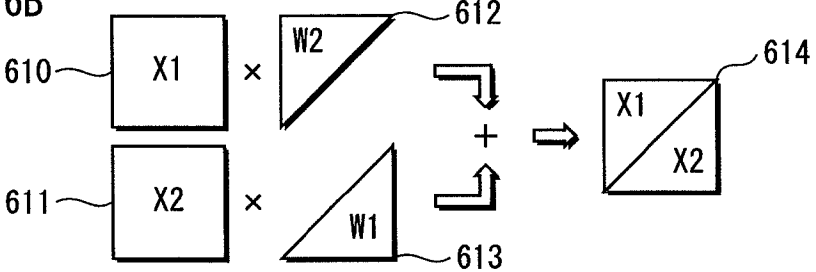
FIG. 6B schematically shows an operation executed when X1 and X2 are overlap targets.
Figure 6C:
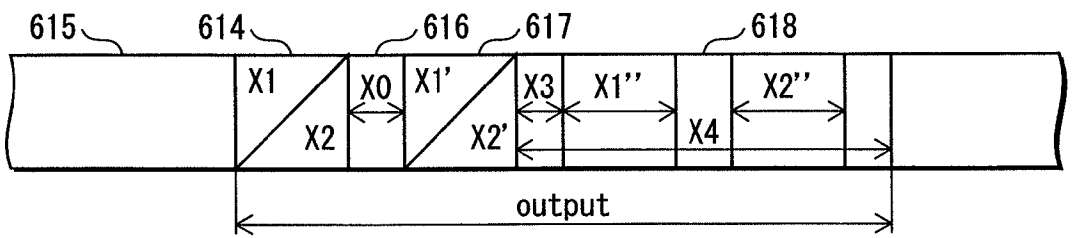
FIG. 6C shows an output that is made by selecting and overlapping X1 and X2 as well as X1' and X2' as shown in FIG. 6A.

After X1, X2, X1' and X2' shown in FIGS. 6A-6C are selected, X1" and X2" are not selected if the accumulated sum Tas exceeds a target time length Ta by selecting X1" and X2". This leaves only the pair of X1 and X2 and the pair of X1' and X2' as overlap targets. When the pair of X1 and X2 and the pair of X1' and X2' are selected, X3 and X4 shown in FIGS. 6A-6C are output unmodified. Since X1, X2, X1' and X2' are selected, X0 is located between X2 and X1', and X3 is located between X2' and X1". Meanwhile, since X1" and X2" are not selected, all of the segments that follow X2' make up X4.

FIG. 6B schematically shows an operation executed when X1 and X2 are overlap targets.

In FIG. 6B, the operation "X1×W1" denotes multiplying X1 (610) by a decreasing window function 612. The size of a square representing X1 indicates the data size of X1, and the size of a triangle representing W2 indicates a compression ratio according to W2. That is, by multiplying X1 by W2, X1 is compressed down to the size of the triangle representing W2.

In FIG. 6B, the operation "X2×W1" denotes multiplying X2 (611) by an increasing window function 613. The size of a square representing X2 indicates the data size of X2, and the size of a triangle representing W1 indicates a compression ratio according to W1. That is, by multiplying X2 by W1, X2 is compressed down the size of the triangle representing W1.

The operation "+" in FIG. 6B denotes adding "X1×W2" to "X2×W1". An added signal "X1/X2" is a sum of X1 that has been compressed by W2 and X2 that has been compressed by W1.

FIG. 6C shows an output that is made by selecting and overlapping X1 and X2 as well as X1' and X2' as shown in FIG. 6A. Here, an output signal is composed of the following output periods: "X1/X2", "X0", "X1'/X2'" and "X4".

"X1/X2" is an output made by adding "X1×W2" to "X2×W1". "X0" is output unmodified.

"X1'/X2'" is an output made by adding "X1'×W2" to "X2'×W1". "X4" is output unmodified.

According to FIGS. 5A-5C and 6A-6C, X1 and X2 have a gap therebetween when the following conditions are met: the starting times of X1 and X2 are Tl_max apart from each other; and the time length of each segment takes an intermediate value between Tl_min and Tl_max. On the other hand, X1 and X2 overlap when the following conditions are met: the start times of X1 and X2 are Tl_min apart from each other; and the time length of each segment takes an intermediate value between Tl_min and Tl_max. Put another way, it is conditional in FIGS. 5A-5C and 6A-6C that a time length of each segment is set to an intermediate value between the maximum cycle length and the minimum cycle length of the audio signal.

In order for software to execute the aforementioned speed conversion, the following must be performed: (a) generating a computer program (hereafter "program") by writing, in a computer description language, processing procedures of FIGS. 7-10 to extend the time axis and processing procedures of FIGS. 12-15 to compress the time axis; and (b) making MPU execute the program. Note that FIGS. 11A-11C and 16A-16C shall be used as references in the following descriptions of flowcharts.

Figure 7:
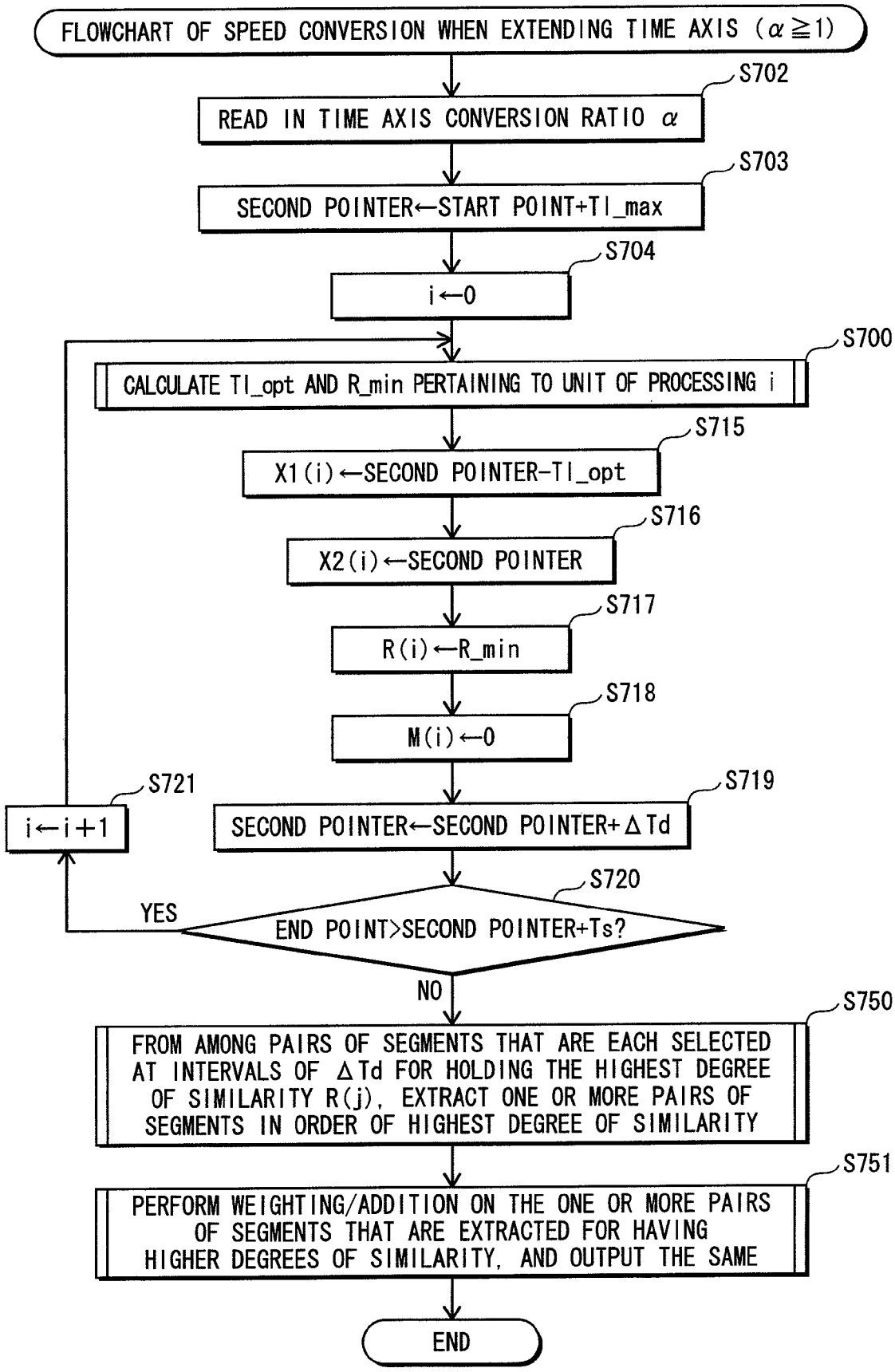
FIG. 7 is a flowchart showing a processing procedure for performing speed conversion when extending the time axis ($\alpha \geqq 1$).

FIG. 7 is a flowchart showing a processing procedure for performing speed conversion when extending the time axis ($\alpha \geqq 1$). Note, Steps shown in flowcharts of FIGS. 7-10 are labeled in the 700s, so that they are differentiated from Steps shown in flowcharts of FIGS. 12-15.

Step S702 involves reading in a time axis conversion ratio $\alpha$. Step S703 involves setting a second pointer to a default, which is time Tl_max (maximum time lag) behind a point at which the time range Tr ends (hereafter, "start point"). Step S704 involves setting a unit of processing counter i to a default 0. Steps S700 and S715-S721 form a loop, with Step S720 serving as an end-of-loop condition and a variable i being a control variable. Step S704 gives this loop an initial condition.

Step S700 involves calculating an optimal time lag Tl_opt and a minimum square error R_min pertaining to a unit of processing i. Step S715 involves storing a start time of X1(*i*) (the first segment in the unit of processing i), which is time obtained by deducting the optimal time lag Tl_opt from time indicated by the second pointer. Step S716 involves storing the time indicated by the second pointer as a start time of X2(*i*) (the second segment in the unit of processing i).

Step S717 involves storing the calculated minimum square error R_min as a degree of similarity R(i) pertaining to the unit of processing i.

Step S718 involves setting a selection M(i) pertaining to the unit of processing i to "0", which indicates that the pair of segments in the unit of processing i is not extracted. Step S719 involves shifting the second pointer forward by "the second pointer+ΔTd".

Step S720 involves comparing (a) a sum of time indicated by the second pointer and a time length Ts of a unit of processing to (b) a point at which the time range Tr ends (hereafter, "end point"). Step S720 specifies the end-of-loop condition. As long as the stated sum is smaller than the end-point, the loop is repeated. Once the above sum exceeds the end point, the conversion device proceeds to Step S750. As set forth, this loop allows (a) shifting the second pointer in increments of ΔTd, and (b) calculating a minimum square error R(i) for each set of coordinates along the time axis.

Step S750 involves extracting, from among the pairs of segments that are selected at intervals of ΔTd for holding the highest degree of similarity R(j), one or more pairs of segments holding exceptionally high degrees of similarity in order of highest degree of similarity. This extraction is performed until an accumulated extended time Tas reaches a required extended time Ta that is obtained according to <Formula 3>.

Step S751 involves performing weighting/addition on the one or more pairs of segments that are extracted for holding exceptionally high degrees of similarity, and then outputting the same.

Figure 8:
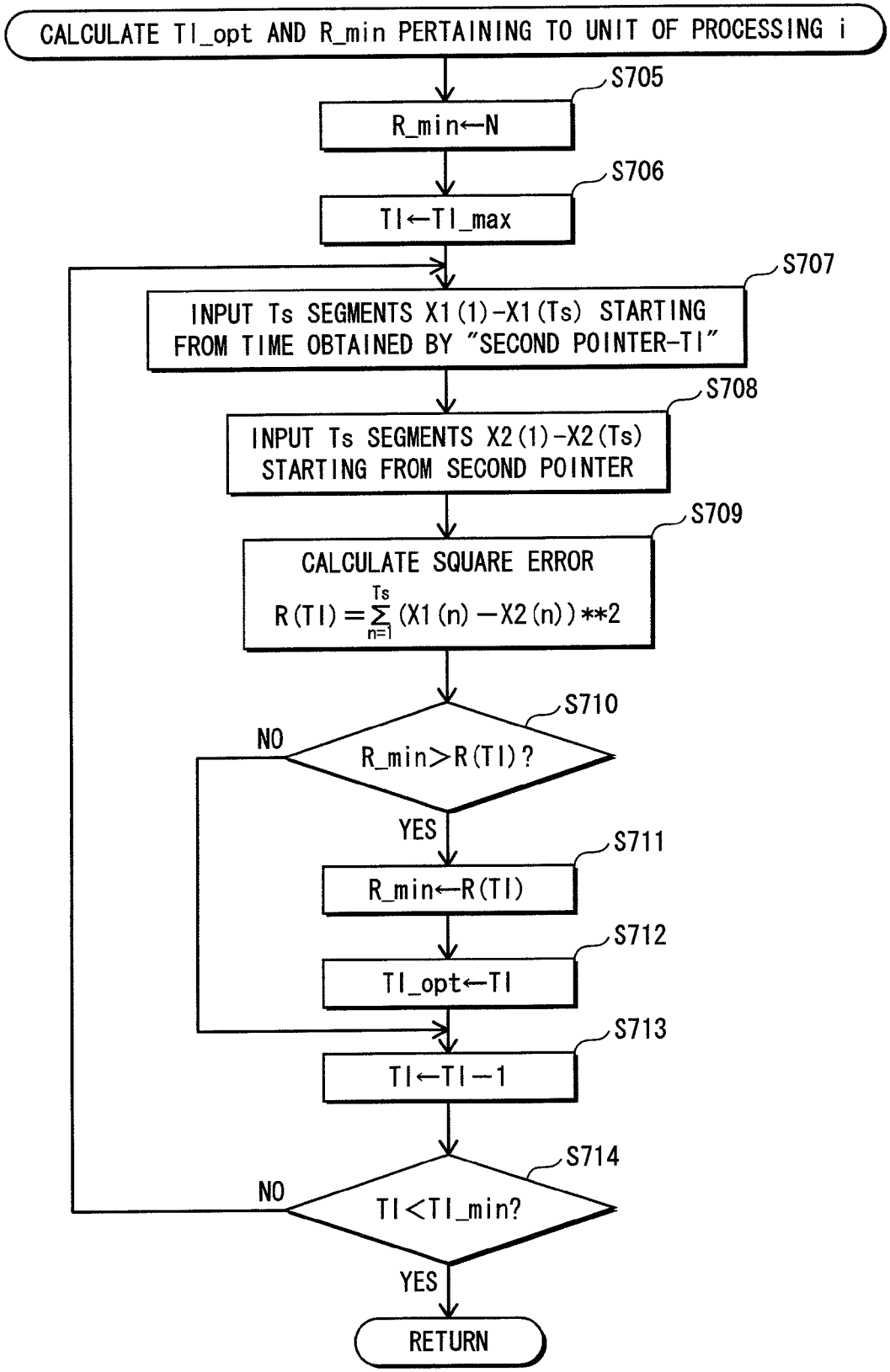
FIG. 8 is a flowchart showing a detail of a processing procedure for calculating an optimal time lag Tl_opt and a minimum square error R_min pertaining to a unit of processing i.

FIG. 8 is a flowchart showing a detail of a processing procedure for calculating the optimal time lag Tl_opt and the minimum square error R_min in the unit of processing i.

Step S705 involves setting the minimum square error R_min to a default N. Step S706 involves setting a time lag Tl to a default Tl_max. Steps S707-S714 form a loop, with Step S714 serving as an end-of-loop condition and a variable Tl being a control variable.

Step S707 involves inputting Ts segments (Ts represents the number of segments) starting from "time indicated by the second pointer—Tl". Step S708 involves inputting Ts segments starting from the time indicated by the second pointer. These steps allow inputting X1(1)-X1 (Ts) and X2(1)-X2 (Ts), which are shown in <Formula 1> and <Formula 2>.

In Step S709 involves calculating, according to <Formula 1>, a square error R(Tl) of X1 and X2 when the time lag is Tl.

Step S710 involves comparing the minimum square error R_min to the square error R(Tl), so as to determine whether to execute or skip Steps S711 and S713.

The conversion device executes Steps S711 and S712 when the square error R (Tl) is smaller than R_min, but skips and proceeds to Step S713 when the square error R(Tl) is greater than R_min.

Step S711 involves updating the minimum square error R_min, such that the updated minimum square error R_min takes a value of the square error R(Tl).

Step S712 involves updating the optimal time lag Tl_opt, such that the updated optimal time lag Tl_opt takes a value of the time lag Tl.

Step S713 involves reducing the time lag Tl by one sample.

Step S714 is a judging step and involves comparing the time lag Tl to a minimum time lag Tl_min. In order for this loop to end, it must be judged YES in Step S714. When the time lag Tl is not smaller than the minimum time lag Tl_min, the conversion device returns to Step S707, repeatedly executing this loop. However, when the time lag Tl is smaller than the minimum time lag Tl_min, the conversion device returns to the flowchart of FIG. 7 and proceeds to Step S715, so as to change the time lag Tl to somewhere from the maximum time lag Tl_max to the minimum time lag Tl_min. Since Tl ranges from Tl_max to Tl_min and the first pointer is located at "time indicated by the second pointer—Tl_min", the first pointer is located in a range of "time indicated by the second pointer—Tl_max" to "time indicated by the second pointer—Tl_min".

Steps included in this flowchart are executed each time the variable i is incremented and the second pointer is shifted in increments of ΔTd. That is to say, each time the second pointer is shifted in increments of ΔTd, the first pointer is also shifted to be located in a range of "time indicated by the second pointer—Tl_max" to "time indicated by the second pointer—Tl_min". Executing Steps included in the flowchart enables calculation of a location of X1 where X1 holds the highest similarity to X2, and this calculation is performed each time the second pointer is shifted in increments of ΔTd.

The following is a detailed description of Step S750. As will be explained below, Step S750 involves extracting one or more pairs of segments that satisfy the relationship of <Formula 3>. This procedure is illustrated in a flowchart of FIG. 9.

Figure 9:
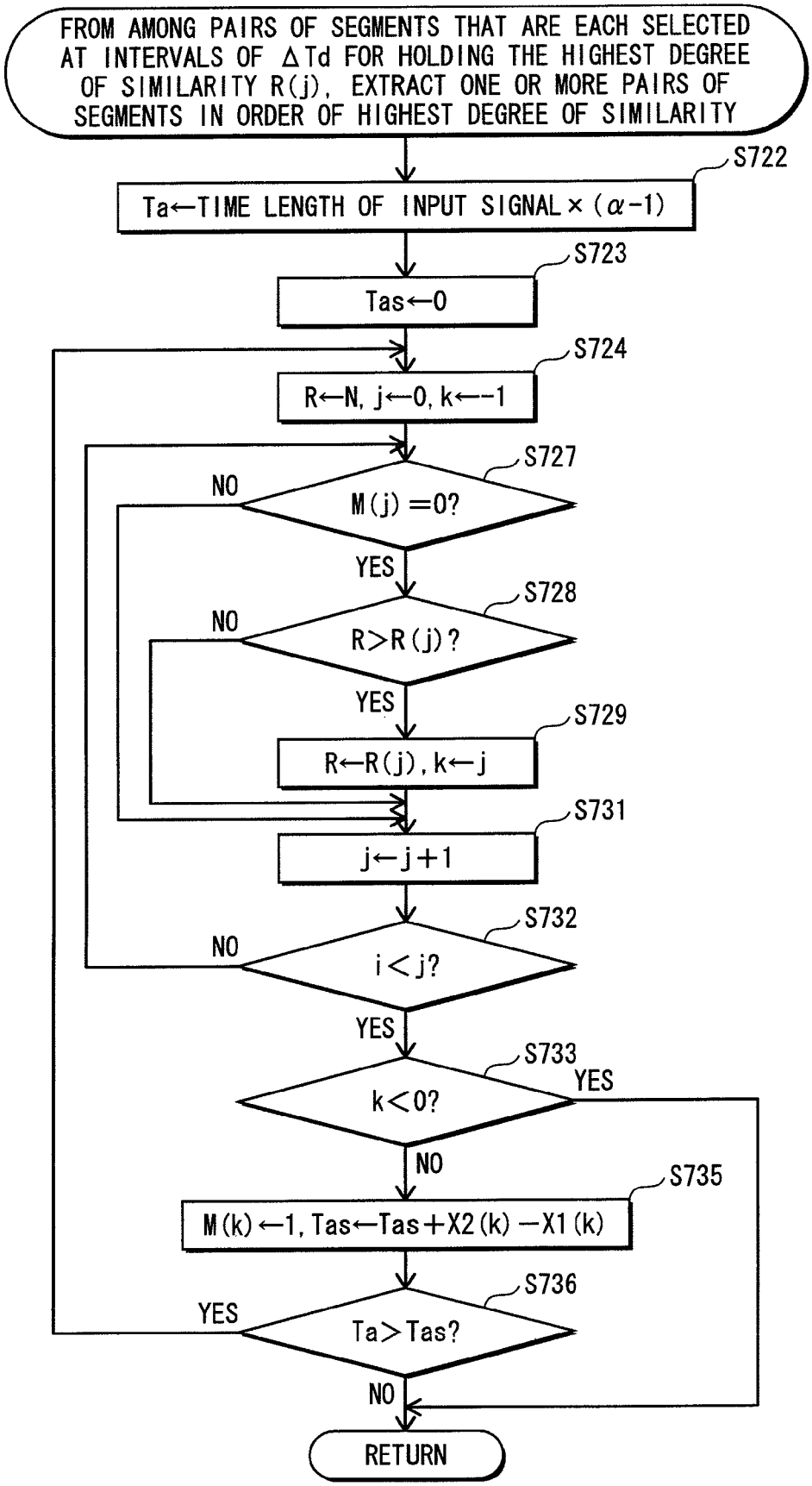
FIG. 9 is a flowchart showing a processing procedure for extracting, from among pairs of segments that are selected at intervals of $\Delta Td$ for holding the highest degree of similarity R(j), one or more pairs of segments holding exceptionally high degrees of similarity in order of highest degree of similarity.

FIG. 9 is a flowchart showing a processing procedure for extracting, from among pairs of segments that are selected at intervals of ΔTd for holding the highest degree of similarity R(j), one or more pairs of segments holding exceptionally high degrees of similarity in order of highest degree of similarity.

Steps S722-S736 represent a loop processing that changes a unit of processing i at intervals of ΔTd, from the start point to the end point.

Step S722 involves calculating the required extended time Ta according to the time axis conversion ratio $\alpha$.

Step S723 involves setting the accumulated extended time Tas to a default 0. Steps S724-S736 form a first loop, with Step S736 serving as an end-of-loop condition and a variable Tas being a control variable. Step S723 gives the first loop an initial condition.

Step S724 involves setting a degree of similarity R to a default N, a unit of processing counter j to a default 0, and a unit of processing k to a default −1. The letter j indicates at least one of pairs of X1 and X2 that is to be a target of processing, the pairs of X1 and X2 being identified by a variable ranging from 0 to i.

Steps S727-S732 form a second loop, with Step S732 serving as an end-of-loop condition and a variable j being a control variable. Step S724 gives the second loop an initial condition. In the second loop, j is changed into a number ranging from 0 to i (Steps S731 and S732), and updates R such that R takes a value of the smallest R(j) (Steps S728 and S729). Also, j that makes R(j) the smallest is stored as k.

Step S727 involves judging whether or not a selection flag M(j) pertaining to the unit of processing j indicates 0, and determining whether to execute or skip Steps S728 and S729. Since j is changed into a number in the above-mentioned range (i.e., from 0 to i) in the second loop, there is a possibility that the conversion device may redundantly select a pair of X1 and X2 that has already been selected. It is an object of Step S727 to eliminate such a possibility of redundant selection.

Step S728 involves comparing (a) the degree of similarity R to (b) a degree of similarity R(j) pertaining to the unit of processing j, and determining whether to execute or skip Step S729. In this flowchart, the degree of similarity is measured using a minimum square error. The comparison in Step S728 is expressed by "R>R(j)", which is to judge whether R(j) is smaller than R. When the degree of similarity R is smaller than the degree of similarity R(j) (this case the minimum square error is large), the conversion device proceeds to Step S729. On the other hand, when the degree of similarity R is greater than the degree of similarity R(j) (this case the minimum square error is not large), the conversion device skips Step S729 and proceeds to Step S732.

Step S729 involves updating the degree of similarity R, such that the updated degree of similarity R takes a value of the degree of similarity R(j) pertaining to the unit of processing j. Here, the selected unit of processing k is also updated as a unit of processing j.

Step S731 involves incrementing the variable j.

Step S732 involves comparing i to a unit of processing counter j, and specifies the end-of-loop condition of the second loop. By the time the conversion device reaches Step S732, the above-mentioned loop processing is completed, and i consequently denotes the total number of units of processing. When the total number of units of processing i is greater than j of the unit of processing j, the conversion device returns to Step S727 and repeats the second loop. When the total number of units of processing i is smaller than j of the unit of processing j, the conversion device exits the second loop and proceeds to Step S733.

When judged YES in the comparison of Step S728 in the second loop, R is updated such that updated R takes a value of R(j) (Step S729). Therefore, the value of R becomes the smallest when $0 \leqq j \leqq i$. Also, j that makes R(j) the smallest is stored as k.

Step S733 involves judging whether or not the selected unit of processing k indicates a negative number, and specifies an end-of-loop condition of this loop. The selected unit of processing k indicating a negative number means that k has never been updated throughout the second loop. When the selected unit of processing k indicates a negative number, processing of this flowchart is terminated.

Step S735 involves (a) setting a selection M(k) of the selected unit of processing k to 1, the selected unit of processing k including a pair of segments that hold a higher degree of similarity, and (b) updating the accumulated extended time Tas. Here, the accumulated extended time Tas is updated by adding the accumulated extended time Tas to a time difference between (a) a start time of X2(*k*) in the kth unit of processing and (b) a start time of X1(*k*) in the kth unit of processing. By repeating such an addition throughout the first loop, a time difference between X1 and X2 is accumulated and added to Tas.

Step S736 involves judging whether the required extended time Ta after the update has exceeded the accumulated extended time Tas. If not, the conversion device returns to Step S724 and repeats the loop, so as to select a pair of segments that holds the next highest degree of similarity. If the required extended time Ta after the update exceeds the accumulated extended time Tas, then the conversion device regards that the end-of-loop condition is satisfied and terminates the processing of the flowchart.

As described above, processing to obtain the highest possible degree of similarity R (Steps S728 and S729) is executed when the selection flag M(j) is set to 0. Hence, by updating Tas while concurrently updating M(j) to 1 in Step S735, a value of j that has been once selected is excluded from selection targets. Then in the second round of the first loop, X(j) with the second smallest value is set as the degree of similarity R. Likewise, in the third round of the first loop, X (j) with the third smallest value is set as the degree of similarity R. This way, pairs of X1 and X2 are selected in order of smallest degree of similarity R.

Figure 10:
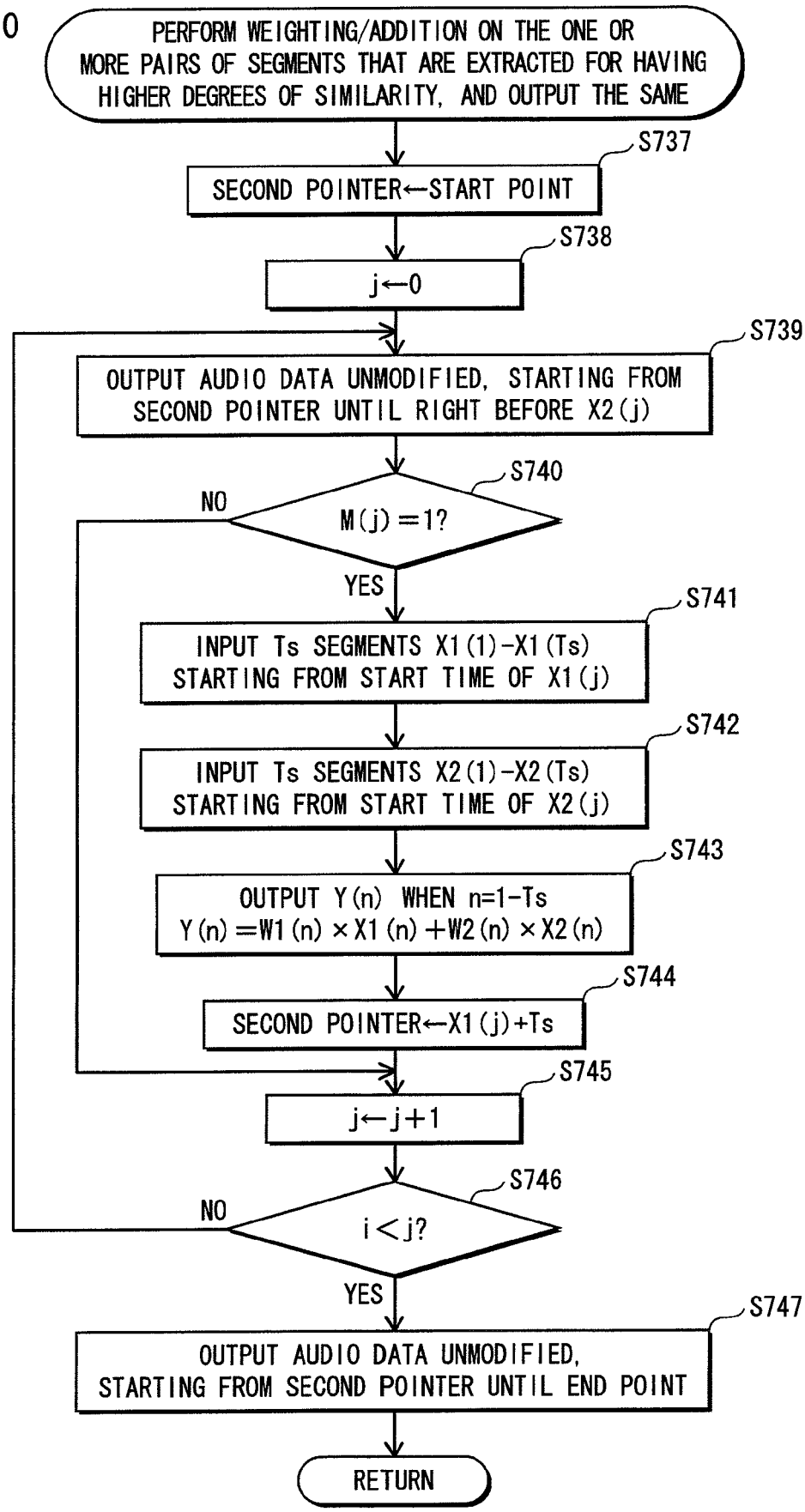
FIG. 10 is a flowchart showing a processing procedure for performing weighting/addition on, and then outputting, the one or more pairs of segments that are each extracted for holding the exceptionally high degree of similarity.

The following describes a detailed processing procedure of Step S751. Step S751 represents a procedure for overlapping each pair of segments based on <Formula 5>. This procedure is illustrated in detail in FIG. 10. FIG. 10 is a flowchart showing a processing procedure for performing weighting/addition on, and outputting, the one or more pairs of segments that are each extracted for holding the exceptionally high degree of similarity.

According to FIG. 9, the extracted pairs of segments are sorted in order of highest degree of similarity. However, it is not possible to output these pairs of segments both in order of highest degree of similarity and in playback order. For this reason, in FIG. 10, the extracted pairs of segments are re-extracted as overlap targets in playback order by resetting the second pointer to "start point+Tl_max".

In Step S737, the second pointer is set as the start point. Step S738 involves setting a unit of processing counter j to a default 0.

Steps S739-S746 form a loop, with Step S746 serving as an end-of-loop condition and a variable j being a control variable.

Step S739 involves inputting the audio data, starting from time indicated by the second pointer until right before X2(*j*) pertaining to the jth unit of processing, and outputting the input audio data unmodified.

Step S740 involves judging whether or not the selection flag M(j) is set to 1, and determining whether to skip or execute Steps S741-S744. Regarding the variable j that could change in the range of 0 to i, M(j) of a pair of X1 and X2 that is selected in FIG. 9 is set to "1", whereas M(j) of a pair of X1 and X2 that is not selected in FIG. 9 is set to "0". Each pair of X1 and X2 whose M(j) is set to "1" in FIG. 9 represents a pair that has been extracted for holding the exceptionally high degree of similarity. Processing of Steps S741-S744 is performed on such a pair.

A pair of X1 and X2 whose M(j) is not set to "1" represents a pair that does not hold the exceptionally high degree of similarity and thus has not been extracted. Processing of Steps S741-S744 is not performed on such a pair; the conversion device accordingly proceeds to Step S745.

Step S741 involves inputting Ts segments (Ts represents the number of segments) constituting X1(*j*) pertaining to the jth unit of processing. Step S742 involves inputting Ts segments constituting X2(*j*) pertaining to the jth unit of processing. These steps allow inputting X1(1)-X1(Ts) and X2(1)-X2(Ts) shown in Formulae 1 and 2.

Step S743 involves performing the overlap based on <Formula 5>. Specifically, X1(1)-X1 (Ts) input in Step S741 are respectively multiplied by W1(1)-W1 (Ts), and X2(1)-X2 (Ts) input in Step S742 are respectively multiplied by W2(1)-W2 (Ts). The results of these multiplications are added, and then the results of the additions, which are Y(1)-Y(Ts), are output.

Step S744 involves adding (a) Ts (the time length of the unit of processing) to (b) the start time of X1(*j*) pertaining to the jth unit of processing as indicated by the first pointer, and then resetting the second pointer to a time point that is right after the end time of X1(*j*).

Step S745 involves incrementing the variable j.

Step S746 involves comparing i, which indicates the total number of units of processing, to the unit of processing counter j. Step S746 specifies the end-of-loop condition of the second loop. When the total number of units of processing i is greater than the unit of processing j, the conversion device returns to Step S739 and repeats the loop. When the total number of units of processing i is smaller than the unit of processing j, the conversion device exits the loop and proceeds to Step S747.

Step S747 involves outputting the audio data unmodified, starting from time indicated by the second pointer until the end point.

For simplicity, a unit of time and a sampling cycle are regarded to be equal in the flowchart of FIG. 10.

Figure 11A:
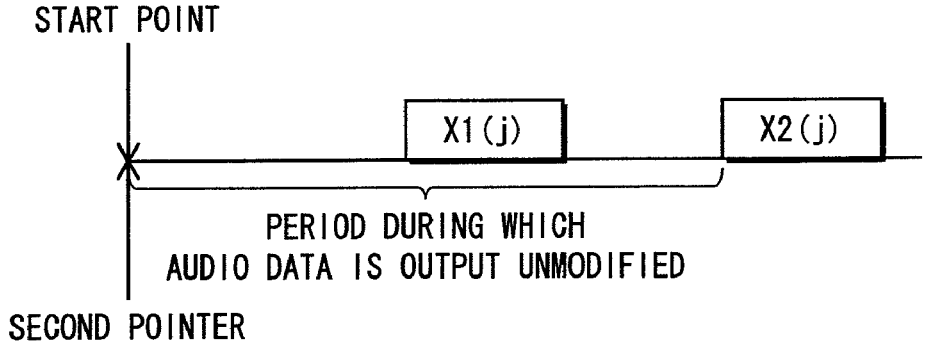
FIG. 11A shows a part of the audio data that is output upon executing Step S739 for the first time.
Figure 11B:
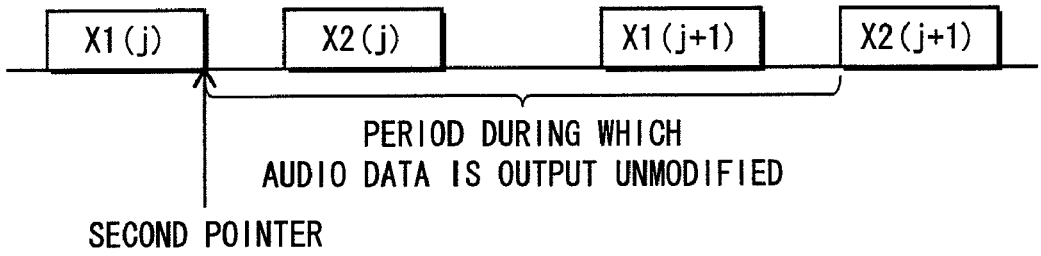
FIG. 11B shows a part of the audio data that is output upon executing Step S739 for the second time onward.
Figure 11C:
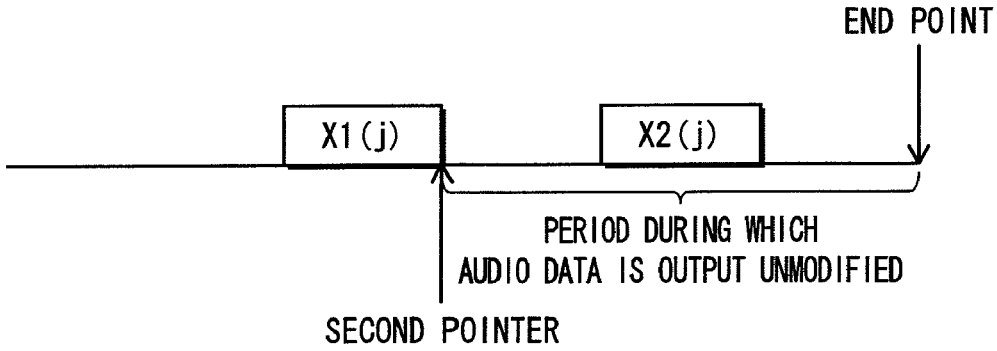
FIG. 11C shows a part of the audio data that is output upon executing Step S747.

FIGS. 11A-11C show which parts of the audio data are output according to the flowchart of FIG. 10.

FIG. 11A shows a part of the audio data that is output upon executing Step S739 for the first time. When Step S739 is executed for the first time, the second pointer indicates the start point. As shown in FIG. 11A, the audio data is hence output unmodified, starting from the start point until right before X2(*j*).

FIG. 11B shows a part of the audio data that is output upon executing Step S739 for the second time onward. When executing Step S739 for the second time onward, the second pointer indicates time obtained by "the start time of X1(*j*)+Ts". As shown in FIG. 11B, the audio data is hence output unmodified between the end time of X1(*j*) and the start time of X2(*j*+1).

FIG. 11C shows a part of the audio data that is output upon executing Step S747. When executing Step S747, the second pointer indicates time obtained by "the start time of X1(*j*)+Ts". As shown in FIG. 11C, the audio data is hence output unmodified between the end time of X1(*j*) and the end point.

As described above, the following are performed in Steps S707-S714: (a) changing a time difference between start times of two segments from Tl_min to Tl_max, by one sample at a time, so as to obtaining all possible pairs of segments; (b) calculating a degree of similarity of each pair of segments according to <Formula1> or <Formula2>; and (c) from among the pairs of segments, selecting one pair that holds the highest degree of similarity. A start time of X1(*i*) (the first segment), a start time of X2(*i*) (the second segment), and the degree of similarity R(i) of the selected pair are stored in Steps S715, S716 and S717, respectively.

In Steps S722-S736, the conversion device preferentially selects, from among various pairs of segments constituting input audio data, one or more pairs of segments that hold exceptionally high degree of similarity and are thus best suited for weighting/addition. This has the effect of reducing problems such as a lack of sound, sound duplication, and deterioration in sound quality.

The conversion device only extracts the necessary number of pairs of segments to be weighted/added in accordance with a desired time axis conversion ratio α. Moreover, the conversion device outputs audio data of a desired length both before and after outputting the weighted/added segments. This provides the effect of changing the time axis conversion ratio finely and accurately.

Here, a pair of segments that hold high similarity to each other is generally concentrated in a soundless period and a vowel period. In view of this, the conversion device has the effect of giving the after-conversion audio data a resemblance to a change in a speech speed that a human makes while speaking.

Further, the conversion device extracts, from among pairs of segments that are selected at intervals of ΔTd for holding the highest degree of similarity R(j), one or more pairs of segments holding exceptionally high degrees of similarity in order of highest degree of similarity. That is, the conversion device uses a single scale of evaluation (i.e., the degree of similarity) not only to determine the optimal time lag Tl_opt between segments holding the highest degree of similarity, but also to extract one or more pairs of segments to be weighted/added. This provides the effect of reducing the processing complexity and processing amount.

Moreover, the conversion device (a) inputs X1(1)-X1(Ts) starting from the start time of X1(*j*) pertaining to the jth unit of processing (Step S741), (b) inputs X2(1)-X2(Ts) starting from the start time of X2(*j*) pertaining to the jth unit of processing (Step S742), and (c) performs weighting/addition on X1(1)-X1(Ts) and X2(1)-X2(Ts). This way, under any circumstances, a time length of output audio data after weighting/addition can be adjusted to Ts (a time length of a given unit of processing). This has the effect of preventing the decrease in sound quality. This concludes the description of the processing procedure for extending the time axis of the audio data.

Next, the following is a detailed description of a processing procedure for compressing the playback time axis of the audio data.

Figure 12:
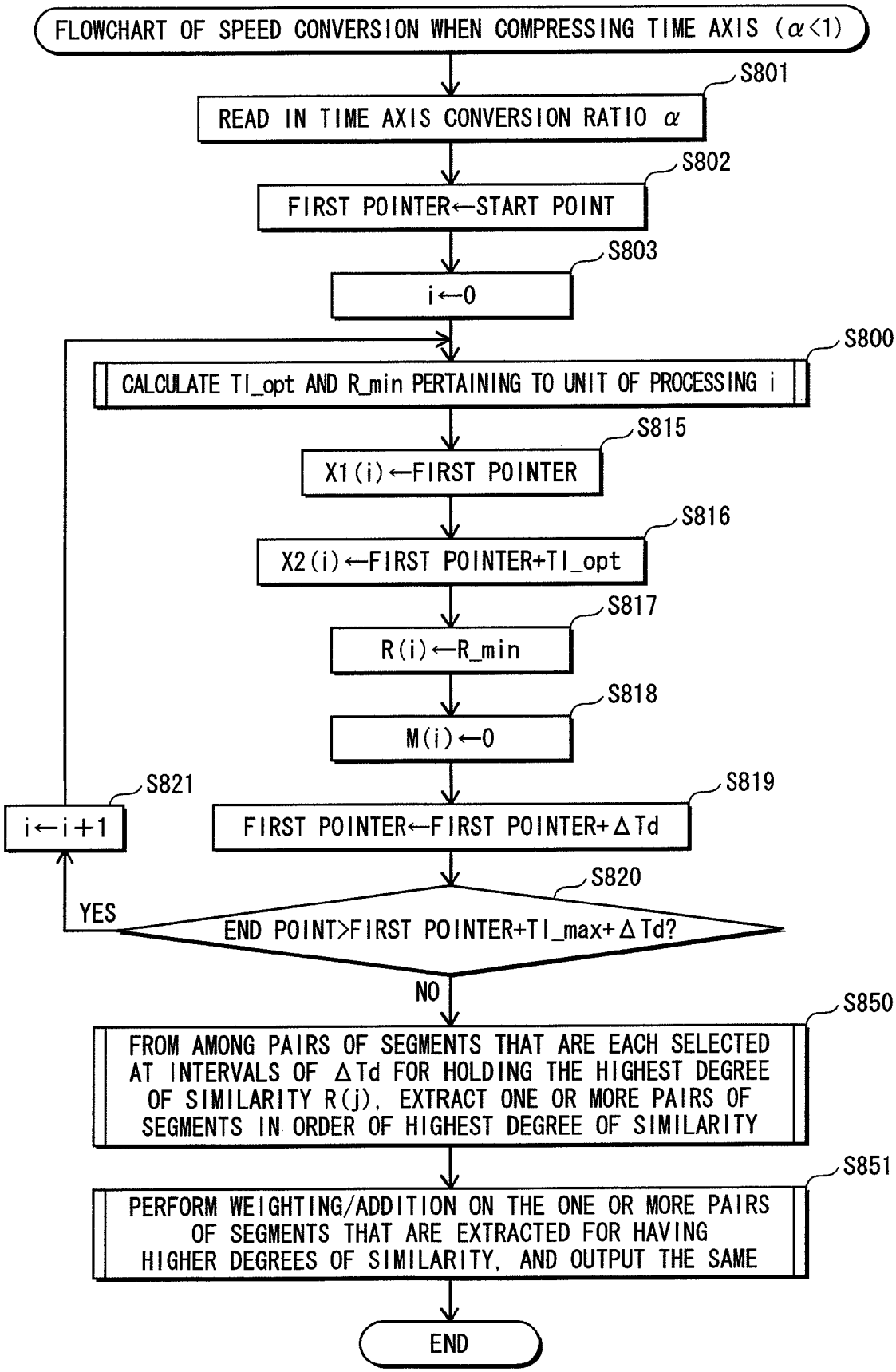
FIG. 12 is a flowchart showing a processing procedure for performing speed conversion when compressing the time axis ($\alpha \leqq 1$).

FIG. 12 is a flowchart showing a processing procedure for performing speed conversion when compressing the time axis (α<1). Steps shown in flowcharts of FIGS. 12-15 are labeled in the 800s, so that they are differentiated from Steps shown in the flowcharts of FIGS. 7-10.

Step S801 involves reading in a time axis conversion ratio α. Step S802 involves setting a first pointer to a default, which is the start point. Step S803 involves setting a unit of processing counter i to a default 0. Steps S800 and S815-S821 form a loop, with Step S820 serving as an end-of-loop condition and a variable being a control variable.

Step S800 involves calculating an optimal time lag Tl_opt and a minimum square error R_min pertaining to a unit of processing i.

S815 involves storing time indicated by the first pointer as a start time of X1(*i*) pertaining to the unit of processing i. S816 involves storing time obtained by adding the optimal time lag Tl_opt to the time indicated by the first pointer as a start time of X2(*i*) pertaining to the unit of processing i. Step S817 involves storing a calculated minimum square error R_min as a degree of similarity R(i) pertaining to the unit of processing i. Step S818 involves storing a value "0" for a selection M(i) pertaining to the unit of processing i, which indicates that the pair of segments in the unit of processing i is not extracted. Step S819 involves shifting the first pointer forward by "the first pointer+ΔTd".

Step S820 involves comparing (a) a sum of the time indicated by the first pointer, a maximum time lag Tl_max, and a time length of the unit of processing Ts to (b) the endpoint. Step S820 specifies the end-of-loop condition of the present loop. When the end point is judged to be smaller than the above sum, the conversion device exits the present loop and proceeds to Step S850. When the end point is judged to be greater than the above sum, the conversion device proceeds to Step S821.

Step S850 involves extracting one or more pairs of segments based on <Formula 4>.

Step S851 involves performing weighting/addition on the one or more pairs of segments that are extracted for holding exceptionally high degrees of similarity, and then outputting these pairs of segments.

Figure 13:
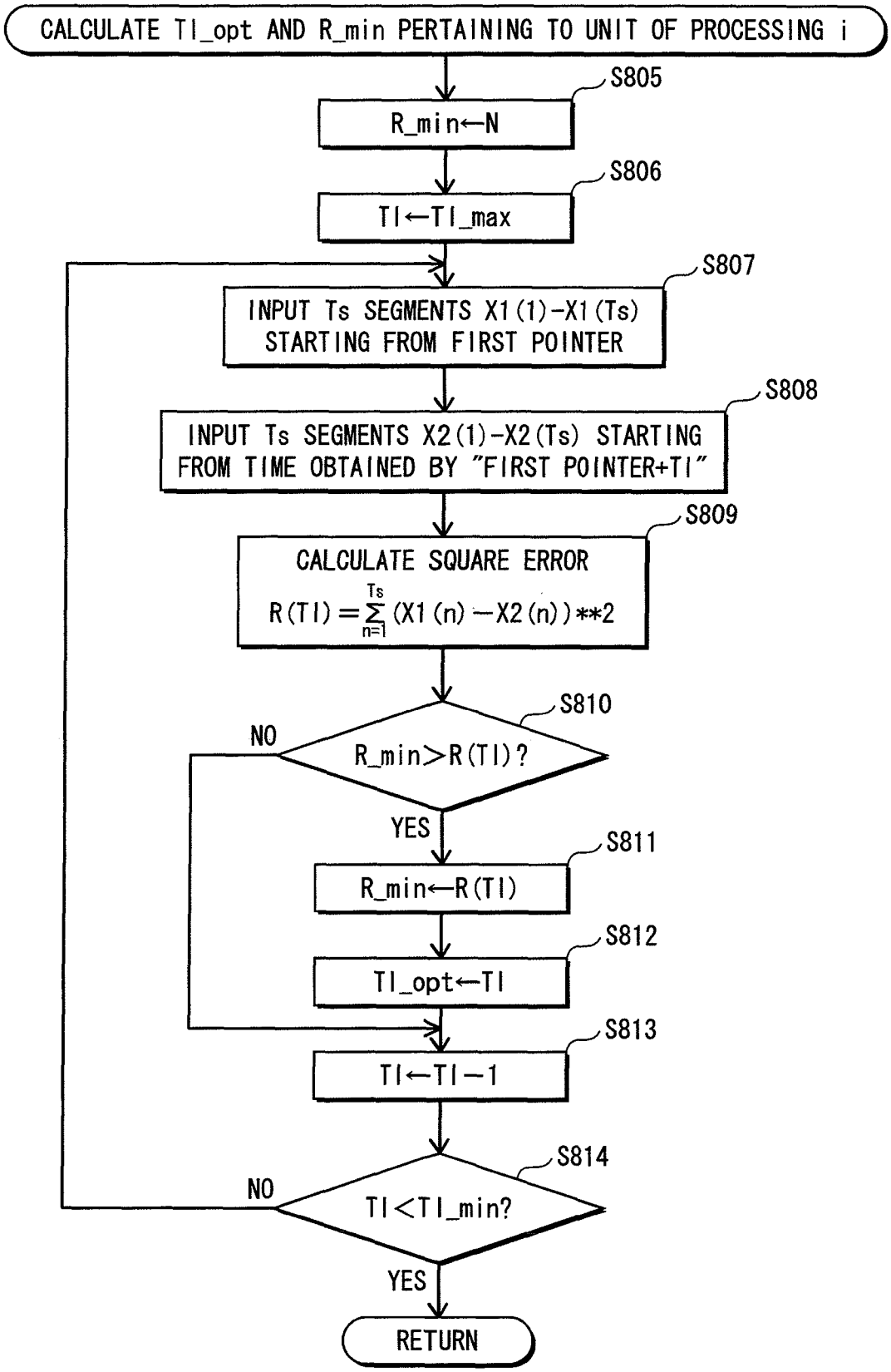
FIG. 13 is a flowchart showing processing for calculating an optimal time lag Tl_opt and a minimum square error R_min pertaining to a unit of processing i.

The following is a detailed description of Step S800. Step S800 involves selecting a plurality of pairs of segments. The procedure of this processing is illustrated in the flowchart of FIG. 13. FIG. 13 is a flowchart showing processing for calculating an optimal time lag Tl_opt and a minimum square error R_min pertaining to the unit of processing i.

Step S805 involves setting the minimum square error R_min to a default N. Step S806 involves setting a time lag Tl to a default Tl_max. Steps S807-S814 form a loop, with Step S814 serving as an end-of-loop condition and a variable Tl being a control variable.

Step S807 involves inputting Ts segments constituting a unit of processing X1 (Ts represents the number of segments), starting from the time indicated by the first pointer. Specifically, X1(1)-X1(Ts) are input. Step S808 involves inputting Ts segments constituting a unit of processing X2, starting from "the time indicated by the first pointer+Tl". Specifically, X2(1)-X2 (Ts) are input.

Step S809 involves calculating, according to <Formula 1>, a square error R(Tl) of X1 and X2 when the time lag is Tl. Step S810 involves comparing the minimum square error R_min to a square error R(Tl), so as to determine whether to skip or execute Steps S811 and S812.

The conversion device executes Steps S811 and S812 when R_min is greater than the square error R(Tl), but skips these steps when R_min is smaller than the square error R(Tl).

Step S811 involves updating the minimum square error R_min such that it takes a value of the square error R(Tl). Step S812 involves updating the optimal time lag Tl_opt such that it takes a value of the time lag Tl. Step 813 involves reducing the time lag Tl by one sample. Step S814 involves comparing the time lag Tl to a minimum time lag Tl_min, and specifies the end-of-loop condition of the present loop. When the time lag Tl is not smaller than the minimum time lag Tl_min, the conversion device returns to S807 and repeats the present loop. When the time lag Tl is smaller than the minimum time lag Tl_min, the conversion device terminates the processing shown in the flowchart of FIG. 13.

Figure 14:
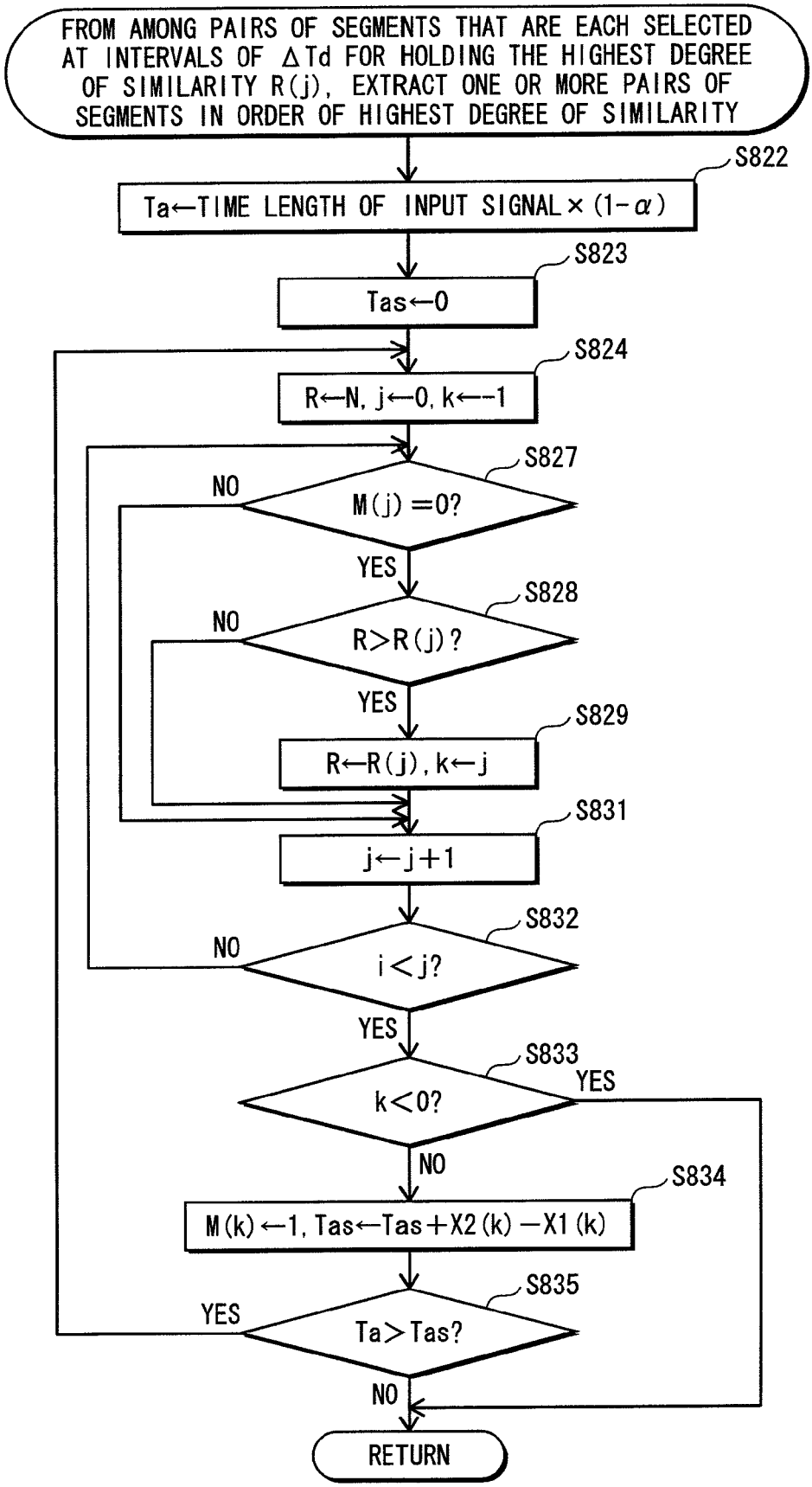
FIG. 14 is a flowchart showing a processing procedure for extracting, from among pairs of segments that are selected at intervals of ΔTd for holding the highest degree of similarity R(j), one or more pairs of segments holding exceptionally high degrees of similarity in order of highest degree of similarity.

FIG. 14 is a flowchart showing a processing procedure for extracting, from among pairs of segments that are selected at intervals of ΔTd for holding the highest degree of similarity R(j), one or more pairs of segments holding exceptionally high degrees of similarity in order of highest degree of similarity. This flowchart allows extracting one or more pairs of segments that satisfy the relationship of <Formula 4>. What <Formula 4> means is that the conversion device extracts, from among pairs of segments that are selected at intervals of ΔTd for holding the highest degree of similarity R(j), one or more pairs of segments holding exceptionally high degrees of similarity in order of highest degree of similarity, until an accumulated compressed time Tas reaches a required compressed time Ta.

Step S822 involves calculating the required compressed time Ta according to <Formula 4> so as to achieve the time axis conversion ratio α. Step S823 involves setting the accumulated compressed time Tas to a default 0. Steps S824-S835 form a first loop, with Step S835 serving as an end-of-loop condition and a variable Tas being a control variable. Step S823 gives the first loop an initial condition.

Step 824 involves setting a degree of similarity R to a default N, a unit of processing counter j to a default 0, and a selected unit of processing k to a default −1. Steps S827-S832 form a second loop, with Step S835 serving as an end-of-loop condition and a variable Tas being a control variable.

Step 827 involves judging whether or not a selection flag M(j) pertaining to the jth unit of processing indicates 0, and determining whether to execute or skip Steps S828 and S829. When the selection flag M(j) pertaining to the jth unit of processing indicates 1, the conversion device regards that a pair of segments pertaining to the jth unit of processing has already been extracted, and thus skips Steps S828 and S829 and proceeds to Step S831. When the selection flag M(j) pertaining to the jth unit of processing indicates 0, the conversion device regards that the pair of segments pertaining to the jth unit of processing has not been selected yet, and thus proceeds to Step S828.

Step 828 involves comparing (a) the degree of similarity R to (b) a degree of similarity R(j) pertaining to the unit of processing j, and determining whether to execute or skip Step S829. In this flowchart, the degree of similarity is measured using a minimum square error. The comparison in Step S828 is expressed by "R>R(j)", which is to judge whether R(j) is smaller than R.

When the degree of similarity R is greater than the degree of similarity R(j) (this case the square error is not large), the conversion device skips Step S829 and proceeds to Step S831. On the other hand, when the degree of similarity R is smaller than the degree of similarity R(j) (this case the square error is large), the conversion device executes Step S829.

Step S829 involves updating the degree of similarity R such that the updated degree of similarity R takes a value of the degree of similarity R(j) pertaining to the unit of processing j. Step S829 also involves updating the selected unit of processing k such that the unit of processing j is now the selected unit of processing k.

Step S831 involves incrementing the unit of processing j by one. Step S832 involves comparing i, which indicates a total number of units of processing, to the unit of processing counter j. Step S832 specifies the end-of-loop condition of the second loop. When i indicating the total number of units of processing is not smaller than the unit of processing j, the conversion device returns to Step S827 and repeats the second loop. When i indicating the total number of units of processing is smaller than the unit of processing j, the conversion device exits the second loop and proceeds to Step S833.

Step S833 involves judging whether or not the selected unit of processing k indicates a negative number, and specifies the end-of-loop condition of the present flowchart. When k indicates a negative number, the conversion device regards that weighting/addition has been performed in every unit of processing, and thus terminates the present flowchart. When k does not indicate a negative number, the conversion device regards that there still exists a unit of processing in which weighting/addition has not been performed yet, and thus proceeds to Step S834.

Step S834 involves setting a selection M(k) to 1, the selection M(k) pertaining to a unit of processing that includes a pair of segments that has been extracted for holding the exceptionally high degree of similarity. Step 834 also involves updating the accumulated compressed time Tas by adding the accumulated compressed time Tas to a time difference between (a) a start time of X2(*k*) in the kth unit of processing and (b) a start time of X1(*k*) in the kth unit of processing.

Step S835 involves comparing the required compressed time Ta and the accumulated compressed time Tas, and specifies the end-of-loop condition of the present flowchart and the first loop. When the required compressed time Ta is greater than the accumulated compressed time Tas, the conversion device returns to Step S824 so as to select a pair of segments holding the second highest degree of similarity. When the required compressed time Ta is not greater than the accumulated compressed time Tas, the conversion device stops extracting a pair of segments holding the exceptionally high degree of similarity, and terminates the present flowchart and the first loop.

The following is a detailed description of a processing procedure of Step S851.

Step S851 represents a procedure for overlapping each pair of segments based on <Formula 6>. This procedure is illustrated in detail in FIG. 15.

Figure 15:
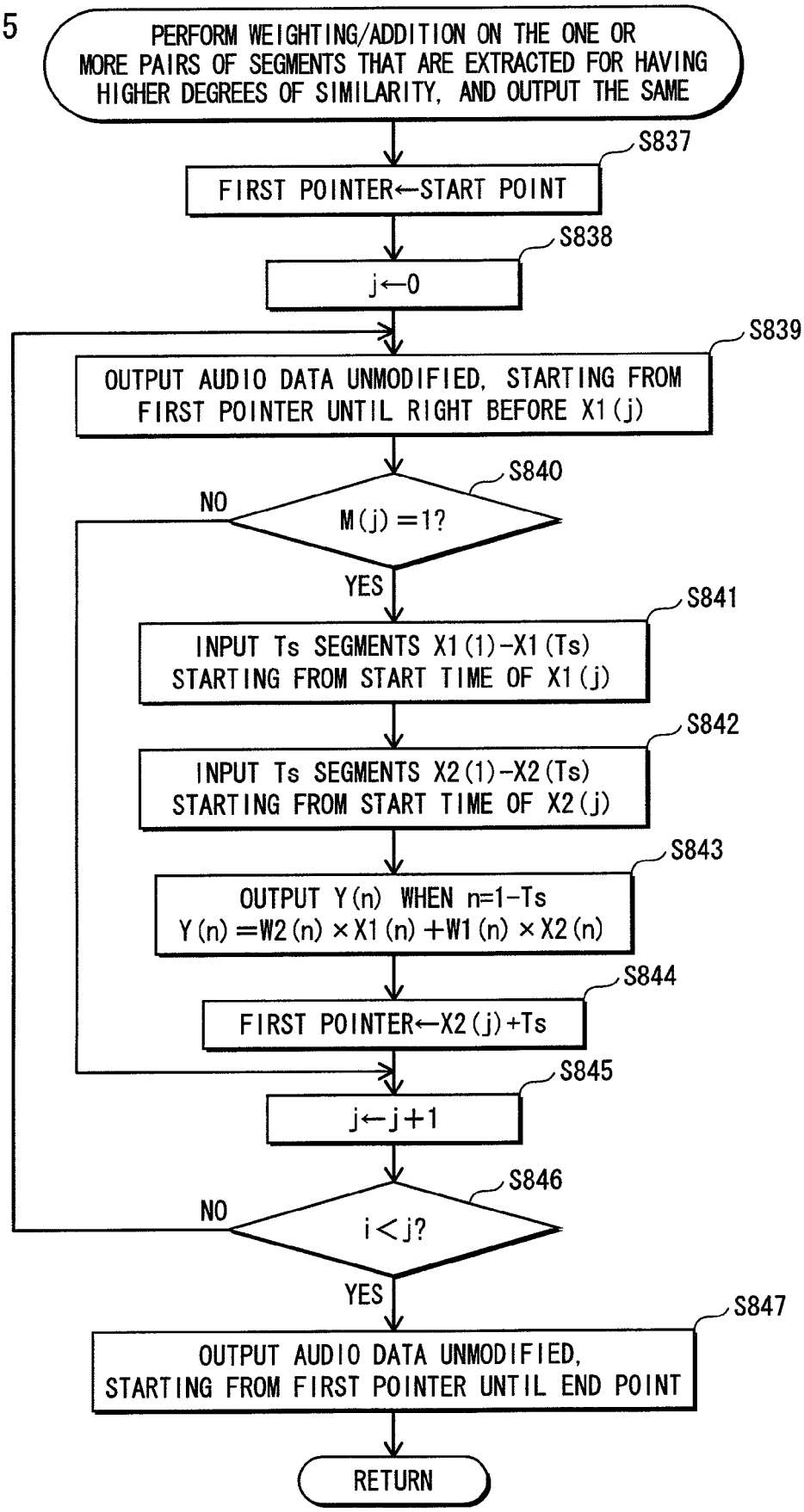
FIG. 15 is a flowchart showing a processing procedure for performing weighting/addition on, and then outputting, the one or more pairs of segments that are each extracted for holding the exceptionally high degree of similarity.

FIG. 15 is a flowchart showing a processing procedure for performing weighting/addition on, and then outputting, the one or more pairs of segments that are each extracted for holding the exceptionally high degree of similarity.

Step S837 involves setting the first pointer to the start point. Step S838 involves setting the unit of processing counter j to a default 0. According to FIG. 14, pairs of segments are sorted in order of highest degree of similarity. However, it is not possible to output these pairs of segments both in order of highest degree of similarity and in playback order. For this reason, in FIG. 15, the extracted pairs of segments are re-extracted as overlap targets in playback order by resetting the first pointer to the start point.

Steps S839-S846 form a loop, with Step S846 serving as an end-of-loop condition and a variable j being a control variable. Step S838 gives the present loop an initial condition.

Step S839 involves inputting the audio data, starting from the first pointer until right before X1(*j*) pertaining to the jth unit of processing, and then outputting the input audio data unmodified. Step S840 involves judging whether or not the selection flag M(j) is set to 1, and determining whether to execute or skip processing of Steps S841-S844.

When a selection flag M(j) indicates, the conversion device regards that a pair of X1 and X2 pertaining to the unit of processing j has been extracted for holding the exceptionally high degree of similarity and thus performs processing of Steps S841-S844 on this pair of X1 and X2. Contrarily, when a selection flag M(j) does not indicate 0, the conversion device regards that the pair of X1 and X2 pertaining to the unit of processing j has not been extracted for not holding the exceptionally high degree of similarity, and thus does not perform the processing of Steps S841-S844 on this pair of X1 and X2 and proceeds to Step S845.

Step S841 involves inputting Ts segments (Ts represents the number of segments) constituting X1(*j*), starting from a start time of X1(*j*) pertaining to jth unit of processing. Specifically, X1(1)-X1(Ts) are input.

Step S842 involves inputting Ts segments constituting X2(*j*), starting from a start time of X2(*j*) pertaining to the jth unit of processing. Specifically, X2(1)-X2(Ts) are input.

Step S843 involves performing the overlap based on <Formula 6>. Specifically, X1(1)-X1 (Ts) input in Step S841 are respectively multiplied by W2(1)-W2 (Ts), and X2(1)-X2 (Ts) input in Step S842 are respectively multiplied by W1(1)-W1(Ts). The results of these multiplications are added, and then the results of the additions, which are Y(1)-Y(Ts), are output.

Step S844 involves adding (a) Ts (the time length of the unit of processing) to (b) the start time of X2(*j*) pertaining to the jth unit of processing as indicated by the second pointer, and then resetting the first pointer to a time point that is right after the end time of X2(*j*).

Step S845 involves incrementing the unit of processing counter j by one.

Step S846 involves comparing i, which indicates a total number of units of processing, to the unit of processing counter j. When i indicating the total number of units of processing is not smaller than the unit of processing j, the conversion device returns to Step S839 and repeats execution of the present loop.

When i indicating the total number of units of processing is smaller than the unit of processing j, the conversion device outputs the audio data unmodified starting from the first pointer until the end point (Step S847), and then terminates the processing of the present flowchart.

For simplicity, a unit of time and a sampling cycle are regarded to be equal in the present flowchart.

Figure 16A:
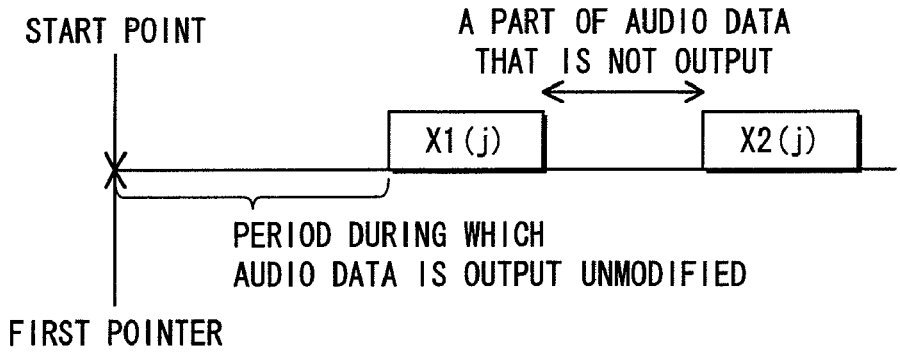
FIG. 16A shows a part of the audio data that is output upon executing Step S839 for the first time.
Figure 16B:
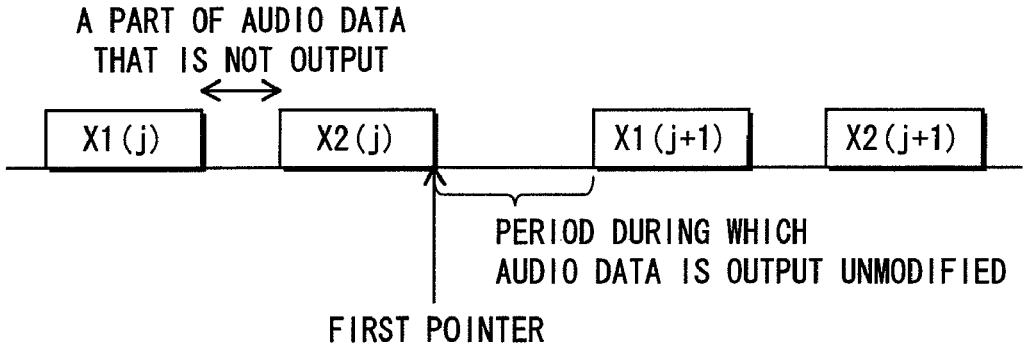
FIG. 16B shows a part of the audio data that is output upon executing Step S839 for the second time onward.
Figure 16C:
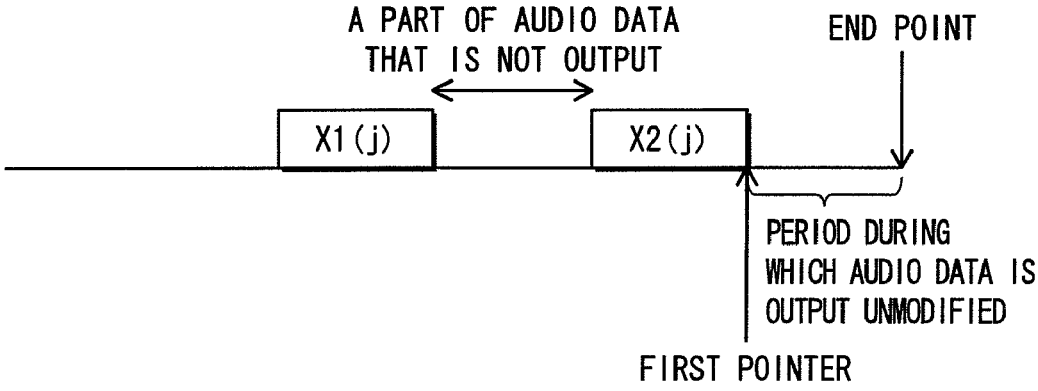
FIG. 16C shows a part of the audio data that is output upon executing Step S847.

FIGS. 16A-16C show which parts of the audio data are output according to the flowchart of FIG. 15.

FIG. 16A shows a part of the audio data that is output upon executing Step S839 for the first time. When executing Step S839 for the first time, the first pointer indicates the start point. As shown in FIG. 16A, the audio data is hence output unmodified, starting from the start point until right before X1(*j*). Here, a part of the audio data that is between X1(*j*) and X2(*j*) is not output.

FIG. 16B shows a part of the audio data that is output upon executing Step S839 for the second time onward. When executing Step S739 for the second time onward, the first pointer indicates time obtained by "the start time of X2(*j*)+Ts". As shown in FIG. 16B, the audio data is hence output unmodified between the end time of X2(*j*) and the start time of X2 (j+1). Here, a part of the audio data that is between X1(*j*) and X2(*j*), as well as between X1(*j*+1) and X2(*j*+1), is not output.

FIG. 16C shows a part of the audio data that is output upon executing Step S847. When executing Step S847, the first pointer indicates time obtained by "the start time of X2(*j*)+Ts". As shown in FIG. 16C, the audio data is hence output unmodified between the start time of X2(*j*) and the end point.

As set forth, in Steps S822-S835, the conversion device extracts, from among pairs of segments that are selected at intervals of ΔTd for holding the highest degree of similarity R(j), one or more pairs of segments holding exceptionally high degrees of similarity in order of highest degree of similarity. This extraction is performed until the accumulated compressed time Tas reaches the required compressed time Ta that is calculated according to <Formula 4>. In other words, the conversion device only extracts the necessary number of pairs of segments to be weighted/added in accordance with a desired time axis conversion ratio α. Moreover, the conversion device outputs audio data of a desired length both before and after outputting the weighted/added segments. This provides the effect of changing the time axis conversion ratio finely and accurately.

Here, a pair of segments that hold high similarity to each other is generally concentrated in a soundless period and a vowel period. In view of this, the conversion device has the effect of giving the after-conversion audio data a resemblance to a change in a speech speed that a human makes while speaking.

Also, the conversion device uses a single scale of evaluation (i.e., the degree of similarity) not only to determine the optimal time lag Tl_opt between segments hold the highest degree of similarity, but also to extract one or more pairs of segments to be weighted/added. This provides the effect of reducing the processing complexity and processing amount.

Furthermore, under any circumstances, a time length of output audio data after weighting/addition can be adjusted to Ts (a time length of a given unit of processing). This has the effect of preventing the decrease in sound quality.

Second Embodiment

The second embodiment relates to modifying implementation of the speed conversion, which has been described in the first embodiment, with use of specific hardware.

Figure 17:
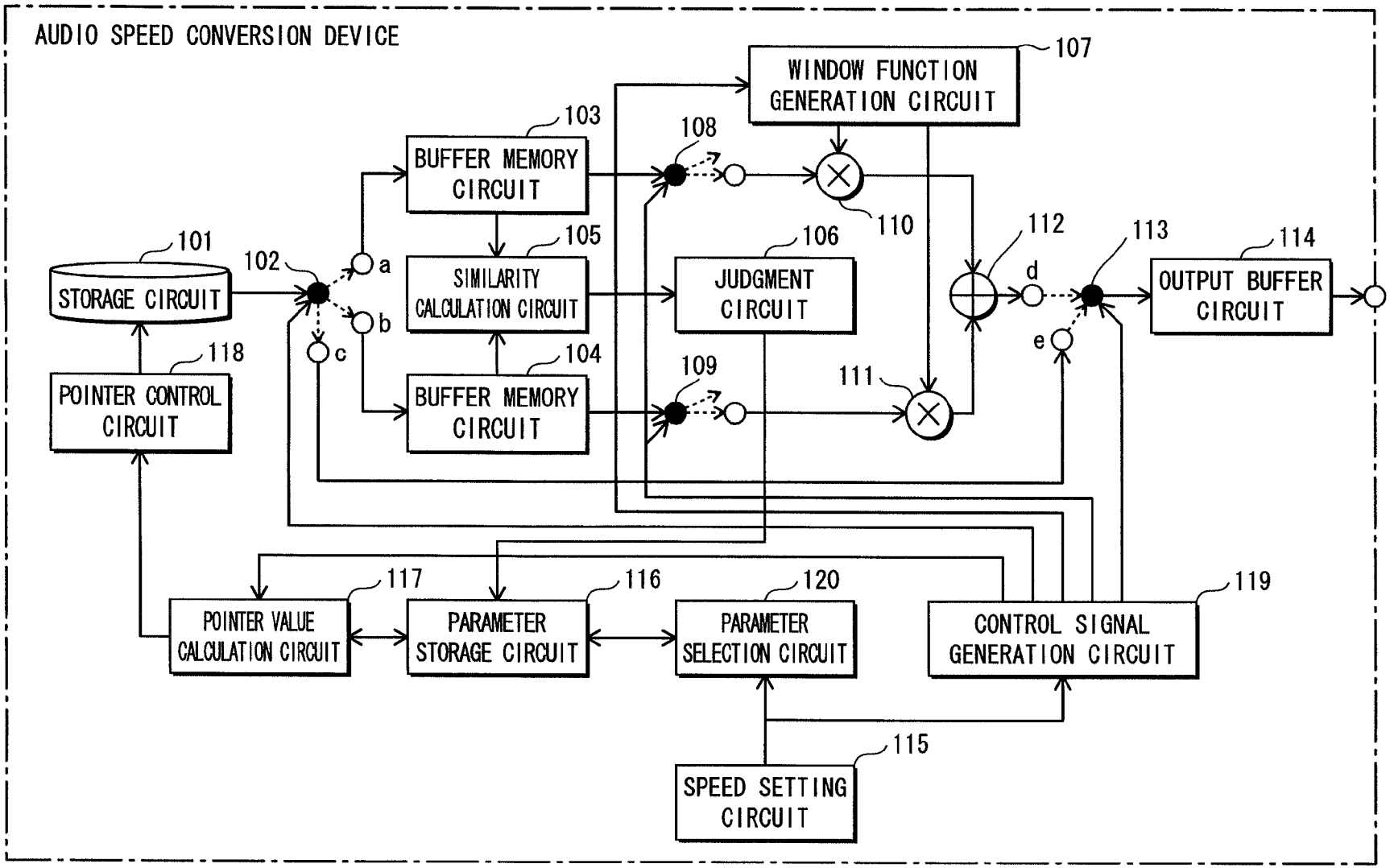
FIG. 17 shows an internal structure of a conversion device pertaining to a second embodiment.

FIG. 17 shows an internal structure of a conversion device pertaining to the second embodiment. As shown in FIG. 17, the conversion device of the second embodiment includes: a storage circuit 101; a switch circuit 102; a buffer memory circuit 103; a buffer memory circuit 104; a similarity calculation circuit 105; a judgment circuit 106; a window function generation circuit 107; a switch circuit 108; a switch circuit 109; a multiplication circuit 110; a multiplication circuit 111; an addition circuit 112; a switch circuit 113; an output buffer circuit 114; a speed setting circuit 115; a parameter storage circuit 116; a pointer value calculation circuit 117; a pointer control circuit 118; a control signal generation circuit 119; and a parameter extraction circuit 120. These constituent elements of the internal structure shown in FIG. 17 are labeled in the 100s, so that they are differentiated from the components of the internal structure shown in FIG. 1.

The storage circuit 101 stores therein audio data, and outputs the audio data of a desired length with a desired start point based on an address value and a time length of the audio data that are output from the pointer control circuit 118.

The switch circuit 102 selects one of (a) the buffer memory circuit 103, (b) the buffer memory circuit 104 and (c) the switch circuit 113 as an output destination of the audio data that is output from the storage circuit 101.

The buffer memory circuit 103 stores therein X1 that is output from the switch circuit 102, X1 including Ts segments (Ts represents the number of segments).

The buffer memory circuit 104 stores therein X1 that is output from the switch circuit 102, X1 including Ts segments.

When the time lag Tl between start times of X1 and X2 is in the range of the minimum time lag Tl_min to the maximum time lag Tl_max, the similarity calculation circuit 105 calculates a degree of similarity pertaining to X1 and X2 that are stored in the buffer memory circuits 103 and 104, respectively.

The judgment circuit 106 judges which one of degrees of similarity, which have been output from the similarity calculation circuit 105 so far, is the highest of all. The judgment circuit 106 then detects a pair of X1 an X2 that corresponds to the highest degree of similarity, and outputs start times of these X1 and X2, as well as the degree of similarity thereof, to the parameter storage circuit 116.

The window function generation circuit 107 outputs an increasing window function and a decreasing window function.

The switch circuit 108 outputs X1, which is stored in the buffer memory circuit 103, to the multiplication circuit 110 by closing itself. This X1 is not output to the multiplication circuit 110 when the switch circuit 108 is open.

The switch circuit 109 outputs X2, which is stored in the buffer memory circuit 104, to the multiplication circuit 111 by closing itself. This X2 is not output to the multiplication circuit 111 when the switch circuit 109 is open.

Based on a parameter that is stored in the parameter storage circuit 116 and has been selected by the parameter extraction circuit 120, the multiplication circuit 110 multiplies X1, which is output from the storage circuit 101, by one of the window functions output from the window function generation circuit 107.

Meanwhile, based on the stated parameter, the multiplication circuit 111 multiplies X2, which is output from the storage circuit 101, by the other one of the window functions output from the window function generation circuit 107.

The addition circuit 112 adds X1 to X2, each of which has been multiplied by the corresponding one of the window functions by the multiplication circuit 110 or 111.

The switch circuit 113 selects one of (a) the output from the addition circuit 112 and (b) the output from the switch circuit 102, and outputs the selected item to the output buffer circuit 114.

The output buffer circuit 114 temporarily stores the results of weighting/addition performed on X1 and X2, which have been output from the switch circuit 113, and then outputs the results after adjusting their speed.

The speed setting circuit 115 stores a time axis conversion ratio $\alpha$ (time length of output/time length of input), which has been input in accordance with a user operation via GUI and the like.

The parameter storage circuit 116 stores the segment selection log of FIG. 4. Just like as shown in FIG. 4, each piece of data included in this log is composed of the following items that correspond to one another, and the following items should be input to edit the log, or add a new piece of data to the log: a pair of a start time of X1 and a start time of X2; a degree of similarity R(i); and a selection flag M(i). In order to add a new piece of data to this log, the speed setting circuit 115 receives (a) from the judgment circuit 106, the highest degree of similarity detected by the judgment circuit 106, and (b) from the pointer value calculation circuit 117, start times of X1 and X2 that have been used by the pointer value calculation circuit 117 to obtain an address value corresponding to the pair of X1 and X2 output by the pointer control circuit 118. Then, the speed setting circuit 115 generates a new piece of data from the highest degree of similarity and the start times of X1 and X2 it has received, and adds the generated piece of data to the selection log.

The pointer value calculation circuit 117 calculates an address value of the pair of X1 and X2, whose degree of similarity is to be obtained by the similarity calculation circuit 105, and outputs the address value to the pointer control circuit 118. The pointer value calculation circuit 117 further (a) calculates the address value and time length of the pair of X1 and X2 that holds a high degree of similarity, based on the parameter stored in the parameter storage circuit 116, (b) calculates address values and time lengths of segments that come right before/after the pair of X1 and X2, and (c) outputs the calculation results to the pointer control circuit 118.

Based on the address values calculated by the pointer value calculation circuit 117, the pointer control circuit 118 outputs the first and second pointers, which are described in the first embodiment, to the storage circuit 101. The pointer control circuit 118 controls the storage circuit 101 such that X1 and X2 are read out based on these first and second pointers. The pointer control circuit 118 also performs processing for updating the first and second pointers in accordance with the time lengths calculated by the pointer value calculation circuit 117.

The control signal generation circuit 119 controls the switch circuits 102, 108, 109 and 113. Here, when the similarity calculation circuit 105 calculates a degree of similarity, the control signal generation circuit 119 connects the switch circuit 102 to the buffer memory circuit 103 or 104, and opens the switch circuit 108 or 109.

When the addition circuit 112 outputs a result of addition, the control signal generation circuit 119 connects the switch circuit 102 to the buffer memory circuit 103 or 104, closes the switch circuits 108 and 109, and connects the switch circuit 113 to the addition circuit 112. When the segments stored in the storage circuit 101 is output unmodified to the output buffer circuit 114, the control signal generation circuit 119 connects the switch circuit 102 to the switch circuit 113.

The parameter extraction circuit 120 only extracts the necessary number of pairs of segments in order of highest degree of similarity to comply with the time axis conversion ratio $\alpha$ set by the speed setting circuit. Here, targets of extraction are a plurality of segments that (a) are within a time range Tr and (b) have their start times stored in the parameter storage circuit 116. This concludes the description of the hardware structure of the conversion device pertaining to the present embodiment.

Figure 18:
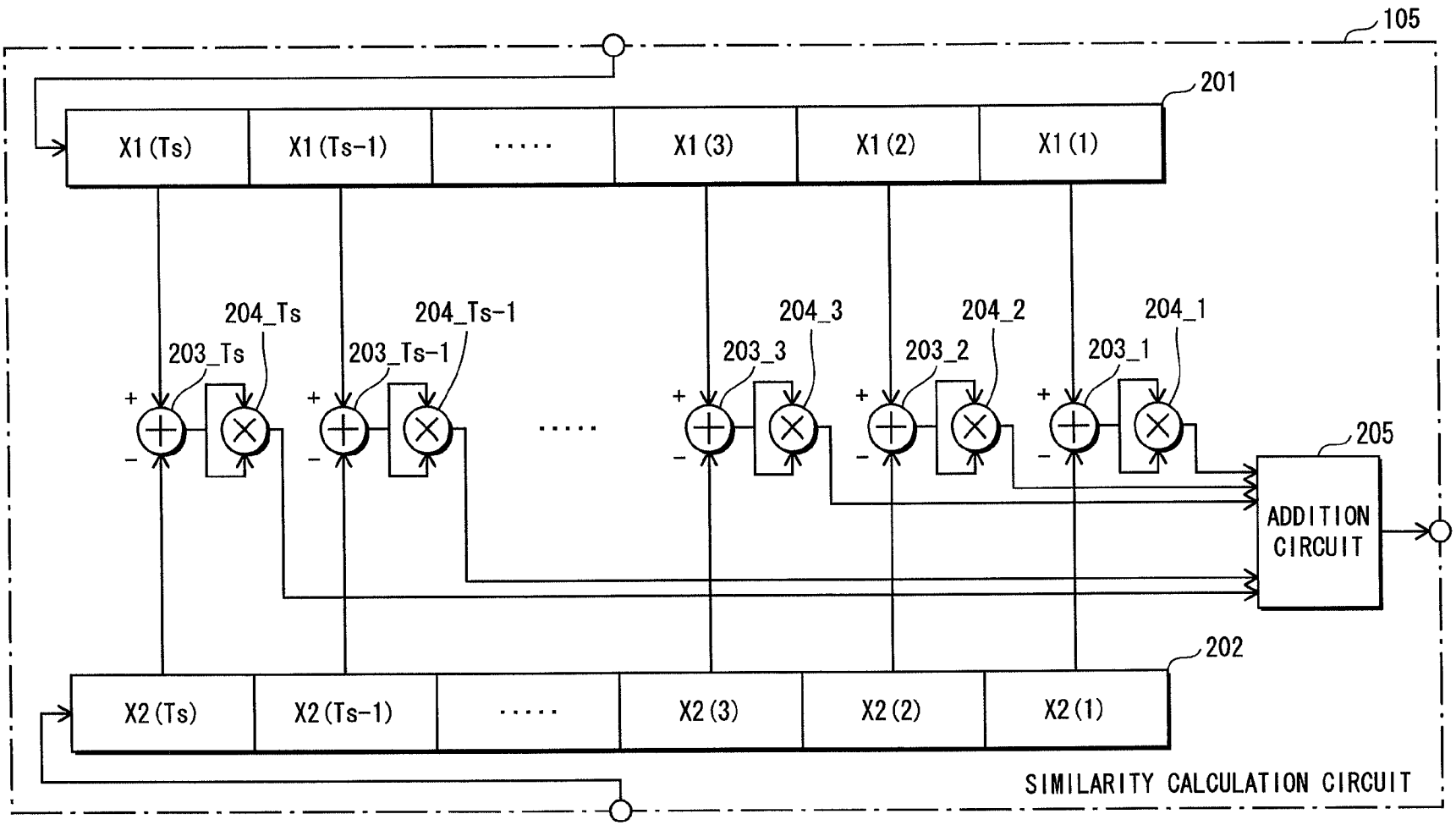
FIG. 18 shows an internal structure of a similarity calculation circuit 105 when a square error is used as an evaluation function to obtain a degree of similarity.
Figure 19:
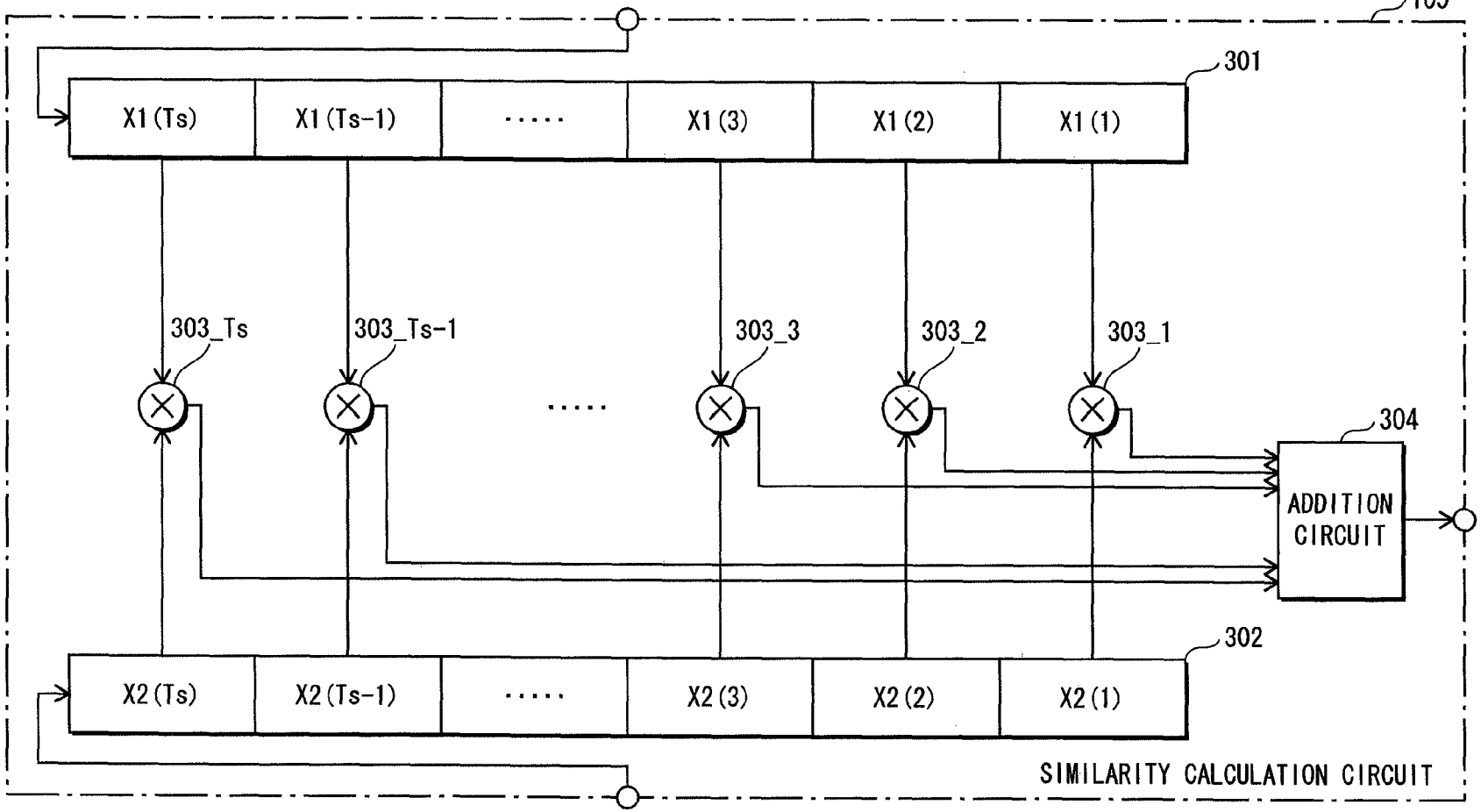
FIG. 19 shows an internal structure of the similarity calculation circuit 105 when a correlation function is used as the evaluation function to obtain the degree of similarity.

Referring to FIGS. 18 and 19, the following describes in detail a hardware structure of the similarity calculation circuit 105. Here, a degree of similarity is expressed by a square error or a correlation function. Depending on which of these is used to obtain the degree of similarity, the hardware structure of the similarity calculation circuit 105 varies. First, described below is the internal structure when the minimum square value is used.

FIG. 18 shows the internal structure of the similarity calculation circuit 105 when the square error is used as an evaluation function to obtain a degree of similarity. Here, the similarity calculation circuit 105 includes: shift register memory circuits 201 and 202; subtraction circuits 203_1 through 203_Ts, multiplication circuits 204_1 through 204_Ts, and the addition circuit 205.

Segments constituting a unit of processing X1, which are stored in the buffer memory circuit 103, are input in series to the shift register memory circuit 201. The unit of processing X1 input to the shift register memory 201 is composed of Ts segments, which are X1(1), X1(2), X1(3) . . . X1(Ts−1), X1(Ts).

Segments constituting a unit of processing X2, which are stored in the buffer memory circuit 104, are input in series to the shift register memory circuit 202. The unit of processing X2 input to the shift register memory 202 is composed of Ts segments, which are X2(1), X2(2), X2(3) . . . X2(Ts-1), X2(Ts).

The subtraction circuits 203_1 through 203_Ts concurrently subtract X2(1), X2(2), X2(3) . . . X2(Ts-1) and X2(Ts), which are stored in the shift register memory circuit 202, from X1(1), X1(2), X1(3) . . . X1 (Ts-1) and X1(Ts), which are stored in the shift register memory circuit 201, respectively.

Each of the multiplication circuits 204_1 through 204_Ts multiplies a corresponding one of the outputs from the subtraction circuits 203_1 through 203_Ts by itself.

The addition circuit 205 calculates a sum of the outputs from the multiplication circuits 204_1 through 204_Ts, and outputs the calculated sum as a square error. The calculation performed by the similarity calculation circuit 105 to obtain the square error is based on <Formula 1> explained in the first embodiment. This concludes the description of the internal structure of the similarity calculation circuit 105 when the degree of similarity is expressed by the square error.

Second, the following describes the internal structure of the similarity calculation circuit 105 when a correlation function is used. FIG. 19 shows the internal structure of the similarity calculation circuit 105 when the correlation function is used as the evaluation function to obtain the degree of similarity. Here, the similarity calculation circuit 105 includes: shift register memory circuits 301 and 302; multiplication circuits 303_1 through 303_Ts; and an addition circuit 304.

Segments constituting X1, which are stored in the buffer memory circuit 103, are input in series to the shift register memory circuit 301. The unit of processing X1 input to the shift register memory circuit 302 is composed of Ts segments, which are X1(1), X1(2), X1(3) . . . X1(Ts-1) and X1(Ts)

Segments constituting X2, which are stored in the buffer memory circuit 104, are input in series to the shift register memory circuit 302. The unit of processing X2 input to the shift register memory circuit 302 is composed of Ts segments, which are X2(1), X2(2), X2(3) . . . X2(Ts-1) and X2(Ts).

The multiplication circuits 303_1 through 303_Ts concurrently multiply X1(1), X1(2), X1(3) . . . X1 (Ts-1) and X1(Ts), which are stored in the shift register memory circuit 301, by X2(1), X2(2), X2(3) . . . X2(Ts-1) and X2(Ts), which are stored in the shift register memory circuit 302, respectively.

The addition circuit 304 calculates a sum of the outputs from the multiplication circuits 303_1 through 303_Ts, and outputs the calculated sum as a correlation function. The calculation performed by the similarity calculation circuit 105 to obtain the correlation function is based on <Formula 2> explained in the first embodiment. This concludes the description of the internal structure of the similarity calculation circuit 105 when the degree of similarity is expressed by the correlation function.

Figure 20:
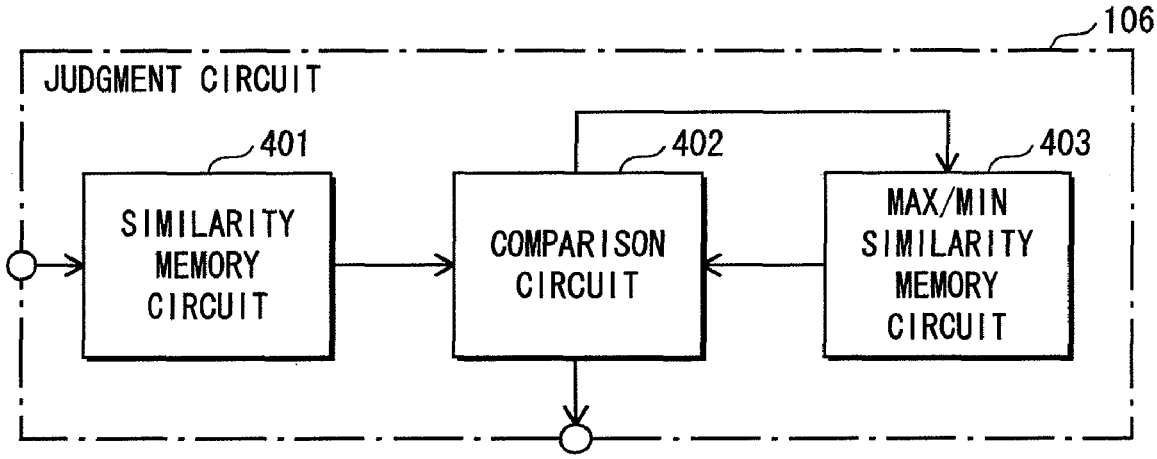
FIG. 20 shows an internal structure of a judgment circuit 106.

Referring to FIG. 20, the following describes in detail the hardware structure of the judgment circuit 106.

FIG. 20 shows the internal structure of the judgment circuit 106. The judgment circuit 106 includes: a similarity memory circuit 401; a comparison circuit 402; and a max/min similarity memory circuit 403.

The similarity memory circuit 401 stores therein degrees of similarity calculated by the similarity calculation circuit 105.

The max/min similarity memory circuit 403 stores therein the highest or lowest value representing a degree of similarity. Note that the max/min similarity memory circuit 403 stores therein the lowest value when the square error is used as the evaluation function, and the highest value when the correlation function is used as the evaluation function.

The comparison circuit 402 compares (a) a current degree of similarity that is output by the similarity memory circuit 401 to (b) the highest or lowest value in the past stored in the max/min similarity memory circuit 403, the highest or lowest value representing a degree of similarity. If the degree of similarity stored in the similarity memory circuit 401 is either higher than the highest value in the past or lower than the lowest value in the past, the highest or lowest value stored in the max/min similarity memory circuit 403 is updated by writing the degree of similarity stored in the similarity memory circuit 401 to the max/min similarity memory circuit 403. In performing such an update, the comparison circuit 402 instructs the parameter storage circuit 116 to store start times of current X1 and X2 as a potential pair of segments that holds a high degree of similarity. This concludes the description of the inner structure of the judgment circuit 106, and the description of the hardware structure for performing the speed conversion.

Described below is an operation of a conversion device that is structured as explained above.

(Calculation of Degree of Similarity)

By changing the time difference between start times of X1 and X2 by Tl_min to Tl_max, the similarity calculation circuit 105 obtains various pairs of X1 (stored in the buffer memory circuit 103) and X2 (stored in the buffer memory circuit 104), and calculates a degree of similarity of each pair of X1 and X2. Next, the judgment circuit 106 detects, from among all pairs of X1 and X2 whose degrees of similarity are output by the similarity calculation circuit 105, a pair of X1 and X2 that holds the highest degree of similarity.

Then, (a) the start times of X1 and X2, which are used by the pointer value calculation circuit 117 to obtain the address value of the pair of X1 and X2, and (b) the degree of similarity pertaining to the pair of X1 and X2 are written as a piece of data to the selection log in the parameter storage circuit 116.

(Extraction of Segments)

The above-mentioned processing is performed at various times within a predetermined time range Tr. Next, the parameter extraction circuit 120 extracts, from among pairs of segments whose degrees of similarities are calculated at various times within the predetermined time range Tr that is stored in the parameter extraction circuit 120, the necessary number of pairs of segments in order of highest degree of similarity to comply with a desired time axis conversion ratio $\alpha$ that is set by the speed setting circuit 115. Here, among pieces of data stored in the parameter storage circuit 116, selection flags of pieces of data corresponding to the extracted pairs of segments are set to ON, whereas selection flags of pieces of data corresponding to segments that have not been extracted are set to OFF.

(Overlap)

The pairs of segments corresponding to pieces of data whose selection flags are set to ON in the selection log of the parameter storage circuit 116 are output after getting weighted/added by the multiplication circuits 110, 111 and 112. Segments other than these pairs of segments are output unmodified.

Described below is processing performed by the conversion device of the present embodiment to extend the time axis (time axis conversion ratio $\alpha$=4/3), as illustrated in FIG. 5 that has been explained in the first embodiment.

(ith Unit of Processing)

The conversion device performs the processing on the ith unit of processing pertaining to the audio data stored in the storage circuit 110. Here, based on the pointers 502_*i* and 503_*i*, which are output by the pointer control circuit 118 in the ith unit of processing, the buffer memory circuits 103 and 104 read out X1(1)-X1(Ts) and X2(1)-X2(Ts), respectively.

The conversion device retrieves different patterns of X1 by shifting X1 to change the time difference between start times of X1 and X2 by Tl_min to Tl_max, and then makes the similarity calculation circuit 105 calculate a degree of similarity of each pair of X1 and X2.

The judgment circuit 106 searches the highest degree of similarity, and obtains a time difference between the start times of X1 and X2 that hold the highest degree of similarity as Tl_opt. Here, when the square error is used as the evaluation function to obtain the degree of similarity, the judgment circuit 106 detects the minimum square error from among all the square errors output by the similarity calculation circuit 105. On the other hand, when the correlation function is used as the evaluation function to obtain the degree of similarity, the judgment circuit 106 detects the maximum correlation function from among all the correlation functions output by the similarity calculation circuit 105.

The parameter storage circuit 116 stores therein (a) the highest degree of similarity detected by the judgment circuit 106, and (b) start times of X1 and X2 that hold the highest degree of similarity.

(i+1th Unit of Processing)

Next, based on the pointers 502_*i*+1 and 503_*i*+1, which are output by the pointer control circuit 118 in the i+1th unit of processing, the conversion device retrieves different patterns of X1' by shifting X1' to change the time difference between start times of X1' and X2' by Tl_min to Tl_max. Then, the similarity calculation circuit 105 calculates a degree of similarity of each pair of X1' and X2'.

The judgment circuit 106 searches the highest degree of similarity, and obtains a time difference between X1' and X2' that hold the highest degree of similarity as Tl_opt. The parameter storage circuit 116 stores therein (a) the highest degree of similarity detected by the judgment circuit 106, and (b) start times of X1' and X2' that hold the highest degree of similarity.

(i+2th Unit of Processing)

The conversion device performs the same processing as described above, based on the pointers 502_*i*+2 and 503_*i*+2 that are output by the pointer control circuit 118 in the i+2th unit of processing.

When the judgment circuit 106 detects the highest degree of similarity, the parameter storage circuit 116 stores therein (a) the highest degree of similarity and (b) start times of X1' and X2" that hold the highest degree of similarity. This is the end of the search pertaining to the example of FIG. 5.

(Sorting Based on Degree of Similarity)

Next, the parameter extraction circuit 120 (a) compares the highest degrees of similarity that are each calculated in a corresponding one of the units of processing (ith through i+2th) and are stored in the parameter storage circuit 116, and (b) extracts one or more pairs of segments in order of highest degree of similarity. Here, the parameter extraction circuit 120 extracts such pairs of segments in order of highest degree of similarity in accordance with <Formula 3>, until the time length of the output signal complies with the time axis conversion ratio $\alpha$ (time length of output/time length of input) that is set by the speed setting circuit 115 with respect to the time length of the input signal.

In the example of FIG. 5, the parameter extraction circuit 120 judges that the pair of X1 and X2 as well as the pair of X1' and X2' holds an exceptionally high degree of similarity, and that extracting these two pairs will satisfy the relationship of <Formula 3>. Accordingly, corresponding selection flags in the parameter storage circuit 116 are set to ON.

(Overlap)

Based on the start times of X1 and X2 that are stored in the parameter storage circuit 116, the pointer value calculation circuit 117 calculates a corresponding address value. Using the address value corresponding to X1 and X2 that are output by the pointer control circuit 118, X2 (511) and X1 (510), whose time lengths are each Ts, are read out from the storage circuit 101 and then output to the buffer memory circuits 104 and 103, respectively.

The window function generation circuit 107 outputs an increasing window function 512 and a decreasing window function 513. The multiplication circuit 110 first multiplies X1 (510), which is stored in the buffer memory circuit 103, by the increasing window function 512 output by the window function generation circuit 107, then outputs X1 (510). Likewise, the multiplication circuit 111 first multiplies X2 (511), which is stored in the buffer memory circuit 104, by the decreasing window function 513 output by the window function generation circuit 107, then outputs X2 (511).

The addition circuit 112 outputs a sum of the outputs (514) from the multiplication circuits 110 and 111 to the output buffer circuit 114. Then, the pointer control circuit 118 reads out X0 (516) from the storage circuit 101 and outputs X0 (516) to the output buffer circuit 114, where X0 (516) is composed of a sample that follows X1 through a sample that is right before X2'.

Next, based on the start times of X1' and X2' that are stored in the parameter storage circuit 116, the pointer value calculation circuit 117 calculates a corresponding address value. Using the address value corresponding to X1' and X2' that are output by the pointer control circuit 118, X1' and X2', whose time lengths are each Ts, are read out from the storage circuit 101 and then output to the buffer memory circuits 103 and 104, respectively.

The window function generation circuit 107 outputs the increasing window function 512 and the decreasing window function 513. The multiplication circuit 110 first multiplies X1', which is stored in the buffer memory circuit 103, by the increasing window function 512 output by the window function generation circuit 107, then outputs X1'. Likewise, the multiplication circuit 111 first multiplies X2', which is stored in the buffer memory circuit 104, by the decreasing window function 513 output by the window function generation circuit 107, then outputs X2'. The addition circuit 112 outputs a signal 517, which is a sum of the outputs from the multiplication circuits 110 and 111, to the output buffer circuit 114. Then, the pointer control circuit 118 reads out the following from the storage circuit 101, and outputs the same to the output buffer circuit 114: (a) X3 (518) composed of a sample that follows X1' through a sample that is right before X2" (519); (b) X2" (519); and (c) audio data X4 (520) composed of a sample that follows X2" (519) through a sample that is at the end point.

The above-described processing may be repeated until the end of the input signal, or may be performed only once throughout the entire input signal.

Described below is an exemplary operation performed by the conversion device of the present embodiment to compress the time axis (time axis conversion ratio $\alpha$=2/3), as illustrated in the specific example of FIG. 6 that has been explained in the first embodiment.

(ith Unit of Processing)

The following description is given under the assumption that the conversion device performs the processing on the ith unit of processing pertaining to the audio data stored in the storage circuit 110. Here, based on the pointers 602_*i* and 603_*i*, which are output by the pointer control circuit 118, the buffer memory circuits 103 and 104 read out X1(1-Ts) and X2(1-Ts), respectively. A start time of X2 can be located Tl_min to Tl_max behind a start time of X1 (604). Put another way, X2 can be located anywhere within a range of 607_min to 607_max.

The conversion device retrieves different patterns of X2 by shifting X2 to change the time difference between start times of X1 and X2 by Tl_min to Tl_max, sample by sample, and then makes the similarity calculation circuit 105 calculate a degree of similarity of each pair of X1 and X2. Once the degree of similarity of said each pair is calculated in such a manner, the judgment circuit 106 searches the highest degree of similarity, and obtains a time difference between start times of X1 and X2 that hold the highest degree of similarity as Tl_opt. Here, when the square error is used as the evaluation function to obtain the degree of similarity, the judgment circuit 106 detects the minimum square error from among all the square errors output by the similarity calculation circuit 105. On the other hand, when the correlation function is used as the evaluation function to obtain the degree of similarity, the judgment circuit 106 detects the maximum correlation function from among all the correlation functions output by the similarity calculation circuit 105. Upon obtainment of the highest degree of similarity in the above-described manner, the parameter storage circuit 116 stores therein (a) the highest degree of similarity detected by the judgment circuit 106, and (b) start times of X1 and X2 that hold the highest degree of similarity.

(i+1th Unit of Processing)

Next, based on the pointers 602_*i*+1 and 603_*i*+1, which are output by the pointer control circuit 118 in the i+1th unit of processing, the conversion device retrieves different patterns of X2' by shifting X2' to change the time difference between start times of X1' and X2' by Tl_min to Tl_max, sample by sample. Then, the similarity calculation circuit 105 calculates a degree of similarity of each pair of X1' and X2'. The judgment circuit 106 searches the highest degree of similarity, and obtains a time difference between X1' and X2' that hold the highest degree of similarity as Tl_opt. The parameter storage circuit 116 stores therein (a) the highest degree of similarity detected by the judgment circuit 106, and (b) start times of X1' and X2' that hold the highest degree of similarity.

(i+2th Unit of Processing)

The conversion device performs the same processing as described above, based on the pointers 602_*i*+2 and 603_*i*+2 that are output by the pointer control circuit 118 in the i+2th unit of processing. The parameter storage circuit 116 stores therein (a) the highest degree of similarity detected by the judgment circuit 106 and (b) start times of X1" and X2" that hold the highest degree of similarity. This is the end of the search pertaining to the example of FIG. 6. Next, the parameter extraction circuit 120 (a) compares the highest degrees of similarity that are each calculated in a corresponding one of the units of processing (ith through i+2th) and are stored in the parameter storage circuit 116, and (b) extracts one or more pairs of segments in order of highest degree of similarity. Here, the parameter extraction circuit 120 extracts such pairs of segments in order of highest degree of similarity in accordance with <Formula 4>, until the time length of the output signal complies with the time axis conversion ratio $\alpha$ (time length of output/time length of input) that is set by the speed setting circuit 115 with respect to the time length of the input signal.

(Judgment on Degree of Similarity)

In the example of FIG. 6, the parameter extraction circuit 120 judges that the pair of X1 and X2 as well as the pair of X1, and X2' holds an exceptionally high degree of similarity, and that extracting these two pairs will satisfy the relationship of <Formula 4>. Accordingly, corresponding selection flags in the parameter storage circuit 116 are set to ON. Then, based on the start times of X1 and X2 that are stored in the parameter storage circuit 116, the pointer value calculation circuit 117 calculates a corresponding address value. Using the address value corresponding to X1 and X2 that are output by the pointer control circuit 118, X1 (610) and X2 (611), whose time lengths are each Ts, are read out from the storage circuit 101 and then output to the buffer memory circuits 103 and 104, respectively.

(Overlapping X1 and X2)

The window function generation circuit 107 outputs an increasing window function 612 and a decreasing window function 613. The multiplication circuit 110 first multiplies X1 (610), which is stored in the buffer memory circuit 103, by the decreasing window function 612 output by the window function generation circuit 107, then outputs X1 (610). Likewise, the multiplication circuit 111 first multiplies X2 (611), which is stored in the buffer memory circuit 104, by the increasing window function 513 output by the window function generation circuit 107, then outputs X2 (611). The addition circuit 112 outputs a signal 614, which is a sum of the outputs from the multiplication circuits 110 and 111, to the output buffer circuit 114. Then, the pointer control circuit 118 reads out X0 (616) from the storage circuit 101 and outputs X0 (616) to the output buffer circuit 114, where X0 (616) is composed of a sample that follows X2 through a sample that is right before X1'.

Next, based on the start times of X1' and X2' that are stored in the parameter storage circuit 116, the pointer value calculation circuit 117 calculates a corresponding address value. Using the address value corresponding to X1' and X2' that are output by the pointer control circuit 118, X1' and X2', whose time lengths are each Ts, are read out from the storage circuit 101 and then output to the buffer memory circuits 103 and 104, respectively.

(Overlapping X1' and X2')

The window function generation circuit 107 outputs the decreasing window function 612 and the increasing window function 613. The multiplication circuit 110 first multiplies X1', which is stored in the buffer memory circuit 103, by the decreasing window function 612 output by the window function generation circuit 107, then outputs X1'. Likewise, the multiplication circuit 111 first multiplies X2', which is stored in the buffer memory circuit 104, by the increasing window function 613 output by the window function generation circuit 107, then outputs X2'. The addition circuit 112 outputs a signal 617, which is a sum of the outputs from the multiplication circuits 110 and 111, to the output buffer circuit 114. Then, the pointer control circuit 118 reads out audio data X4 (618) from the storage circuit 101 and outputs X4 (618) to the output buffer circuit 114, where X4 is composed of a sample that follows X2' through a segment that is at the end point.

The above-described processing may be repeated until the end of the input signal, or may be performed only once throughout the entire input signal.

As described above, the following is performed in the present embodiment. In each unit of processing, the parameter storage circuit 116 stores therein (a) the highest degree of similarity detected by the judgment circuit 106, and (b) start times of X1 and X2 that hold the highest degree of similarity. The parameter extraction circuit 120 compares the degrees of similarity, each of which is (a) stored in the parameter storage circuit 116 and (b) obtained from a different one of units of processing that are located at different times along the time axis of the audio data. Then, the parameter extraction circuit 120 extracts one or more pairs of segments in order of highest degree of similarity. As a result, the conversion device can preferentially extract, from among various pairs of segments constituting a certain part of an input signal, one or more pairs of segments that hold exceptionally high degrees of similarity and are thus best suited for weighting/addition. This has the effect of reducing problems such as a lack of sound, sound duplication, and deterioration in sound quality.

Furthermore, the parameter extraction circuit 120 extracts one or more pairs of segments holding exceptionally high degrees of similarity, from among pairs of segments that are stored in the parameter storage circuit 116 and hold the highest degrees of similarity calculated at different times along the time axis of the audio data. Here, the parameter extraction circuit 120 only extracts the necessary number of pairs of segments in accordance with <Formula 3> or <Formula 4> to comply with the desired time axis conversion ratio $\alpha$. This provides the effect of conforming to the desired time axis conversion ratio $\alpha$ finely and accurately.

Here, a pair of segments that hold high similarity to each other is generally concentrated in a soundless period and a vowel period. In view of this, the conversion device has the effect of giving the after-conversion audio data a resemblance to a change in a speech speed that a human makes while speaking.

Furthermore, the similarity calculation circuit 105 uses a single scale of evaluation (i.e., the degree of similarity) not only to determine the optimal time lag between segments holding the highest degree of similarity, but also to extract one or more pairs of segments to be weighted/added. This provides the effect of reducing the processing complexity and processing amount.

Moreover, the pointer value calculation circuit 117 calculates an address value based on parameters stored in the parameter storage circuit 116. Also, a pair of segments (X1 and X2) holding a high degree of similarity is read out from the storage circuit 101 and output into the buffer memory circuits 103 and 104. This way, under any circumstances, the time length of the output from the addition circuit 112 can be adjusted to Ts (a time length of a given unit of processing). This has the effect of preventing the decrease in sound quality.

As described above, the present embodiment realizes the speed conversion by means of hardware. It is thus possible to speed up the process of speed conversion by using a pipelined structure for a part of or all of the hardware.

Third Embodiment

The present embodiment relates to modifying the conversion device for audio playback, which has been described in the first embodiment, so as to implement the conversion device into a playback device that plays back video and audio.

Figure 21:
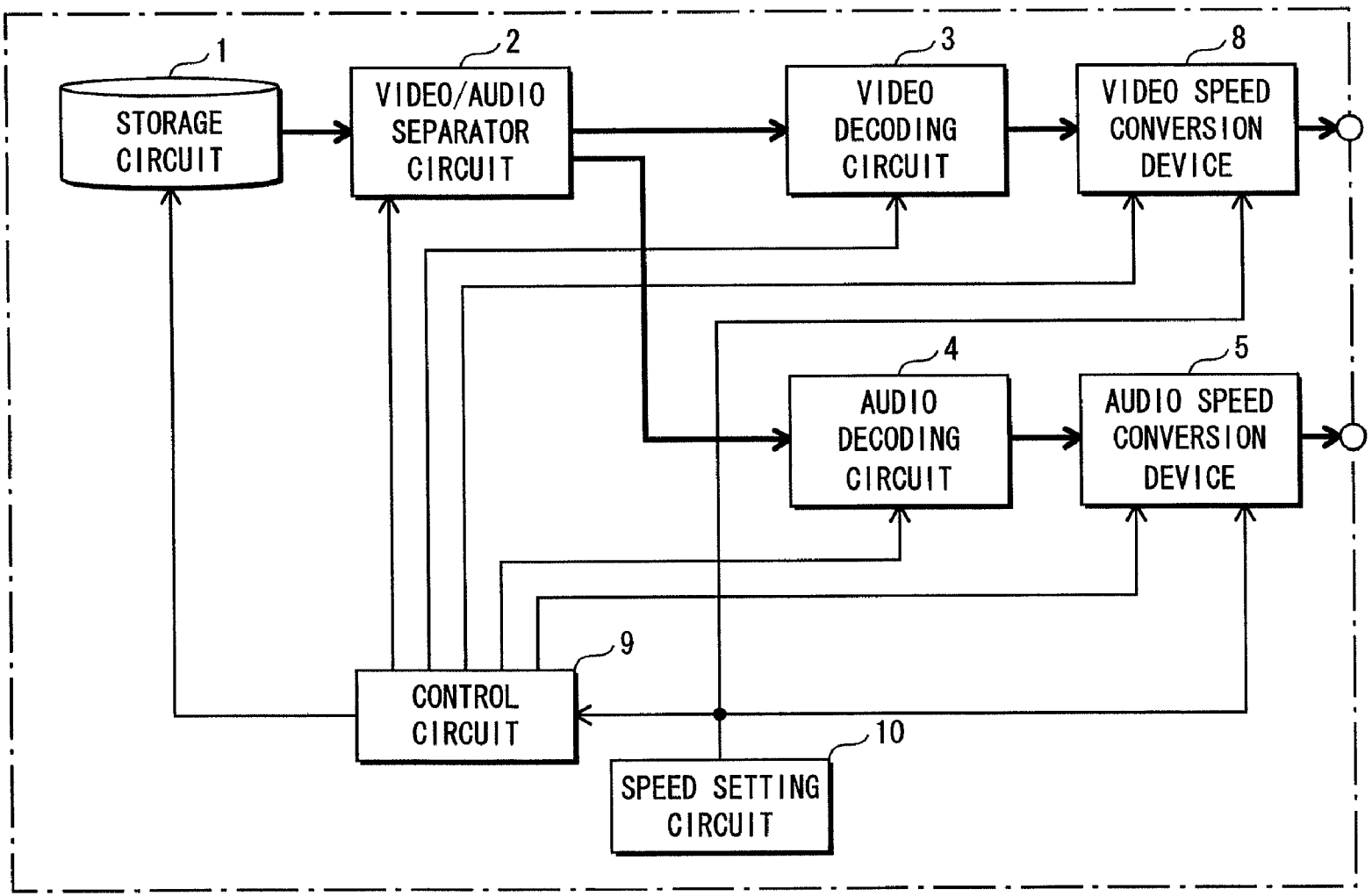
FIG. 21 shows an internal structure of a playback device into which a conversion device pertaining to a third embodiment is implemented.

FIG. 21 shows an internal structure of a playback device into which a conversion device pertaining to the third embodiment is implemented. As shown in FIG. 21, the playback device pertaining to the present embodiment includes: a storage circuit 1; video/audio separator circuit 2; a video decoding circuit 3; an audio decoding circuit 4; an audio speed conversion device 5; a video speed conversion device 8; a control circuit 9; and a speed setting circuit 115.

Based on the time axis conversion ratio $\alpha$ output by the speed setting circuit 115, the video speed conversion device 8 performs speed conversion processing on a video signal output by the video decoding circuit 3. The video speed can be converted by (a) repeatedly outputting the same video frame (or, freezing an output video frame) when extending the time axis (time axis conversion ratio $\alpha>1$), and (b) skipping one or more video frames so as to output only unskipped video frames when compressing the time axis (time axis conversion ratio $\alpha<1$). Especially when compressing the time axis, skipping B-pictures allows bypassing the processing to decode B-pictures in the video decoding circuit 3. The video speed conversion device 8 performs speed conversion processing by freezing/skipping video frames almost linearly (evenly), such that the video output after the speed conversion processing looks smooth when played back.

The audio speed conversion device 5 is the same as the one explained in the second embodiment. Based on the time axis conversion ratio $\alpha$ output by the speed setting circuit 115, the audio speed conversion device 5 performs speed conversion processing on the audio data output by the audio decoding circuit 4. The audio speed conversion device 5 performs the speed conversion processing by preferentially extracting and performing weighting/addition on one or more pairs of segments that hold exceptionally high degrees of similarity. Accordingly, the audio data is extended/compressed mainly in soundless periods and sound periods, with the result that the audio speed changes non-linearly.

The control circuit 9 outputs (a) to the storage circuit 1, an address for outputting desired data, (b) to the video/audio separator circuit 2, a video identification number and an audio identification number for identifying and extracting video data audio data, respectively, (c) to the video decoding circuit 3, a video decoding control signal requesting a normal playback, a special playback, etc., (d) to the video speed conversion device 8, a video speed conversion control signal requesting initiation/termination of the speed conversion processing, etc., (e) to the audio decoding circuit 4, an audio decoding control signal requesting a normal playback, a special playback, etc., and (f) to the audio speed conversion device 5, an audio speed conversion control signal requesting initiation/termination of the speed conversion processing, etc.

The speed setting circuit 115 outputs information on the desired time axis conversion ratio $\alpha$ to the video speed conversion device 8, the audio speed conversion device 5 and the control circuit 9.

As described above, according to the present embodiment, the video speed conversion device 8 performs the speed conversion processing on the video signal almost evenly—i.e., linearly—with respect to the time axis in accordance with the time axis conversion ratio $\alpha$. In contrast, the audio speed conversion device 5 performs the speed conversion processing on the audio data unevenly—i.e., nonlinearly—with respect to the time axis in accordance with the time axis conversion ratio $\alpha$. Accordingly, the speed conversion processing performed on the video signal can be simple but can make the video signal look steady and smooth. Also, the speed of the audio data can be converted naturally, with the result that the after-conversion audio data sounds similar to a change in a speech speed that a human makes while speaking.

There is a possibility that the video may get out of sync with the audio along the way. However, as the audio speed conversion device 5 performs the speed conversion nonlinearly yet accurately in accordance with the time axis conversion ratio $\alpha$, the present embodiment still provides the effect of making a time length of video to match a time length of audio at least by the end of conversion.

Furthermore, as described in the first embodiment, the audio speed conversion device 5 performs the processing once every Tr (a predetermined time range). Hence, the present embodiment also provides the effect of making a time length of video to match a time length of audio at least once every Tr.

Fourth Embodiment

The present embodiment relates to modifying the playback device explained in the first and second embodiments, so that the playback device can set the time range Tr and the conversion ratio $\alpha$ in performing the speed conversion based on a GUI operation by a user. The playback device of the present embodiment displays a setup menu (e.g., the one illustrated in FIG. 22) and receives specific instructions for speed conversion via this setup menu.

Figure 22:
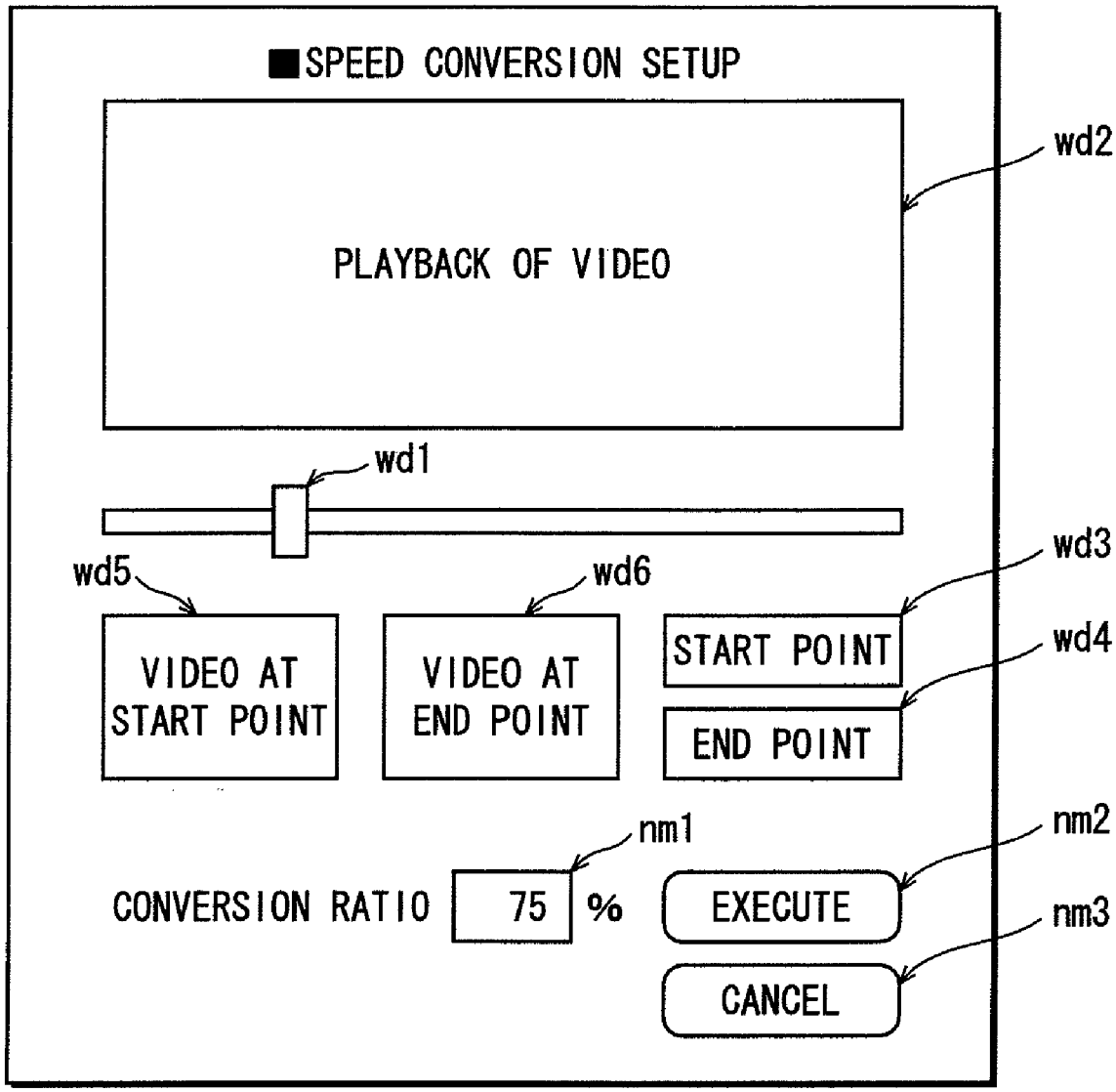
FIG. 22 shows an example of a setup menu for speed conversion.

FIG. 22 shows an example of a setup menu for speed conversion.

The setup menu contains GUI components, such as: a slidebar wd1; a window wd2; a start point button wd3; an end point button wd 4; time range Tr navigations wd5 and wd6; a numerical value field nm1; a playback button nm2; and a cancel button nm3.

The slidebar wd1 is a GUI component that receives, from a user, an operation for specifying the start point and the end point. This operation for specifying the start/end points can be performed as follows: (a) shifting the slidebar to the left or right along a guide by pressing left/right buttons on a remote control; then (b) converting a location of the slidebar along the guide into a corresponding location in the video signal. For example, if the target of speed conversion is a two-hour video signal and the slidebar is located in the middle of the guide, the corresponding location in the video signal would be a time point that is an hour past the start of the video signal.

The window wd2 displays a part of the video signal that corresponds to the location of the slide bar. Fine adjustments of the start/end points are made possible by (a) the operation for specifying the start/end points with use of the slide bar and (b) a feedback provided by the window wd2.

The start point button wd3 and the end point button wd4 are GUI components for setting the location of the slide bar on the guide as the start point or end point. The start point and the end point of the time range Tr are set by pressing the start point button and the end point button, respectively. This defines the time range Tr.

The time range Tr navigations wd5 and wd6 visually present the time range Tr defined by (a) positioning the start/end points with use of the slide bar and (b) setting the start/end points by pressing the start point button and the end point button. The time range Tr navigations wd5 and wd6 show the time range Tr by displaying thumbnail images taken from the video at the start/end points of the time range Tr.

The numerical value field nm1 receives a numerical value representing the time axis ratio $\alpha$. This can be done by inputting a numerical value ranging from 1 to 200 to the numerical value field nm1.

The playback button nm2 receives an instruction to (a) perform the speed conversion based on the time range Tr and the numerical value $\alpha$ that are set in the above-described manner, and (b) play back the audio obtained from the speed conversion, together with the video.

The cancel button nm3 receives an operation to null the settings on the setup menu.

The setup menu is written using OSD (On-screen Display) graphics or BML (Broadcast Markup Language). The playback device superimposes the setup menu on the video played back, and makes the conversion device perform the speed conversion after setting the time range Tr or the ratio $\alpha$ in accordance with the operation pertaining to the setup menu.

As stated above, according to the present embodiment, it is possible to interactively adjust (a) a position of the time range Tr (the target of speed conversion) along the time axis, and (b) a corresponding ratio $\alpha$. This makes audio obtained from the speed conversion more listener-friendly.

Fifth Embodiment

In the first and second embodiments, a degree of similarity of each pair of segments is calculated in every unit of processing, followed by the ranking of the pairs of segments in order of highest degree of similarity. The present embodiment proposes a modification to that—i.e., skipping the ranking of the pairs of segments. Instead of ranking the pairs of segments, the present embodiment introduces a threshold value for the degree of similarity. Specifically, in the flowcharts of FIGS. 7, 8, 12 and 13, one of X1 and X2 is regarded as a base segment and is shifted by a time interval $\Delta$Td. Here, the other one of X1 and X2 (hereafter, "a subsidiary segment") is shifted such that a start time thereof is ahead of or behind a start time of the base segment by Tl_max to Tl_min; this generates various patterns of the subsidiary segment. Then, a square error pertaining to the base segment and each subsidiary segment is calculated. Each time the square error is calculated in such a manner, the conversion device judges whether the square error is smaller than the threshold value. When the square error is judged to be smaller than the threshold value, a corresponding pair of X1 and X2 is regarded as an overlap target. Then, the base segment is shifted. In other words, in shifting X2 by Tl_max to Tl_min, the conversion device does not select X2 that holds the highest similarity to the base segment. Instead, in shifting X2, the conversion device terminates the search for the minimum square error upon detecting a minimum square error that is smaller than the threshold value, and selects the base segment and this X2 as overlap targets.

The aforementioned process is performed when the degree of similarity is expressed by a minimum square error. When the degree of similarity is expressed by a correlation function, the conversion device judges whether or not the degree of similarity is greater than the threshold value.

In overlapping each selected pair of segments, a time difference between the segments is accumulated one after another. This overlap processing is repeated as long as the accumulated total of the time differences satisfies the relationship of <Formula 3> or <Formula 4>. The overlap processing is terminated when the accumulated total has exceeded the target time length that is shown in the left-hand sides of <Formula 3> and <Formula 4>. That is to say, in the first embodiment, the conversion device (a) extracts the necessary number of pairs of segments to satisfy the relationship of <Formula 3> or <Formula 4>, (b) ranks the extracted pairs of segments are in order of highest degree of similarity, and (c) outputs the ranked pairs of segments in accordance with the playback time axis. However, in the present embodiment, the conversion device skips such ranking processing, and instead performs overlap processing until the relationship of <Formula 3> or <Formula4> are satisfied. Such a speed conversion can not only realize a real-time execution of speed conversion, but also allow implementing the speed conversion into general household appliances.

(Additional Remarks)

Although the best mode known to the applicant at the time the application was filed has been described above, further improvements and modifications can be added in relation to the technical topics shown below. It should be noted that whether or not to implement the above embodiments just as explained therein, as well as whether or not to perform these improvements and modifications, is arbitrary and depends on the intentions of the executor of the invention.

(Time Range Tr)

The time range Tr specified by the user may be specified as a playback period included in a playlist. The conversion device may perform the speed conversion and generate audio data for trick playback upon creation of the playlist.

(Development into Real-Time Recording)

It is necessary that the audio data be stored in the storage circuit, because the foregoing description is based on the premise that pairs of segments that each hold the highest degree of similarity are extracted from the entire audio data. However, if such pairs of segments are to be extracted from a part of the audio data, the speed conversion of the present invention can be performed even while recording the audio data or during play back thereof.

(Adapting Converted Audio Data to Original Audio Data)

It is desirable that the audio data for trick playback, which is the result of the speed conversion, be recorded on a recording medium together with the original audio data in a multiplex manner. It is also permissible that main-path information and sub-path information of playlist information specify the original audio data and the audio data for trick playback, respectively, such that they make up one playback path together.

(Development into Authoring Technology)

The speed conversion of the present invention may be implemented into an authoring system. In this case, an audio stream obtained from the speed conversion may be recorded on DVD or BD-ROM as sub-audio for a movie and then be distributed to a user. This way a playback device can play back the audio stream obtained from the speed conversion of the present invention by, upon trick playback of the movie recorded on DVD or BD-ROM, selecting the audio stream obtained from the speed conversion as the sub audio. This enables the user to learn the content of the movie in a short period of time during the trick playback of the movie, with listener-friendly, clear audio.

(Development of Audio Abstract)

The speed conversion of the present invention may be applied to technology for generating an audio abstract. More specifically, with use of the setup menu explained in the third embodiment, the conversion generates an audio abstract in advance, the audio abstract meaning audio data whose $\alpha$ is set to a small value (5%, 10%, etc.). This way, while a list of thumbnails showing different videos is displayed on GUI of a program navigation, selecting one of the thumbnails allows playing back a corresponding audio abstract. This enables the user to learn the content of the selected video (thumbnail) in a short period of time, and thus to make a proper judgment on whether or not to play back the same.

(Scale of Evaluation to Obtain Degree of Similarity)

As mentioned in the first embodiment, in Steps S709 and S809 that are respectively included in the flowcharts of FIGS. 8 and 13, the smallness of the unnormalized square error (shown in <Formula 1>) or the greatness of the unnormalized correlation function is used as the scale of evaluation to obtain a degree of similarity. However, it is also permissible to use the smallness of a normalized square error or the greatness of a normalized correlation function as the scale of evaluation. In this case, although the processing amount will be increased, the scale of evaluation is not dependent on the amplitude of the audio data. Consequently, the degree of similarity can be obtained without being affected by the amplitude of the audio data, with the promising result that the sound quality is improved.

(Time Length of Output Y(n) of Audio Data)

As mentioned in the first embodiment, in Steps S743 and S843 that are respectively included in the flowcharts of FIGS. 10 and 15, a signal Y(n) of a fixed time length Ts is output, the signal Y(n) being obtained by performing weighting/addition on X1(*n*) and X2(*n*) based on <Formula 5>. However, the time length of the output Y(n) of the audio data, on which weighting/addition has been performed, may be variable. Here, for example, if the time lag Tl_opt between two segments holding the highest degree of similarity is shorter than the time length Ts of the unit of processing, then setting the length of each weighting/addition to Tl_opt will reduce unnecessary weighting/addition. This is expected to result in (a) reduction in the processing amount and improvement in audio quality, or (b) that the time axis conversion ratio $\alpha$ can be set to a small value when shortening the time axis.

(Selection Target)

As mentioned in the first embodiment, in Steps S703-721 and S803-S821 that are respectively included in the flowcharts of FIGS. 7 and 12, the highest degree of similarity R(j) (here, j denotes 0-i) is calculated at intervals of $\Delta$Td at one time, from the start point to the end point. Also, in Steps S722-S736 and S822-S836 that are respectively included in the flowcharts of FIGS. 9 and 14, the conversion device (a) compares the highest degrees of similarity calculated, again at one time, then (b) from among the highest degrees of similarity, extracts one or more degrees of similarity in order of highest degree of similarity. However, it is not imperative that each processing in the above-mentioned steps is performed at one time; instead, it may be performed at intervals of a time range Tr. This can reduce the storage capacity required in Steps S715-S718 of FIG. 7 and Steps S815-S818 of FIG. 12. Moreover, by performing each processing at certain intervals that each contains a plurality of texts, it is possible to (a) prevent the desired time axis conversion ratio $\alpha$ from widely straying off its original ratio from the start point through the end point, and (b) effectively extend the time axis, including soundless periods that are between texts.

(Time Length of Interval)

As mentioned in the first embodiment, in Steps S719 and S819 that are respectively included in the flowcharts of FIGS. 7 and 12, the highest degree of similarity (Tl_opt) is calculated at intervals of $\Delta$Td. However, it is permissible to change this interval of $\Delta$Td. In such a case, for example, when the time lag Tl_opt between segments holding the highest degree of similarity is small, the audio data after weighting/addition can be output at shorter intervals by decreasing the time length of each interval $\Delta$Td. This can consequently increase the range of the time axis conversion ratio $\alpha$.

(Extraction Target)

As mentioned in the first embodiment, in Steps S736 and S836 that are respectively included in the flowcharts of FIGS. 9 and 14, one or more pairs of segments holding the exceptionally high degrees of similarity are extracted until the desired time axis conversion ratio $\alpha$ is achieved. Instead, however, it is permissible to extract one or more pairs of segments whose degrees of similarity are each higher than a threshold value. This allows performing the audio speed conversion processing while maintaining a specific level of quality in accordance with characteristics of the input signal.

(Unit of Read-in of Audio Data)

As mentioned in the first embodiment, in Steps S707 and S708 that are respectively included in the flow charts of FIG. 8 and in Steps S807 and S808 that are respectively included in the flow charts of FIG. 13, the audio data is read in increments of Ts (unit of processing). The audio data may, however, be read in larger increments. For example, it is permissible to read in the entire audio data, which is used in Steps S700-S721 and S800-S821 of FIGS. 7 and 13, at one time. In such a case, a storage capacity for reading in the audio data is required in the beginning. Later on, however, processing for reading in segments can be performed only by shifting the pointers. This can eliminate needless, redundant processing for reading in the audio data, rendering the processing efficient and speedy.

(Scale of Evaluation)

In the present embodiment, the similarity calculation circuit 105 uses the smallness of the unnormalized square error or the greatness of the unnormalized correlation function. However, it is also permissible to use the smallness of a normalized square error or the greatness of a normalized correlation function as the scale of evaluation. In this case, although the processing amount will be increased, the scale of evaluation is not dependent on the amplitude of the audio data. Consequently, the degree of similarity can be obtained without being affected by the amplitude of the audio data, with the promising result that the sound quality is improved.

(Size of Unit of Processing)

In FIG. 17 of the second embodiment, the buffer memory circuits 103 and 104 read in, from the storage circuit 101, the audio data in increments of Ts (time length of each unit of processing). However, they may read in the audio data in larger increments. For example, when calculating a degree of similarity of each pair of X1 and X2 by changing the time difference therebetween, and when performing weighting/addition on pairs of segments extracted by the parameter extraction circuit 120, an access to the storage circuit 101 can be prohibited by the buffer memory circuits 103 and 104 reading in either (a) segment from the start time of 504_max through the end time of 509 when extending the time axis as shown in FIG. 5, or (b) segments from the start time of 604 through the end time of 609_max when compressing the time axis as shown in FIG. 6. This reduces the number of transfers made from the storage circuit 101 to the buffer memory circuits 103 and 104, and thus reduces the processing time.

(Development into System LSI)

Regarding the playback device and the conversion device of FIG. 1 (explained in the first embodiment), the conversion device of FIG. 17 (explained in the second embodiment) and the playback device of FIG. 21 (explained in the third embodiment), their internal structures may each be formed as a single system LSI.

A system LSI is a packaged large-scale integrated chip constituted by mounting bare chips on a high-density substrate. By mounting a plurality of bare chips on a high-density substrate, a package in which a plurality of bare chips are provided with the outward appearance of a single LSI is also included as a system LSI (this type of system LSI is referred to as a multichip module).

Focusing now on the types of packages, system LSIs include quad flat packages (QFP) and pin grid arrays (PGA). With a QFP, pins are attached to the four-sides of the package. With a PGA, the majority of pins are attached to the bottom of the package.

These pins act as interfaces to other circuits. Given that the pins in a system LSI have this role as interfaces, the system LSI acts as the core of the playback device if other circuits are connected to these pins in the system LSI.

The system LSI can be incorporated not only in a playback device, but also in various devices capable of video playback, such as a television, game console, personal computer, or "One-Seg" mobile phone. This allows the present invention to be used in a wide variety of ways.

Figure 23:
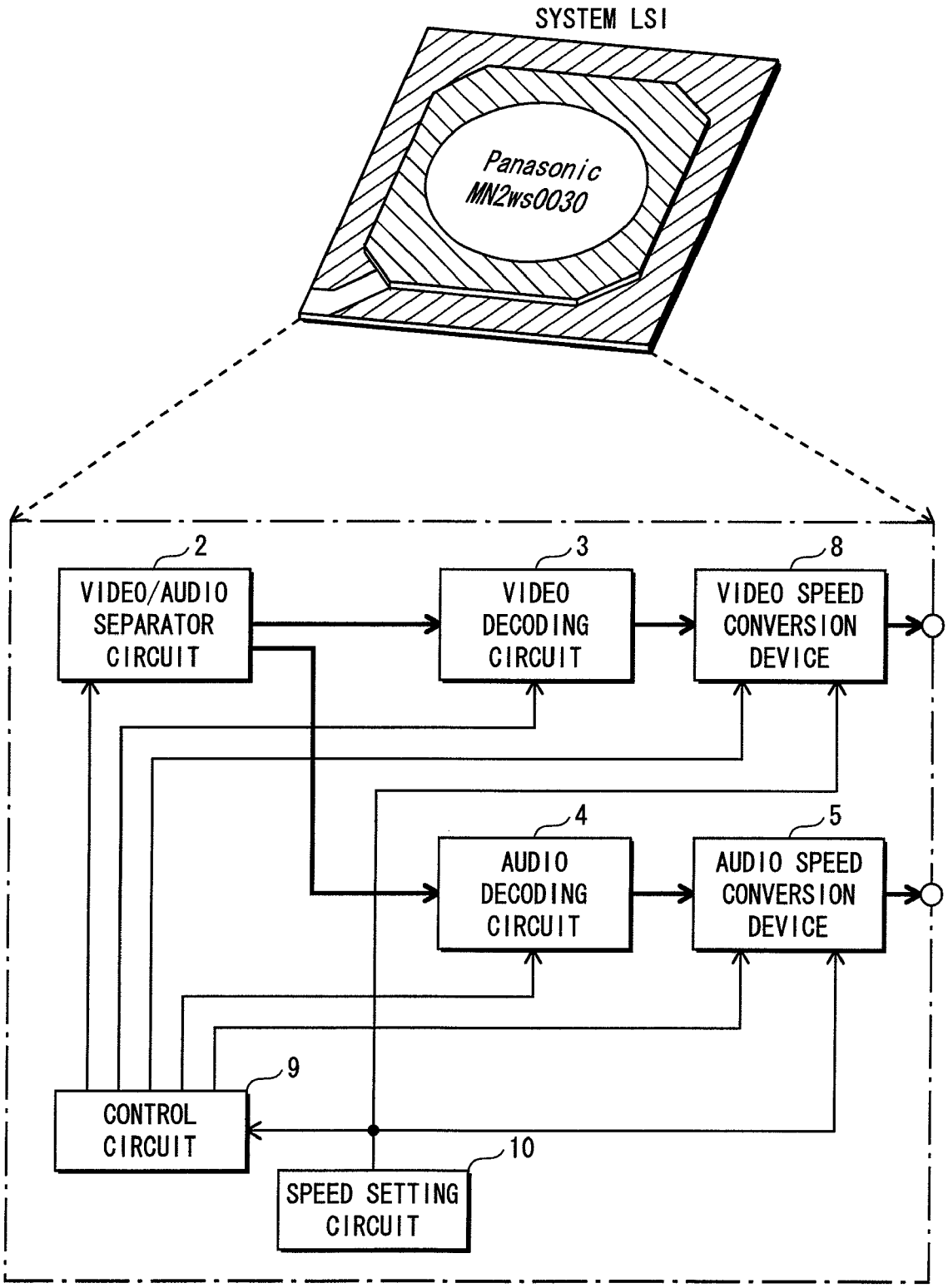
FIG. 23 schematically shows a system LSI into which an internal structure of the playback device, which is explained in the third embodiment, is implemented.

FIG. 23 schematically shows a system LSI into which the internal structure of the playback device, which is explained in the third embodiment, is implemented.

The following are details of specific production procedures. First, a circuit diagram of portions to be included in the system LSI is created based on the structure diagram shown in the embodiments, and the constituent elements in the structure diagrams are realized using circuit elements, ICs and LSIs.

Buses connecting the circuit elements, ICs and LSIs, as well as interfaces with peripheral circuits and external devices are defined as the constituent elements are realized. Furthermore, connection lines, power lines, ground lines, clock signal lines and the like are defined. In these definitions, the operation timings of each constituent element are adjusted taking in account the specifications of the LSI, and other adjustments, such as ensuring the bandwidth necessary for each constituent element, are made as well. The circuit diagram is thus completed.

It is preferable to design the general parts of the internal structures of the embodiments by combining intellectual property defined as pre-existing circuit patterns. For the characteristic parts, it is preferable to perform top-down design with use of descriptions of a high level of HDL abstraction or a register transfer level.

After the circuit diagram is completed, implementation designing is performed. Implementation designing refers to the creation of a substrate layout that determines where on the substrate to place the parts (circuit elements, ICs, LSIs) in a circuit diagram created by circuit designing, and how to wire connection lines in the circuit diagram on the substrate.

Figure 24:
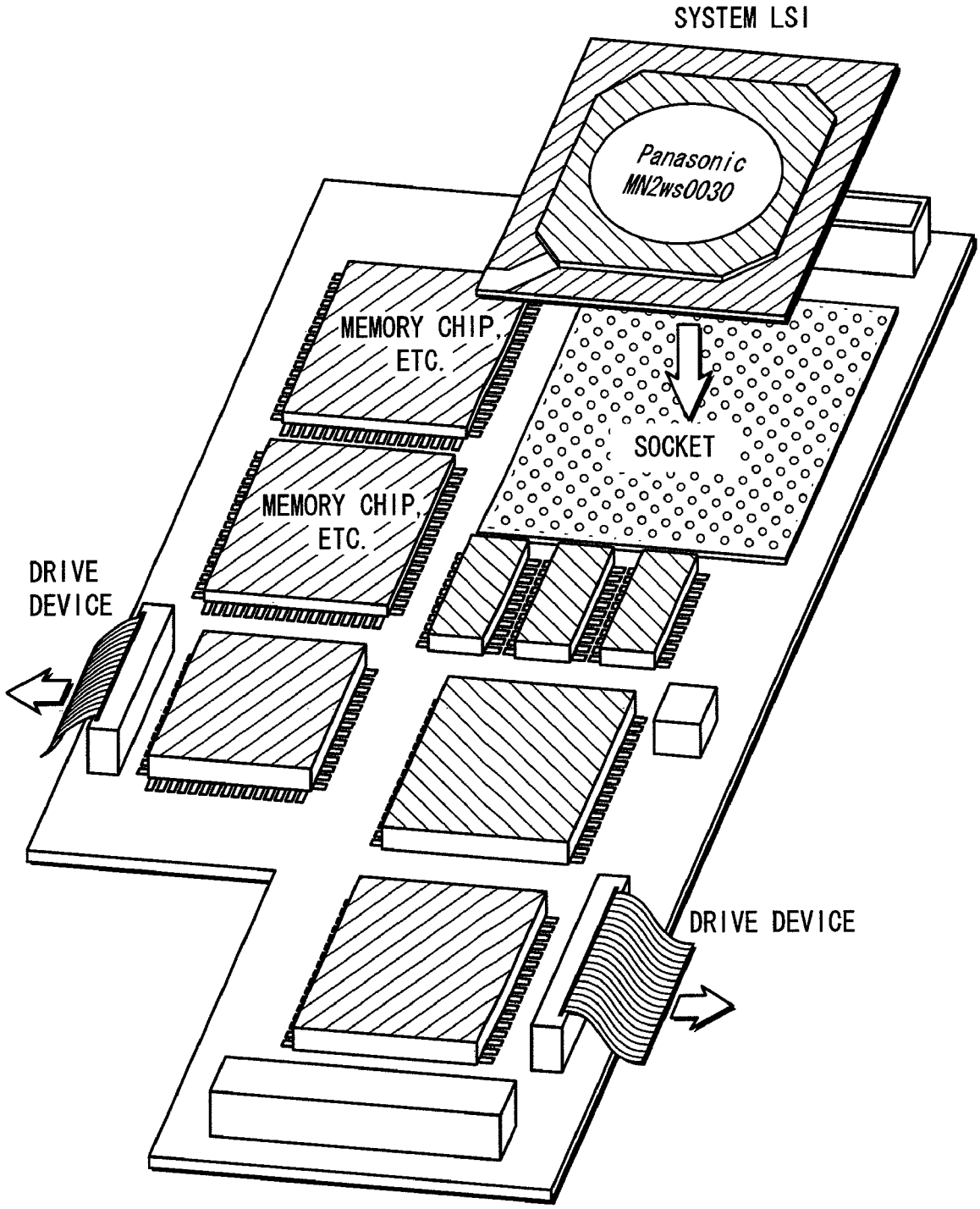
FIG. 24 shows the system LSI, which is created as shown in FIG. 23, being implemented into a device.

After the implementation designing is performed and the layout on the substrate is determined, the implementation designing results are converted into CAM data, and the CAM data is output to an NC machine tool etc. An NC machine tool performs SoC (System on Chip) implementation or SiP (System in Package) implementation based on the CAM data. SoC implementation is a technique for fusing a plurality of circuits to a single chip. SiP implementation is a technique for using resin or the like to form a plurality of chips into a single package. The above-described procedure will produce the system LSI of the present invention, based on the internal structure of the playback device explained in the embodiments. FIG. 24 shows the system LSI, which is created in the above-described manner, being incorporated in a device.

Note that an integrated circuit generated as described above may also be referred to as an IC, an LSI, a super LSI, or an ultra LSI, depending on the degree of integration.

When the system LSI is realized using FPGA, a plurality of logic elements are disposed in a lattice pattern, and connecting wiring vertically and horizontally in accordance with input/output composites listed in a LUT (Look Up Table) enables realizing the hardware structure indicated in the embodiments. LUTs are stored in an SRAM, and since contents of the SRAM are lost when the power is turned off, it is necessary when using FPGA to write the LUTs that realize the hardware structure indicated in the embodiments to the SRAM in accordance with a definition in the configuration information. Furthermore, it is preferable to realize an image demodulation circuit that stores a decoder internally by a DSP that includes a product-sum operation function.

(Architecture)

Since the system LSI of the present invention is assumed to realize the function of a playback device, it is desirable to make the system LSI compliant with UniPhier architecture.

A system LSI that is compliant with UniPhier architecture is constituted from the following circuit blocks.

Data Parallel Processor (DPP)

This is a SIMD-type processor in which a plurality of element processors operate identically and, by causing the computing units in the element processors to operate at the same time with a single instruction, achieves parallel decoding processing on a plurality of pixels that compose a picture.

Especially, real-time speed conversion processing is made possible by using SIMD processor for the comparison circuit 402 explained in the second embodiment, so as to perform parallel processing for ranking Ts pairs of segments in order of highest degree of similarity. In a case where the speed conversion is implemented into a playback device in the form of hardware, real-time speed conversion processing is made possible by modifying the architecture of the conversion device.

Instruction Parallel Processor (IPP)

The instruction parallel processor is constituted from an instruction RAM, an instruction cache, a data RAM, a "Local Memory Controller" composed of a data cache, an instruction fetch unit, a decoder, an execution unit, a "Processing Unit" composed of a register file, and a "Virtual Multi Processor Unit" that causes the Processing Unit to perform parallel execution of a plurality of applications.

CPU Block

The CPU block is constituted from an ARM core, an external bus interface (Bus Control Unit: BCU), a DMA controller, a timer, and a vector interruption controller that are peripheral circuits, and peripheral interfaces such as an UART, a GPIO (General Purpose Input Output), and a synchronization serial interface. The controller described above is implemented in a system LSI as the CPU block.

Stream I/O Block

The stream I/O block performs data input/output between a drive device, a hard disk drive device, and an SD memory card drive device connected on an external bus, via a USB interface or an ATA packet interface.

AV I/O Block

The AV I/O block is composed of an audio input/output, a video input/output, and an OSD controller, and performs data input and output with a television and an AV amp.

Memory Control Block

This is a block that realizes reading/writing from/to an SD-RAM connected via an external bus, and is composed of an internal bus connection unit that controls internal connections between the blocks, an access control unit that performs data transfers to/from the SD-RAM externally connected to the system LSI, and an access schedule unit that adjusts SD-ROM access requests from the blocks.

(Production Configuration of Program of Present Invention)

A program of the present invention is an executable format program (object program) that can be executed by a computer, and is constituted by one or more program codes that make the computer execute each step of the flowcharts explained in the embodiments and every procedure of functional constituent elements. There is a wide variety of program codes, such as a native code of a processor, JAVA™ bytecode, etc.

The program pertaining to the present invention can be made as follows. To begin with, a programmer firstly writes a source program that realizes the flowcharts and the functional constituent elements. The source program that the programmer writes embody the flowcharts and functional constituent elements, using class structures, variables, array variables, and external function calls, in accordance with the structure of a programming language.

The created source program is provided to a compiler as a file. The compiler translates this source program to create an object program.

Once the object program has been generated, the programmer runs a linker on this program. The linker allots the object program and related library programs to memory space and combines them into one to generate a load module. The generated load module is premised on reading by a computer, and causes the computer to execute the processing procedures shown in the flowcharts and the processing procedures of the functional constituent elements. The program pertaining to the present invention can be created through this processing.

(Execution Time of Program)

If the length of an execution period required to execute one instruction is equal to that of a fetch period required to retrieve one instruction, a processing period of the program pertaining to the present invention is determined by the number of words per instruction word length or per unit of fetch in MPU, under the assumption that the number of instructions required to execute the procedures of the flowcharts is the number of effective steps Ta. More specifically, the processing period of said program can be calculated according to the following formula: the number of effective steps Ta×fetch cycle×(the number of words per instruction word length/the number of words per unit of fetch).

Assume that the depth and pitch of the pipeline are D and P seconds, respectively. In a case where MPU explained in the first embodiment executes said program in a pipeline manner, it takes (D+Ta−1)×P seconds to execute the same. It is necessary to examine whether or not said program can be executed real-time in the light of the calculated time.

In realizing such real-time processing, it is desirable to determine the sizes of an operation clock and memory of the device in the light of the calculated processing time.

(Parallelization)

The program pertaining to the present invention can be divided into two parts: a parallelizable part and a non-parallelizable (sequential) part. It is assumed that the ratio of the parallelizable part and the non-parallelizable part is F: (1-F).

Assume that the processing time of the program pertaining to the present invention is A. When executing said program using n processors (n represents the number of processors) concurrently, a processing time B of the present invention would be expressed as follows according to Amdahl's law.

$$\text{Processing Time } B=A\times F/n+A\times(1-F)$$

In order to make these n processors execute the speed conversion, it is desirable to first divide a time range Tr by n (the number of the processors) as well as the target time length shown in Formulae 3 and 4 by n, and then make n processors concurrently perform the speed conversion on the audio data.

A control unit, which performs the above Parallelization, may be a tightly-coupled multiprocessor system containing a plurality of MPUs that have access to a central shared memory. Or, the control unit may be a loosely-couple multiprocessor system containing a plurality of MPUs that share a bus and a communication line.

(Real-Time OS)

It is desirable to run the program pertaining to the present invention on a real-time OS (RTOS). The real-time OS allows prediction of the worst-case length of execution time, which has the benefit of making the stated parallelization possible.

The real-time OS comprises a kernel and a device driver.

The kernel performs the following: a system call processing; an interrupt handler initiation processing that initiates an interrupt handler with use of an interrupt signal; and an interrupt handler termination processing that terminates the interrupt handler.

The device driver comprises: an interrupt handler unit that is initiated by a hardware-like interrupt signal; an interrupt task unit; and a request processing unit. The device driver may be realized in the form of a system call or an application task. In a case where the device driver is realized in the form of a system call, the device driver is mapped into the memory space of the system and runs in a privileged mode.

The real-time processing can be realized by first implementing software-like constituent elements shown in the drawings as tasks in RTOS, and then making them operate.

INDUSTRIAL APPLICABILITY

The above embodiments disclose internal structures of a playback device of the present invention. Since the playback device can obviously be mass-produced according to the internal structures, the device is industrially applicable. The playback device can not only change the duration time of audio data without changing the fundamental frequency thereof, but also prevent the decrease in audio clarity even after performing the speed conversion. A user can thereby use the playback device when playing back an audio signal recorded on a disc medium or in a semiconductor memory at a speed the user desires or a speed that makes the audio easy-to-listen. Accordingly, the playback device can be applied to development of products in the field of DVD±R players, DVD±R recorders, hard disk recorders, broadcast receivers, or video recorders using a semiconductor memory, etc.

The invention claimed is:

1. A conversion device, comprising:

a segment processing unit operable to (a) select at least one pair of segments from a plurality of segments constituting original audio data and (b) perform segment processing so as to overlap playback periods of the selected pair of segments; and a generation unit operable to generate after-conversion audio data by arranging the overlapped segments and unoverlapped segments in playback order, the unoverlapped segments being remainders of the plurality of segments, wherein along a time axis of the original audio data, a positional relationship between the overlapped segments and the unoverlapped segments is non-linear, one of the overlapped segments is a base segment while the other is a subsidiary segment, the base segment is included in the plurality of segments that are positioned at certain time intervals throughout the original audio data, the subsidiary segment is positioned away from the base segment by a maximum time lag to a minimum time lag, and each of the certain time intervals is greater than the minimum time lag.

2. The conversion device of claim 1, further comprising:

a calculation unit operable to (a) generate all possible pairs of the plurality of segments and (b) calculate a degree of similarity pertaining to each possible pair of the plurality of segments, wherein the overlapped segments are one of the all possible pairs of the plurality of segments that holds the highest degree of similarity, and the unoverlapped segments are included in remainders of the all possible pairs of the plurality of segments.

3. The conversion device of claim 2, wherein the segment processing unit includes a selection subunit operable to (a) obtain a time difference between each of the at least one pair of segments to be overlapped and (b) accumulate the time difference, and the selection subunit selects, one by one, the at least one pair of segments to be overlapped, as long as the following condition is satisfied: the accumulated time difference is equal to or smaller than a target time length, which is a time length of the after-conversion audio data.

4. The conversion device of claim 3, wherein under an assumption that a ratio between a time length of the original audio data and the target time length is $\alpha$, when the after-conversion audio data is shorter than the original audio data, the target time length is the time length of the original audio data×$(1-\alpha)$, and when the after-conversion audio data is longer than the original audio data, the target time length is the time length of the original audio data×$(\alpha-1)$.

5. The conversion device of claim 1, wherein the minimum time lag approximates a time length of a minimum cycle of an input signal, and the maximum time lag approximates a time length of a maximum cycle of the input signal, in the original audio data, there is a gap of time between the base segment and the subsidiary segment when the following conditions are satisfied: (a) a time length of the base segment is an intermediate value between the minimum time lag and the maximum time lag; and (b) the subsidiary segment is positioned away from the base segment by the maximum time lag, and in the original audio data, the base segment and the subsidiary segment overlap when the following conditions are satisfied: (a) the time length of the base segment is the intermediate value between the minimum time lag and the maximum time lag; and (b) the subsidiary segment is positioned away from the base segment by the minimum time lag.

6. The conversion device of claim 1, wherein when the after-conversion audio data is shorter than the original audio data, the subsidiary segment is positioned behind the base segment along the time axis of the original audio data, and when the after-conversion audio data is longer than the original audio data, the subsidiary segment is positioned ahead of the base segment along the time axis of the original audio data.

7. The conversion device of claim 1 implemented as an audio conversion device into a playback device that plays back and outputs video and audio, wherein the playback device includes a video conversion device that converts a playback speed of the video, and the video conversion device converts the playback speed of the video by freezing or skipping a part of a plurality of frames constituting video data.

* * * * *